US012643761B2

(12) United States Patent
Biernath et al.

(10) Patent No.: US 12,643,761 B2
(45) Date of Patent: Jun. 2, 2026

(54) HAND TAPE APPLICATOR AND SYSTEM INCLUDING SAME

(71) Applicant: 3M INNOVATIVE PROPERTIES COMPANY, St. Paul, MN (US)

(72) Inventors: Rolf W. Biernath, Wyoming, MN (US); James J. Kobe, Goodyear, AZ (US); Victor F. Vance, Woodbury, MN (US); Bridget E. Nyland, Minneapolis, MN (US); Marti Marie Joyer Platta, Vadnais Heights, MN (US); Kaitlyn M. Lahti, Minneapolis, MN (US); Taylor J. Kobe, Woodbury, MN (US); Damien Latron, Burghfield (GB); Ann Marie Przepasniak, Woodbury, MN (US); Chase M. O'Brien, Roseville, MN (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 352 days.

(21) Appl. No.: 18/554,083

(22) PCT Filed: Apr. 7, 2022

(86) PCT No.: PCT/IB2022/053296
§ 371 (c)(1),
(2) Date: Oct. 5, 2023

(87) PCT Pub. No.: WO2022/215039
PCT Pub. Date: Oct. 13, 2022

(65) Prior Publication Data

US 2024/0034590 A1 Feb. 1, 2024

Related U.S. Application Data

(60) Provisional application No. 63/172,434, filed on Apr. 8, 2021, provisional application No. 63/172,443, filed on Apr. 8, 2021.

(51) Int. Cl.
*B65H 35/00* (2006.01)

(52) U.S. Cl.
CPC ..... *B65H 35/0033* (2013.01); *B65H 2220/01* (2013.01); *B65H 2220/03* (2013.01); *B65H 2301/5161* (2013.01); *B65H 2701/377* (2013.01)

(58) Field of Classification Search
CPC .... B65H 35/002–0053; B65H 2220/01; B65H 2220/03; B65H 2701/337
See application file for complete search history.

(56) References Cited

U.S. PATENT DOCUMENTS

RE24,906 E 12/1960 Ulrich
3,239,478 A 3/1966 Harlan, Jr.
(Continued)

FOREIGN PATENT DOCUMENTS

CN 105836519 8/2016
CN 107720390 A 2/2018
(Continued)

OTHER PUBLICATIONS

Machine translation of CN 111776834 (Year: 2020).*
(Continued)

*Primary Examiner* — Nathaniel J Kolb
(74) *Attorney, Agent, or Firm* — Vincent Pham; Aleksander Medved; Melissa W. Buss

(57) ABSTRACT

Various embodiments of a hand tape applicator and system including such applicator are disclosed. The hand tape applicator includes a body, a spindle connected to the body that is configured to receive a tape roll that includes tape, and an ergonomic handle connected to the body. The applicator further includes a roller mechanism connected to the body that is configured to apply the tape to a substrate. The roller mechanism includes a head and a tape roller extending along
(Continued)

a roller axis between a first end and a second end of the tape roller. The tape roller is connected to the head at each of the first and second ends. The applicator further includes a force sensor connected to the head. The force sensor is configured to detect a force between the tape roller and the head and provide a signal indicative of the force.

19 Claims, 24 Drawing Sheets

(56) References Cited

U.S. PATENT DOCUMENTS

| | | | |
|---|---|---|---|
| 3,681,172 | A | 8/1972 | Cafiero |
| 3,935,338 | A | 1/1976 | Robertson |
| 4,181,752 | A | 1/1980 | Martens et al. |
| 4,223,067 | A | 9/1980 | Levens |
| 4,385,959 | A | 5/1983 | Goguen |
| 4,414,048 | A | 11/1983 | Kontz |
| 4,629,663 | A | 12/1986 | Brown et al. |
| 4,952,650 | A | 8/1990 | Young et al. |
| 4,957,179 | A | 9/1990 | Dannatt |
| 5,083,364 | A | 1/1992 | Olbrich et al. |
| 5,169,727 | A | 12/1992 | Boardman |
| 5,534,391 | A | 7/1996 | Wang |
| 5,562,788 | A | 10/1996 | Kitson et al. |
| 5,602,221 | A | 2/1997 | Bennett et al. |
| 5,857,786 | A | 1/1999 | Randolph |
| 5,902,431 | A | 5/1999 | Wilkinson et al. |
| 5,996,040 | A | 11/1999 | Meaney et al. |
| 6,161,604 | A | 12/2000 | Richards et al. |
| 6,708,068 | B1 | 3/2004 | Sakaue |
| 6,780,484 | B2 | 8/2004 | Kobe et al. |
| 6,832,622 | B2 | 12/2004 | Hassel et al. |
| 6,893,731 | B2 | 5/2005 | Kausch |
| 7,076,865 | B2 | 7/2006 | Morbitzer et al. |
| 7,195,047 | B2 | 3/2007 | Sieverding et al. |
| 7,357,169 | B2 | 4/2008 | Vianello et al. |
| RE40,885 | E | 9/2009 | Sharp |
| 8,918,950 | B2 | 12/2014 | Song et al. |
| 9,102,493 | B2 | 8/2015 | Lam |
| 9,328,265 | B2 | 5/2016 | Hao et al. |
| 9,359,530 | B2 | 6/2016 | Zoller |
| 9,879,157 | B2 | 1/2018 | Sherman et al. |
| 10,086,560 | B2 | 10/2018 | Harkless et al. |
| 10,160,563 | B2 | 12/2018 | Overley et al. |
| 10,577,810 | B2 | 3/2020 | Telleria et al. |
| 10,703,940 | B2 | 7/2020 | Appeaning et al. |
| 10,870,996 | B2 | 12/2020 | Telleria et al. |
| 10,882,261 | B2 | 1/2021 | Graf et al. |
| 2004/0026026 | A1 | 2/2004 | Habisreitinger |
| 2004/0124235 | A1 | 7/2004 | White et al. |
| 2015/0360424 | A1 * | 12/2015 | Williams ..... B29C 70/388 156/289 |
| 2017/0312992 | A1 | 11/2017 | Furno |
| 2018/0155581 | A1 | 6/2018 | Steiner et al. |
| 2019/0241375 | A1 | 8/2019 | Guarracina et al. |
| 2020/0079031 | A1 | 3/2020 | Sellin et al. |
| 2020/0391451 | A1 | 12/2020 | Blaszczyk et al. |

FOREIGN PATENT DOCUMENTS

| | | | | |
|---|---|---|---|---|
| CN | 108190171 | A | 6/2018 | |
| CN | 208690279 | U | 4/2019 | |
| CN | 211594493 | | 9/2020 | |
| CN | 111776834 | A * | 10/2020 | ..... B65H 35/0033 |
| CN | 111113952 | B | 4/2021 | |
| DE | 29724758 | U1 | 12/2003 | |
| DE | 19741671 | B4 | 3/2004 | |
| DE | 102017007597 | A1 | 1/2019 | |
| EP | 0372756 | B1 | 12/1993 | |
| EP | 0907600 | B1 | 3/2003 | |
| EP | 3633002 | A2 | 4/2020 | |
| EP | 3312115 | B1 | 10/2020 | |
| FR | 3043928 | B1 | 5/2018 | |
| GB | 2407062 | B | 1/2006 | |
| KR | 100234675 | B1 | 12/1999 | |
| KR | 101894654 | B1 | 9/2018 | |
| WO | 2005051609 | A2 | 6/2005 | |
| WO | WO-2010115408 | A1 * | 10/2010 | ..... B65H 35/0026 |
| WO | 2011038448 | A1 | 4/2011 | |
| WO | 2017089674 | A1 | 6/2017 | |
| WO | 2020028505 | A1 | 2/2020 | |

OTHER PUBLICATIONS

Machine translation of WO 2010115408 (Year: 2010).*
"3M™ Extended Liner Tape 476XL", 3M Product Information, Sep. 2008, 3M United States, Saint Paul, Minnesota, 5 pages.
International Search Report for PCT International Application No. PCT/IB2022/053296, mailed on Jul. 12, 2022, 5 pages.

* cited by examiner

HAND TAPE APPLICATOR AND SYSTEM INCLUDING SAME

BACKGROUND

Tapes such as pressure sensitive adhesive tapes can be used in manufacturing processes to join two surfaces. For example, these tapes can be used in some applications that conventionally used other connection mechanisms such as liquid adhesives or mechanical attachments such as welding, spot welding, screws, pop rivets, and bolts. Pressure sensitive adhesive tapes can have some key advantages over these and other connection mechanisms, such as the ability to bond dissimilar materials, to seal, and to bond large areas. Furthermore, tapes can help prevent corrosion and are resistant to vibration. Some tapes can have aesthetic advantages when it is desirable to make the attachment system invisible or nearly invisible to the casual observer. Further, tapes are not limited by fixing or cure times, which can be a limitation when liquid adhesives are used.

SUMMARY OF THE DISCLOSURE

In general, the present disclosure provides various embodiments of a tape application system and various components and modules of such system. For example, the system can include a surface characterization apparatus or module that is configured to determine at least one surface quality parameter of the surface based upon a value provided by the one or more sensors and determine at least one processing parameter for a surface bonding application based upon the at least one surface quality parameter. The system can further include a tape applicator such as a hand tape applicator that includes a force sensor connected to a head of a roller mechanism of the applicator. The force sensor is configured to detect a force between a tape roller of the roller mechanism and the head and provide a signal indicative of the force. In one or more embodiments, the tape applicator can receive data such as the at least one surface quality parameter from the surface characterization module. The tape application system can further include an apparatus that can receive a plurality of input variables that can correspond to at least one of an adhesive and a substrate to be used in a tape application process, and perform one or more functions of the input variables and output variables generated during a test of the tape application process to generate a predictive data model.

In one aspect, the present disclosure provides a liner exchange apparatus. The liner exchange apparatus can include a nip roll assembly having a plurality of rollers. The nip roll assembly can receive, at an input side, a tape substrate having a substrate width. The tape substrate can include an adhesive surface and an initial liner. The nip roll assembly can receive, at the input side, an extended liner having an extended width greater than the tape substrate width. The nip roll assembly can output the tape substrate having the extended liner laminated to the tape substrate on an opposing surface from the initial liner. The liner exchange apparatus can include a liner stripping assembly at an output side of the nip roll assembly. The liner stripping assembly can remove the initial liner. The tape substrate can include an adhesive tape in the form of an adhesive transfer tape, a double-coated tape, or double-coated foam tape. More specifically the adhesive tape can include an acrylic foam tape. The substrate width can be greater than 16 millimeters. The adhesive tape can be greater than 1.6 millimeters thick.

The extended liner can include a non-elastic material. The extended liner can include polypropylene. The extended liner can include polyester.

At least one of the plurality of rollers can include rubber material. At least one of the plurality of rollers can include a metal material. At least one of the plurality of rollers can include a rubber material while another of the plurality of rollers includes a metal material.

The nip roll assembly can include a guide and a tension controller to control tension of at least one of the plurality of rollers, tape substrate, or extended liner. The tension controller can be spring loaded. The tension controller can include a magnetic clutch. The nip roll assembly can be configured to center the extended liner on the tape substrate.

In another aspect, the present disclosure provides a tape application system that includes a tape roll unwinding station to provide a tape substrate and an extended liner unwind station to provide an extended liner; an extended liner transfer module configured to receive as input the tape substrate and the extended liner and to laminate the extended liner onto the tape substrate; and a liner stripping station configured to strip an initial liner from the tape substrate. The tape application system can further include a tension control system configured to provide tension control for a nip roll assembly of the extended liner transfer module.

The tape application system can further include a printer configured to print an image on the extended liner. The printer can include a laser printer. The printer can include an ink jet printer.

In another aspect, the present disclosure provides a method for providing an adhesive tape. The method can include receiving an adhesive tape substrate having a first width, the adhesive tape substrate comprising an adhesive portion and a non-adhesive liner; and laminating an extended liner to the adhesive portion of the tape substrate, the extended liner having an extended width greater than the first width. The method can further include removing the non-adhesive liner from the adhesive portion, subsequent to the laminating.

In another aspect, the present disclosure provides an apparatus for characterization of surface quality of a surface. The apparatus includes a sensor configured to detect at least one property of the surface of the substrate or ambient environment and provide a value indicative of the at least one property, and a processor coupled to the sensor. The processor is configured to determine at least one surface quality parameter of the surface based upon the value provided by the sensor, and determine at least one processing parameter for a surface bonding application based upon the at least one surface quality parameter. The substrate can include at least one of a metal, polymer, ceramic, or glass material. The at least one property of the surface of the substrate can include presence of a primer on the surface. The sensor can include a wettability sensor that is configured to estimate surface energy of the surface of the substrate. The sensor can include an optical absorption band sensor. The processor can be further configured to identify surface composition of the surface of the substrate based upon the value provided by the optical absorption band sensor, and provide a notification responsive to detecting an unexpected surface composition of the surface of the substrate. The sensor can include at least one of an ambient temperature and humidity sensor, a surface temperature sensor, a non-contact infrared surface temperature sensor, a surface roughness sensor, a surface debris sensor, a UV primer sensor, a water contact angle sensor, or a surface composition sensor. The processor can be further configured to provide an indication of a remedial action to perform responsive to detecting an adverse surface quality condition based upon the value provided by the sensor. The remedial action can include at least one of cleaning the substrate, priming the substrate, surface treating the substrate, plasma or corona treating the substrate, abrading the substrate, heating the substrate, or drying the substrate. The processor can be further configured to control a machine performing the remedial action. The processor can be further configured to generate a prediction of success of the surface bonding application based upon the at least one surface quality parameter of the surface. The remedial action can be taken based upon the prediction of success of the surface bonding application. The prediction of success of the surface bonding application can be further based upon at least one of a specific tape or adhesive, a substrate composition, or the at least one property of the surface. The surface bonding application can include an acrylic foam tape bonding application.

In another aspect, the present disclosure provides a tape application system that includes a tape entry module comprising an input tape, and a surface characterization module configured to characterize surface quality of a surface of a substrate. The module includes a sensor configured to detect at least one property of the surface of the substrate or ambient environment, and provide a value indicative of the at least one property. The module further includes a processor coupled to the at least one sensor. The processor is configured to determine at least one surface quality parameter of the surface based upon the value provided by the sensor, and determine at least one processing parameter for a surface bonding application based upon the at least one surface quality parameter. The system further includes a surface preparation module configured to prepare the surface of the substrate for application of the input tape based upon the at least one processing parameter, and data acquisition equipment connected to the tape entry module, the surface characterization module, and the surface preparation module. The processor of the surface characterization module can be further configured to identify surface composition of the surface of the substrate based upon the value provided by the sensor, and provide a notification responsive to detecting an unexpected surface composition of the surface of the substrate. The processor of the surface characterization module can be further configured to control the surface preparation module. The processor of the surface characterization module can be further configured to generate a prediction of success of the surface bonding application based upon the at least one surface quality parameter of the surface.

In another aspect, the present disclosure provides a method that includes detecting at least one property of a surface of a substrate or ambient environment of the substrate; generating a value indicative of the at least one property; determining at least one surface quality parameter of the surface based upon the value; and determining at least one processing parameter for bonding a tape to the surface of the substrate. The method can further include treating the surface of the substrate based upon the at least one surface quality parameter of the surface.

In another aspect, the present disclosure provides an apparatus comprising at least two tape core holders configured to hold, respectively, a first roll of tape and a second roll of tape; a roll sensor configured to detect a condition of at least the first roll of tape and the second roll of tape; a cutting mechanism configured to, responsive to the roll sensor detecting an empty condition of one of the first roll of tape and the second roll of tape, cut the respective first roll of tape or second roll of tape at a trailing edge of the respective first roll of tape or second roll of tape; and a splicing mechanism configured to splice a leading edge of the other of the first roll of tape and second roll of tape to the trailing edge. The other of the first roll of tape and second roll of tape can include a liner tab. A liner of at least one of the first roll of tape and the second roll of tape can be spliced. The cutting mechanism can cut the respective first roll of tape or second roll of tape at a ninety-degree angle with an edge of the respective first roll of tape or second roll of tape. The roll sensor can include an optical sensor. The roll sensor can include a mechanical arm configured to detect an empty roll when a diameter of the respective first roll of tape or second roll of tape falls below a threshold. The roll sensor can detect a weight of at least the first roll of tape and the second roll of tape. The apparatus can further include an indicator mechanism to indicate an emptiness condition of at least the first roll of tape and the second roll of tape. The apparatus can further include a communication interface and a processor or equivalent controller coupled to the computer interface. The processor can provide a signal over the communication interface indicating a desired speed of a manufacturing line associated with the apparatus. The first roll of tape and the second roll of tape can include double-coated tape. The first roll of tape and the second roll of tape can include double-coated foam tapes. The cutting mechanism can cut at an angle about perpendicular to a lengthwise edge of the respective first roll of tape and the second roll of tape. The cutting mechanism can cut at about a same angle on each of the respective first roll of tape and the second roll of tape.

The splicing mechanism can apply a tab between the leading edge and the trailing edge on a liner surface. The tab can be applied by manually or automatically pressing the tab over a gap between the leading edge and the trailing edge to make the liner splice. The apparatus can further include a splicing table for providing a counterforce to the pressure when pressing the tab during tab application. The splicing table can include guides for maintaining the tape in a splicing position. The splicing table can be coated with a release coating. The gap can be less than about 1.6 millimeters. The splicing mechanism can apply another tab between the leading edge and the trailing edge on an adhesive surface.

In another aspect, the present disclosure provides a hand tape applicator that includes a body, a spindle connected to the body and configured to receive a tape roll comprising tape, and an ergonomic handle connected to the body. The applicator further includes a roller mechanism connected to the body and configured to apply the tape to a substrate. The roller mechanism includes a head and a tape roller extending along a roller axis between a first end and a second end of the tape roller. The tape roller is connected to the head at each of the first and second ends. The applicator further includes a force sensor connected to the head, where the force sensor is configured to detect a force between the tape roller and the head and provide a signal indicative of the force. The applicator can further include a processor configured to receive the signal from the force sensor and provide feedback to an operator regarding the force. The processor can further be configured to adjust a force between the tape roller and the head to provide a selected force per unit width to the tape as the tape is applied to the substrate. The roller mechanism can further include a first connector that connects the first end of the tape roller to the head and a second connector that connects the second end of the tape roller to the head. Each of the first and second connectors can include at least one of a spring, a hinge, a shock absorber, or a strut. The first connector can include a first actuator and the second connector can include a second actuator, where each of the first and second actuators are connected to the processor. The processor can further be configured to independently actuate the first and second actuators to adjust the force between the head and each of the first and second ends of the tape roller. The processor can further be configured to direct the first and second actuators in an oscillating motion such that the tape roller oscillates or percusses while applying the tape to the substrate. The processor can further be configured to log or map the force signal from the sensor in relation to a position along an applied tape length. The applicator can further include a pivoting mechanism that connects the head to the body, wherein the pivoting mechanism is configured to pivot the tape roller in relation to the body. The applicator can further include a second tape roller connected to the head, where at least one of the tape roller or the second tape roller is configured to apply force to the tape after the tape has been applied to the substrate. The ergonomic handle of the applicator can be reconfigurable to accommodate different operators. The applicator can further include a laser guide connected to the body or the roller mechanism, where the laser guide is configured to indicate to an operator at least one of a desired starting position of the tape when the tape is applied to the substrate, a desired stopping position of the tape that has been applied to the substrate, or a path of the tape as it is applied to the substrate. The applicator can further include a cutting mechanism connected to the body and adapted to separate a portion of the tape from the tape roll.

In another aspect, the present disclosure provides a tape application system that includes a tape entry module including an input tape and a hand tape applicator connected to the tape entry module. The hand tape applicator module includes a body and a roller mechanism connected to the body and configured to apply the input tape to a substrate. The roller mechanism includes a head and a tape roller extending along a roller axis between a first end and a second end of the tape roller, where the tape roller is connected to the head at each of the first and second ends. The module further includes a force sensor connected to the head, where the force sensor is configured to detect a force between the tape roller and the head and provide a signal indicative of the force. The system further includes data acquisition equipment connected to the tape entry module and the hand tape applicator module. The system further includes a surface characterization module and a surface preparation module, where the surface characterization module and the surface preparation module are connected to the data acquisition equipment. The surface characterization module is configured to characterize surface quality of the surface of the substrate prior to application of the input tape. The force between the tape roller and the head of the hand tape applicator is adjustable based upon the surface quality of the surface of the substrate. The data acquisition equipment includes a processor configured to provide an indication of a remedial action to the surface preparation module that is responsive to an adverse surface quality condition detected by the surface characterization module. The hand tape applicator can further include a processor configured to receive the signal from the force sensor and provide feedback to an operator regarding the force. The processor can further be configured to determine a target force based on at least one of tape width, tape type, tape thickness, substrate surface condition, surface texture, or surface temperature.

In another aspect, the present disclosure provides a method that includes disposing a tape on a surface of a substrate utilizing a hand tape applicator that includes a roller mechanism having a head and a tape roller connected to the head at a first end and a second end of the tape roller; detecting a force between the tape roller and the head while disposing the tape on the surface of the substrate; communicating a signal indicative of the force; and adjusting the force between the tape roller and the head while disposing the tape on the surface of the substrate based upon the signal.

The present disclosure provides a non-transitory computer-readable medium including instructions that, when implemented on a processor, cause the processor to perform operations including receiving a plurality of input variables, the input variables corresponding to at least one of an adhesive and a substrate to be used in a tape application process; performing an analysis of input variables and output variables generated during a test of the tape application process to generate a predictive data model; and storing the predictive data model. The input variables can further include information identifying a predictor for success of the tape application process. The input variables can include indication of a predictor, and wherein the predictor includes a peel adhesion test. The predictor can include a ninety-degree peel test. The operations can include generating a recommendation for remedial action of the tape application process. The input variables can indicate a substrate type. The input variables can include indicators for at least one of polypropylene, polyethylene, polycarbonate, stainless steel, aluminum, paint, nylon, and glass. The input variables can indicate a tape type. The input variables can include at least one of adhesive physical characteristics, adhesive thermal characteristics, adhesive electrical characteristics, adhesive curing characteristics, adhesive performance characteristics, adhesive durability characteristics, adhesive chemical resistance characteristics, adhesive rheological characteristics, adhesive viscosity, adhesive setting time, adhesive modulus of elasticity, adhesive solvent resistance, adhesive composition, adhesive dispensing characteristics, adhesive use requirements, standardized tests or certifications, environmental parameters, backing characteristics, liner characteristics, and substrate characteristics. The operations can include feeding input values generated by the tape application process as feedback data to the processor for adjusting the predictive data model. The operations can include outputting at least one of the input variables to a display. The operations can include generating and displaying a simulation of the tape application based on at least one of the input variables.

The above summary of the present disclosure is not intended to describe each disclosed embodiment or every implementation of the present disclosure. The description that follows more particularly exemplifies illustrative embodiments. In several places throughout the application, guidance is provided through lists of examples, which examples may be used in various combinations. In each instance, the recited list serves only as a representative group and should not be interpreted as an exclusive list. Thus, the scope of the present disclosure should not be limited to the specific illustrative structures described herein, but rather extends at least to the structures described by the language of the claims, and the equivalents of those structures. Any of the elements that are positively recited in this specification as alternatives may be explicitly included in the claims or excluded from the claims, in any combination as desired.

Although various theories and possible mechanisms may have been discussed herein, in no event should such discussions serve to limit the claimable subject matter.

DETAILED DESCRIPTION OF ILLUSTRATIVE EMBODIMENTS

Figure 1:
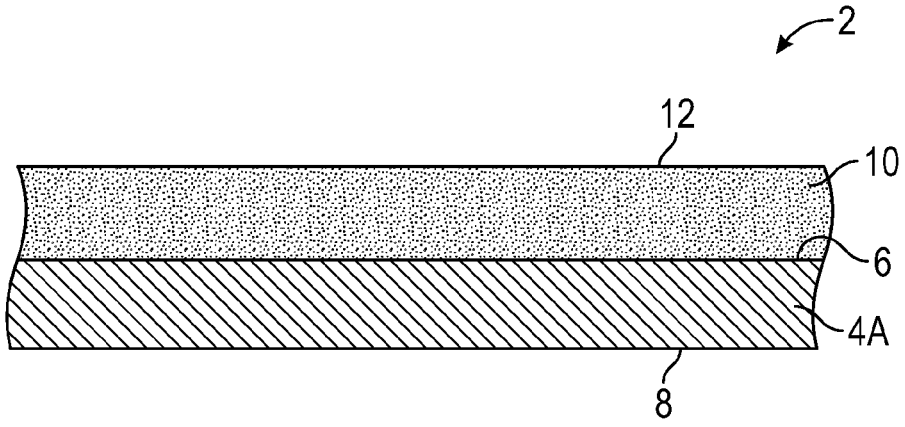
FIG. 1 is a schematic cross-section side view of one embodiment of a length of adhesive transfer tape on a release liner.

In general, the present disclosure provides various embodiments of a tape application system and various components and modules of such system. For example, the system can include a surface characterization apparatus or module that is configured to determine at least one surface quality parameter of the surface based upon a value provided by the one or more sensors, and determine at least one processing parameter for a surface bonding application based upon the at least one surface quality parameter. The system can further include a tape applicator such as a hand tape applicator that includes a force sensor connected to a head of a roller mechanism of the applicator. The force sensor is configured to detect a force between a tape roller of the roller mechanism and the head and provide a signal indicative of the force. The force on the roller and contact area between the roller and the tape can create a pressure zone on the tape. This pressure zone can be important to make adhesive contact especially on rough surfaces. The contact pressure is sometimes referred to as force per unit width of the tape. The actual pressure depends on surface roughness and conformability, roller stiffness, roller diameter, and tape thickness and conformability. In one or more embodiments, the tape applicator can receive data such as the at least one surface quality parameter from the surface characterization module. The tape application system can further include an apparatus that can receive a plurality of input variables that can correspond to at least one of an adhesive and a substrate to be used in a tape application process or environmental conditions, and perform one or more functions of the input various and output variables generated during a test of the tape application process to generate a predictive data model.

As mentioned herein, tapes such as pressure sensitive adhesive tapes utilized in manufacturing to join two or more surfaces provide various advantages over other joining techniques. Such tapes can, however, be present challenges when utilized with various automation processes. As customers move towards automation, attachment processes need to be scalable. Automated attachment and dispensing solutions are widely available for traditional fastening solutions, such as welding, screws, bolts, and liquid structural adhesives, but are more difficult to find for double-sided attachment tapes. Further, most available tape automation solutions are designed with large-scale customers in mind and can be prohibitively expensive.

Many tape assembly processes can benefit from some level of automation in the tape application process by reducing operator labor and error or improving precision/accuracy/quality or speed of throughput. As a result, there is a general need for a tape application automation solution that is less expensive than large-scale automation, easier to operate and maintain, and that minimizes or reduces operator involvement.

Description of Tapes

FIGS. 1-4 are cross-section views of various embodiments of tapes, liners, etc., that can be used in example systems, modules, apparatuses, and methods described herein. Tapes can include pressure sensitive adhesive tape and other types of tape. Foam layers described herein include a polymeric material. Exemplary polymeric materials include a polycarbonate, a polyacrylic, a polymethacrylic, an elastomer, a styrenic block copolymer, a styrene-isoprene-styrene (SIS), a styrene-ethylene/butylene-styrene block copolymer (SEBS), a polybutadiene, a polyisoprene, a polychloroprene, a random copolymer of styrene and diene styrene-butadiene rubber (SBR), a block copolymer of styrene and diene styrene-butadiene rubber (SBR), an ethylene-propylene-diene monomer rubber, a natural rubber, an ethylene propylene rubber, a polyethylene-terephthalate (PET), a polystyrene-polyethylene copolymer, a polyvinylcyclohexane, a polyacrylonitrile, a polyvinyl chloride, a polyurethane, an aromatic epoxy, an amorphous polyester, amorphous polyamides, a semicrystalline polyamide, an acrylonitrile-butadiene-styrene (ABS) copolymer, an ethylene-vinyl acetate (EVA), the copolymers of ethylene and vinyl acetate; also referred to as polyethylene-vinyl acetate (PEVA), a low-density polyethylene (LDPE), a polypropylene (PP), including expanded polypropylene (EPP) and polypropylene paper (PPP), a polystyrene (PS), including expanded polystyrene (EPS), extruded polystyrene (XPS) and sometimes polystyrene paper (PSP), a nitrile rubber (NBR) as in the copolymers of acrylonitrile (ACN) and butadiene, a polyphenylene oxide alloy, a high impact polystyrene, a polystyrene copolymer, a polymethylmethacrylate (PMMA), a fluorinated elastomer, a polydimethyl siloxane, a polyimide, a polyetherimide, an amorphous fluoropolymer, an amorphous polyolefin, a polyphenylene oxide, a polyphenylene oxide-polystyrene alloy, or mixtures thereof. The foam may be formed as a coextruded sheet with the adhesive on one or both sides of the foam, or the adhesive may be laminated to it. When the adhesive is laminated to a foam, it may be desirable to treat the surface to improve the adhesion of the adhesive to the foam or to any of the other types of backings. Such treatments are typically selected based on the nature of the materials of the adhesive and of the foam or backing and include primers and surface modifications (e.g., corona treatment, surface abrasion). Additional tape constructions include those described in U.S. Pat. No. 5,602,221 (Bennett et al.) and U.S. Pat. No. 9,879,157 (Sherman et al.). Some tapes used are clear acrylic tapes that have foam-like properties. Clear acrylic tapes can have a transmission of light of at least 85 percent.

In some embodiments, a pressure sensitive adhesive composition is a foamed composition. The foamed pressure sensitive adhesive can be prepared by mixing into the adhesive composition a physical blowing agent, chemical blowing agent, or a low-density filler. Useful low-density fillers include, for example, hollow glass microspheres. Foamed pressure sensitive adhesive compositions not only reduce weight but can be advantageous in applications where it is necessary for the adhesive to conform to surfaces that are rough or irregularly shaped. The foam can be an open cell foam or a closed cell foam. The foams can be formed by any known method such as using a blowing agent or by including expandable microspheres (e.g., polymeric microspheres) in the pressure sensitive adhesive composition.

One embodiment of a transfer tape 2 is shown in FIG. 1. Tape 2 is composed of flexible release liner 4A having a first major side 6, and a backside, second major side 8. The backside 8 of the planar or embossed carrier web has been coated with a release coating and the front side has been coated with release coating. Release coating can include release agents such as silicone, perfluoropolyether, and the like. Examples of release coatings are disclosed in U.S. Pat. Nos. 9,359,530, 6,780,484, 10,703,940, and U.S. Pub. No. 2018/0155581. The underside of adhesive layer 10 interfaces with the first major side 6 of release liner 4A. In one or more embodiments, a pressure sensitive adhesive layer 10 has been coated onto the front side of the release liner by flooding the surface with adhesive and then wiping with a doctor blade. In this construction of the tape 2, the adhesive is transferred directly from the release liner 4A to the transfer substrate or part needing the adhesive layer. This may be accomplished by pressing the part onto exposed adhesive 12. When the part is removed, adhesive layer 10 transfers thereto, and the release liner 4A is subsequently removed.

The type of adhesive used in adhesive layer 10 is not critically limiting. A wide variety of coatable pressure sensitive adhesives can be used. The adhesive used can be selected based upon the type of substrate to which it will be adhered. However, it may be preferred to use solventless adhesives (often referred to as 100% solids) when making adhesive transfer tapes, and latex PSAs coated out of water may be preferred when making PSA transfer tapes that are continuous adhesive films having discontinuous holes. Classes of adhesives that can be used in this disclosure are silicones, polyolefins, polyurethanes, polyesters, acrylics, rubber-resin, tackified rubber, tackified synthetic rubber, and polyamides. Suitable pressure sensitive adhesives includes solvent-coatable, hot-melt-coatable, radiation-curable (E-beam or UV curable) and water-based emulsion type adhesives. Specific examples of adhesives include acrylic-based adhesives, e.g., isooctyl acrylate/acrylic acid copolymers and tackified acrylate copolymers; tackified rubber-based adhesives, e.g., tackified styrene-isoprene-styrene block copolymers; tackified styrene-butadiene-styrene block copolymers; nitrile rubbers, e.g., acrylonitrile-butadiene; silicone-based adhesive, e.g., polysiloxanes; ethylene vinyl acetate; and polyurethanes. The pressure sensitive adhesive may also be substantially nontacky at room temperature if it becomes tacky at an elevated temperature at which it is to be used. Acrylics may be a preferred class of adhesives for many embodiments disclosed herein. Wide variations in chemical composition exist for the acrylic adhesive class, examples of which are disclosed in U.S. Pat. No. 4,223,067 (Levens) and U.S. Pat. No. 4,629,663 (Brown et al), U.S. Pat. Nos. 3,239,478, 3,935,338, 5,169,727, RE 24,906, 4,952,650, and 4,181,752. Suitable pressure sensitive adhesives include those that are the reaction product of at least alkyl acrylate with at least one reinforcing co-monomer. Suitable alkyl acrylates are those having a homopolymer glass transition temperature below about −10 degrees C. and include, for example, n-butyl acrylate, 2-ethylhexylacrylate, isoctylacrylate, isononyl acrylate, octadecyl acrylate and the like. Suitable reinforcing monomers are those having a homopolymer glass transition temperature about −10 degrees C., and include for example, acrylic acid, itaconic acid, isobornyl acrylate, N,N-dimethylacrylamide, N-vinyl caprolactam, N-vinyl pyrrolidone, and the like. Other pressure sensitive adhesive formulations known in the art may also be suitable.

The pressure sensitive adhesive can optionally include one or more additives. Depending on the method of polymerization, the coating method, the end use, etc., any suitable additive can be used, e.g., initiators, fillers, plasticizers, tackifiers, chain transfer agents, fibrous reinforcing agents, woven and non-woven fabrics, foaming agents, antioxidants, stabilizers, fire retardants, viscosity enhancing agents, coloring agents, and mixtures thereof.

Figure 2:
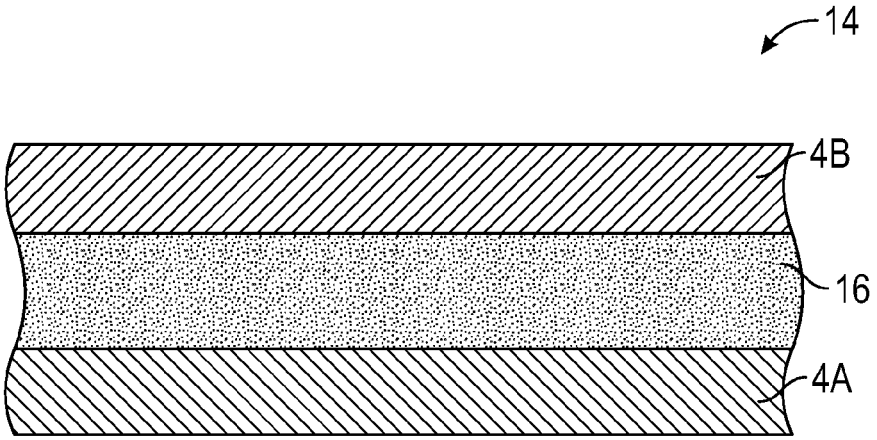
FIG. 2 is a schematic cross-section side view of one embodiment of a length of adhesive transfer tape sandwiched between two release liners.

A further embodiment of an adhesive transfer tape 14 is shown in FIG. 2. This transfer tape is similar to that shown in FIG. 1, but the adhesive layer 16 is sandwiched between a first release liner 4A and a second release liner 4B.

Figure 3:
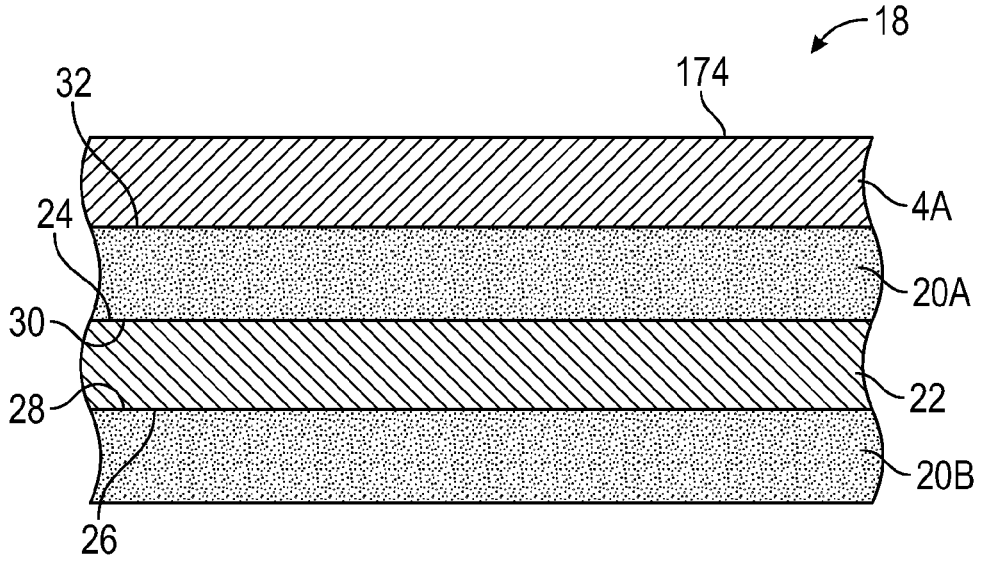
FIG. 3 is a schematic cross-section side view of one embodiment of a length of double sided adhesive tape.

FIG. 3 shows a double-sided adhesive tape 18. This particular embodiment is sometimes referred to as a "self-wound" double sided adhesive tape, as it would typically be distributed on a roll, and a lower major surface of second adhesive layer 20B would thus interface with the upper major surface of release liner 4A, which would be treated with a release coating.

Suitable materials for the release liner 4A include, for example polymeric films, such as polyester films (e.g., polyethylene terephthalate films) and polyolefin films (e.g., polyethylene films, polypropylene films, biaxially oriented polypropylene films (BOPP films)); metallized film; seal paper (e.g., polyethylene-coated paper, metallized paper, and clay-coated paper); and paper. The release liner 4A can be coated with a release coating on the first or second surfaces.

Suitable materials for backing layer 22 include a variety of flexible and inflexible materials, e.g., woven or nonwoven fabrics (e.g., cloth, nonwoven scrim), paper, polymeric films, metalized films or foils, and combinations thereof (e.g., metalized polymeric film), and foam (e.g., polyaelic, polyethylene, polyurethane, neoprene). Polymeric films include, for example, polyolefins, such as polypropylene (e.g., biaxially oriented), polyethylene (e.g., high density or low density), polyvinyl chloride, polyurethane, polyester (polyethylene terephthalate), polycarbonate, polymethyl (meth)acrylate (PMMA), polyvinylbutyral, polyimide, polyamide, fluoropolymer, cellulose acetate, cellulose triacetate, ethyl cellulose, as well as bio-based material such as poly lactic acid (PLA). The woven or nonwoven fabric may include fibers or filaments of synthetic or natural materials such as cellulose (e.g., tissue), cotton, nylon, polyethylene, rayon, glass, ceramic materials, and the like. The backing layer 22 can also be a transparent film having a transmission of visible light of at least 90 percent.

One or more primer layers may optionally be used to enhance the bond between the backing layer and the adhesive layer. The type of primer will vary with the type of backing and adhesive used and one skilled in the art can select an appropriate primer. Examples of suitable primer layers are those described in EP 372756, U.S. Pat. Nos. 5,534,391, 6,893,731, 9,328,265, and WO2011/38448.

Backing layer 22 includes first (upper) and second (lower) major surfaces 24 and 26. The second (lower) major surface 26 is adjacent to and interfaces with an upper, or first, major side 28 of adhesive layer 20B. The upper major surface 24 of backing layer 22 is adjacent to and interfaces with a lower, or second, major side 30 of adhesive layer 20A. An upper, or first, major side 32 of adhesive layer 20A interfaces with the release line 4A. The release liner 4A, as described earlier, is removed to provide double adhesive sided foam tape.

Figure 4:
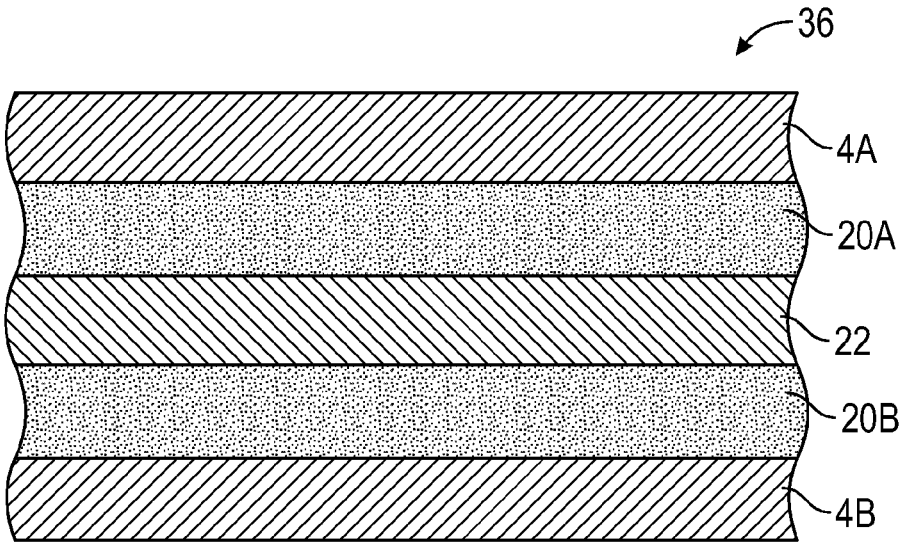
FIG. 4 is a schematic cross-section side view of one embodiment of a length of double sided adhesive tape sandwiched between two release liners.

FIG. 4 shows double liner double sided adhesive tape 36. Its construction is similar to the embodiment shown in FIG. 3, except that a second (lower) side of adhesive layer interfaces with a first (upper) major surface of a second release liner 4B. As in the embodiment shown in FIG. 3, such a construction may be used for double-sided adhesive foam tapes. Double coated foam tapes provide a significant performance advantage over double coated film tapes by their conformability and ability to distribute peel and shear forces over larger areas. This force distribution increases the adhesion, strength and overall tape performance which make them suitable for manufacturing assembly operations.

Systems

As described herein, many tape users can benefit from some level of automation in the tape application process. Automation can remove some of the challenges associated with the tape application process. Such challenges can include difficulties with tape liners, for example, in removing liners quickly and easily from the tape substrate when the liners are no longer needed. Another challenge relates to cleaning the surface/s to which the tape is to adhere or detecting contamination in the tape or substrate surface/s to which the tape is to adhere. A further challenge can include difficulties with tape roll changeover. Finally, operators may not be able to apply tape quickly and accurately enough to keep pace with other operations in a manufacturing operation or product fulfillment process.

To address these and other concerns, systems, apparatuses, and methods described herein provide an automation solution based on a modular approach in which a solution is provided for each operation in the tape application process in which operators have been found to experience challenges, and the modules can be selected and connected based on user needs (e.g., "plug-and-play"). Systems according to embodiments can help operators reduce costs by standardizing components of the tape application system, using some or all modules and disregarding modules that are not of interest to the operator.

Overall Modular Tape Application System

Figure 5:
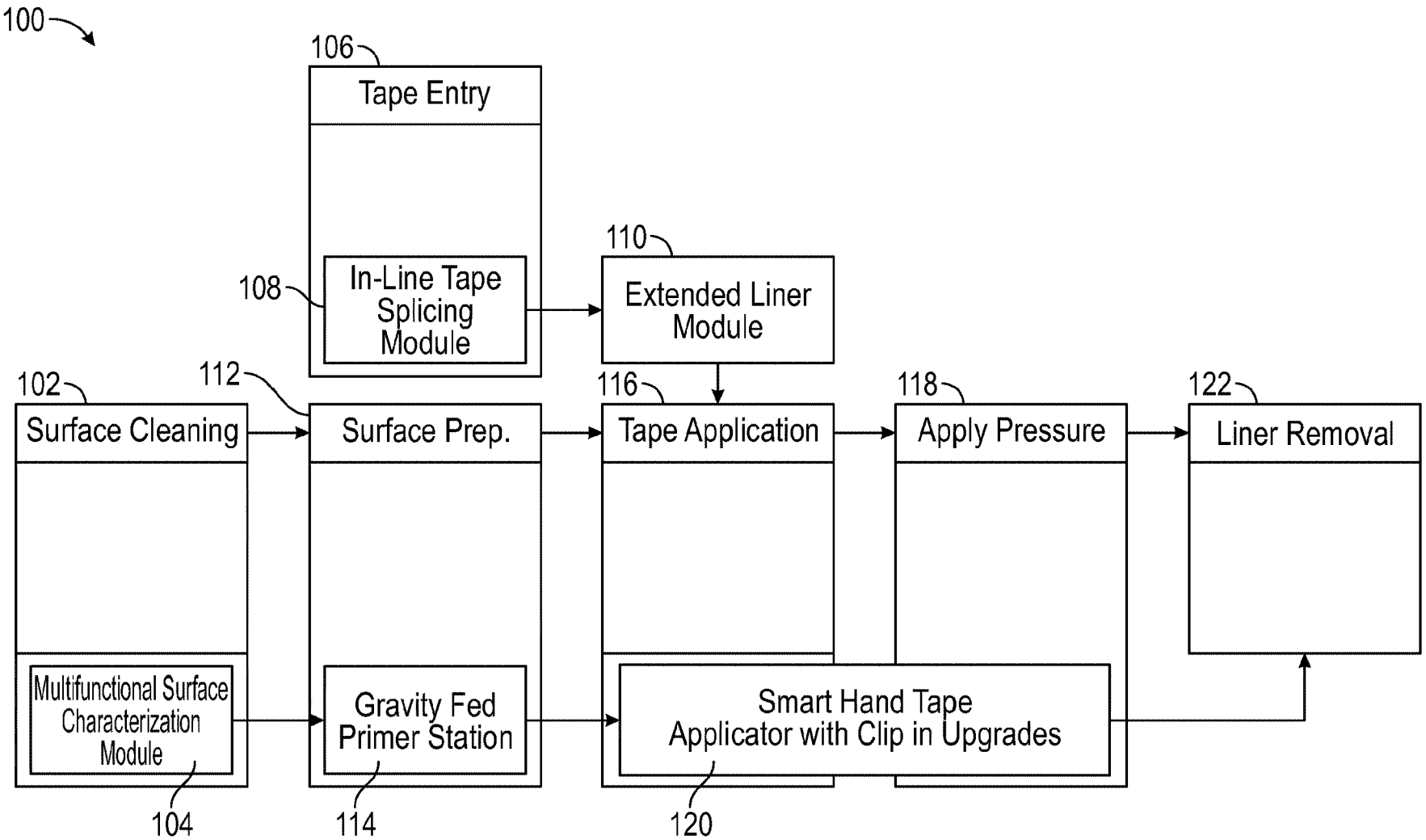
FIG. 5 a block diagram of one embodiment of a system for tape application.

FIG. 5 is a block diagram of an example system 100 for tape application in accordance with some embodiments. The example system 100 can include plug-and-play modules for resolving tape automation challenges in accordance with some embodiments, where the plug-and-play modules can be configured to operate with remote or local software and control systems, or as part of an edge computing system or Internet of Things (IoT) system. The system 100 is a modular system, meaning that an operator can use some or all of the modules in any process requiring tape application, or a subset of such a process, without loss of generality. Modules can be removed or added (e.g., "interconnected").

System 100 can include a surface cleaning system 102. The surface cleaning system 102 can include a multifunctional surface characterization module 104 for performing surface characterization of adhesives or substrate surfaces. The surface characterization module 104 is directed to helping solve a challenge in which operators spend an inordinate amount of time cleaning substrate surfaces or visually inspecting a substrate after cleaning. Reasons for such cleaning or overcleaning can include operator uncertainty as to whether a surface is clean or has been sufficiently cleaned. The surface characterization module 104 can include circuitry, equipment, sensors, etc., for performing continuous or periodic assessment or reading of surface energy, roughness, wettability, surface contamination/cleanliness, surface temperature, and other criteria affecting adhesion. Surface energy quantifies the disruption of intermolecular bonds that occurs when a surface is created and can be viewed as the work required to build an area of a surface on a bulk material. If a surface is created in a vacuum, the surface energy will equal half the energy of cohesion for the relevant bulk material; however, various processes or conditions can reduce surface energy. The surface energy is typically determined from contact angle measurements as described, for example, in standards of the American Society for Testing and Materials (ASTM) family of standards, and in particular the ASTM D7490 standard. The surface characterization module 104 is described in further detail herein with respect to FIGS. 9-10.

The surface characterization module 104 can include multiple modular sensors to assess various surface criteria, and the modular sensors can be added to the surface characterization module as a plug-and-play module. These sensors can include measurements such as surface roughness, ambient temperature and humidity, surface temperature, presence of surface liquids or residual contaminants, spectroscopy of the substrate, surface wettability by contact angle estimation or percent surface area wetted by known fluid/s as an estimate of or a proxy for surface energy, etc. Other modules can include vision systems for visible defects such as dust and debris, scratches, or other physical defects, and systems customized to expected contaminants.

System 100 can also include a tape entry system 106. The tape entry system 106 can include a tape splicing module 108. The tape splicing module 108 can provide tape to an extended liner module 110. The tape splicing module 108 is directed to helping solve a challenge in which tape roll change overs are needed too often, slowing throughput of other operations, such as assembly line systems or other systems and modules downstream of tape application operations. The tape splicing module 108 can provide a way to splice together planetary tape rolls continuously or nearly continuously. Planetary tape rolls are less expensive and take up less manufacturing floor space than other types of rolls such as level-wound rolls and unwind stations associated with level-wound rolls. However, the short yardage planetary tape rolls (for example typically about 36 to 72-yard rolls) suffer from the deficiency of needing to be changed out frequently in high-volume tape applications. Therefore, example embodiments provide the tape slicing module 108 that can splice a new tape roll to a used-up or nearly used-up tape roll. The tape splicing module 108 is described in more detail below with respect to FIGS. 11-12.

The tape splicing module 108 can provide input to an extended liner module 110. The extended liner module 110 is directed to helping solve a challenge regarding the amount of time operators spend in removing liner from the applied tape. Liner removal is often a manual process for most applications and initiating liner removal can be a particularly time-consuming operation in this process. Some manual tools for liner removal can include a file card or similar instruments, but these can damage or contaminate tape, and furthermore can be still time-consuming to use in some applications. The extended liner module 110 includes mechanisms for removing one liner from tape and adding an additional, easier-to-remove extended liner with no or minimal operator involvement. An extended liner, such as the extended liner that is applied by an extended liner module 110, can provide a simpler and easier-to-implement way to remove liners independent of applied tape length. Extended liners of the type applied by the extended liner module 110 can also result in a saving of product, especially in the cases of short pieces of tape for which addition of specialized tabs might be wasteful of product and require the use of a special tape tab applicator. Downstream from the extended liner module 110, the tape substrate with its additional, wider extended liner is applied to a substrate of an article. The wider extended liner can then be easily removed later. Further details of the extended liner module 110 are provided herein with reference to FIGS. 7-8.

The surface characterization module 104 can provide input to a surface preparation module 112. The surface preparation module 112 can include a primer station 114 that includes circuitry and mechanisms for providing primer to a surface of a substrate for improved adhesion of tape. The surface characterization module 104 also can provide input to other surface preparation modules such as solvent cleaning and wiping, flame treatment, plasma treatment, abrasive treatment, ultrasonic treatment, laser treatment, corona treatment, UV treatment, and other surface treatment systems used to improve adhesion.

The surface preparation module 112 and the extended liner module 110 can provide input to a tape application station 116 and a force application station 118. The tape application station 116 and the force application station 118 can include a tape applicator module 120. The tape applicator module 120 includes apparatuses and circuitry directed to mitigating operator challenges brought about by the process of aligning tape during application. Tape alignment presents challenges with maintaining throughput in manual systems. Furthermore, when force is applied to tape at station 118, it may be important to apply sufficient force uniformly across a width of the tape to provide bonding between the tape and the substrate surface. The tape applicator module 120 can optionally be used with robotics or other circuitry or apparatus for automated tape application.

The force application station 118 can provide input to the liner removal station 122. In some embodiments, the extended liner will remain on the tape, for removal further downstream or at the ultimate customer.

Figure 6:
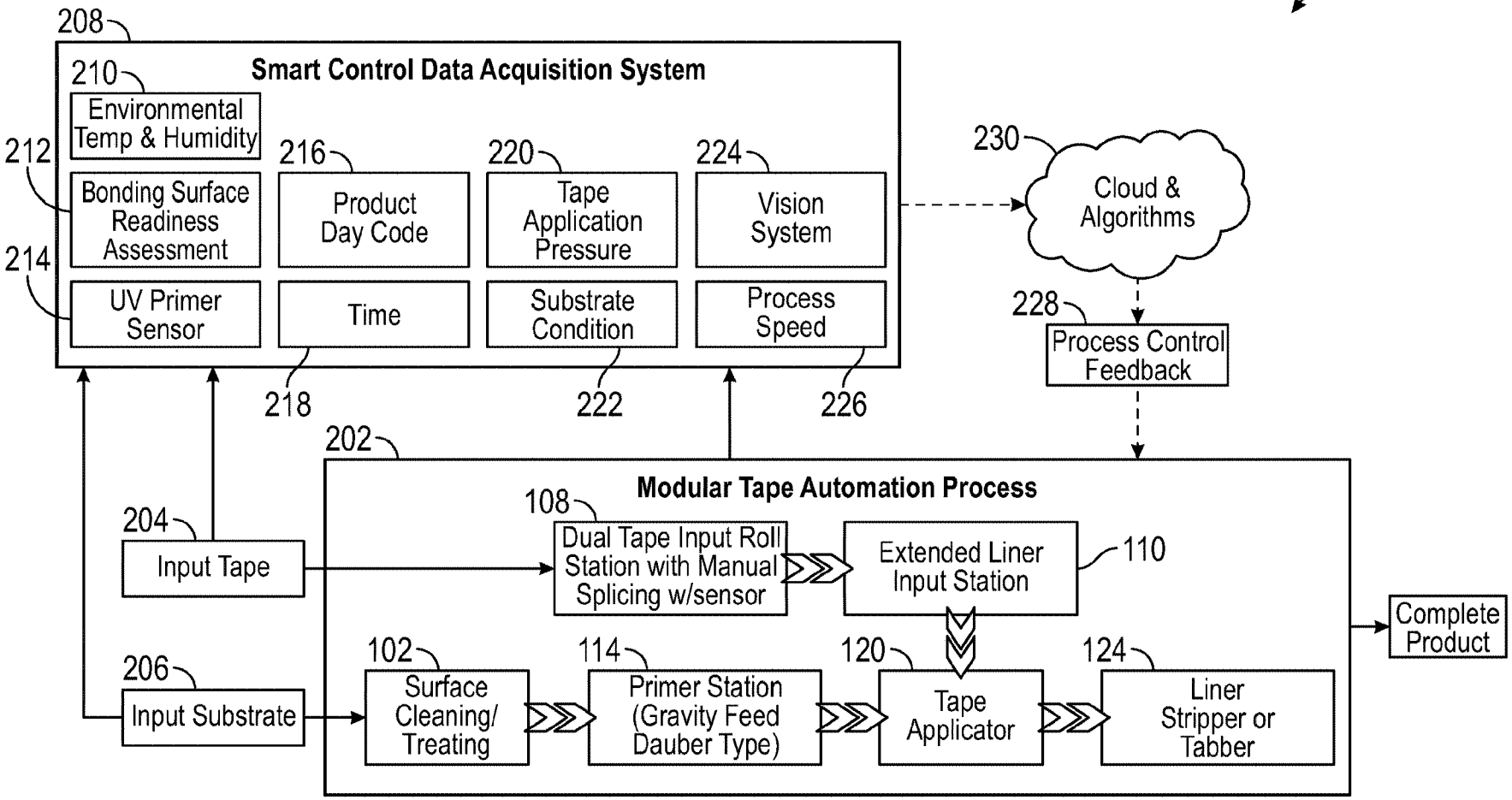
FIG. 6 is a block diagram of one embodiment of a system for controlling and coordinating tape application.

FIG. 6 is a block diagram of a system 200 for controlling and coordinating tape application in accordance with some embodiments. Processing and control circuitry for any of the modules depicted in FIG. 6 can be implemented in part or completely within edge computing devices, locally or remotely from tape application operations, within a cloud, etc. The apparatuses and circuitry of the surface characterization module 104, tape splicing module 108, surface preparation module 112 (which can include primer station 114), extended liner module 110, and tape applicator module 120 can be provided on an as-needed, modular basis within tape automation process 202. Liner can be stripped or tabbed at module 124.

The tape automation process 202 can take an input tape 204 and substrate 206, including stiffeners or any structure or material to be bonded with double-coated tape. The system 200 can further include data acquisition equipment 208. Data acquisition equipment 208 can include circuitry such as sensors, processors, cameras, etc. for detecting conditions within operator facilities or conditions within a geographical area encompassing operator facilities or on the manufacturing line. Example data acquisition equipment 208 can include temperature and humidity sensors 210, bonding surface readiness assessment system 212, and sensors 214 for detecting the state of any primers that may be used in the tape application process. Data acquisition equipment 208 can further include product day code equipment 216 or specific article identifier for data traceability to a part, for example equipment for determining production codes related to a particular "run" of operator product, clocks 218 for determining time of day, force sensors 220 for determining tape application force, sensors 222 for determining conditions of tape or substrates of articles, vision systems 224 for detecting tape placement and defects, and sensors 226 for determining process speed of a process in which tape application is being performed.

The examples provided herein are only some examples of sensors, processors, etc. that can be used, and other sensors, processors, detectors, etc. can be included in the data acquisition equipment 208. Any or all of the modules described herein, or a subset thereof, can be included in a tape application process on a modular plug-and-play basis. A feedback loop 228 can be provided that makes use of local or remote computational circuitry 230 for adapting a tape application process based on inputs, control signals and data provided to or generated by the tape automation process 202. Computational circuitry 230 will be described in more detail herein with reference to FIGS. 19-20.

Extended Liner Module

Figure 7:
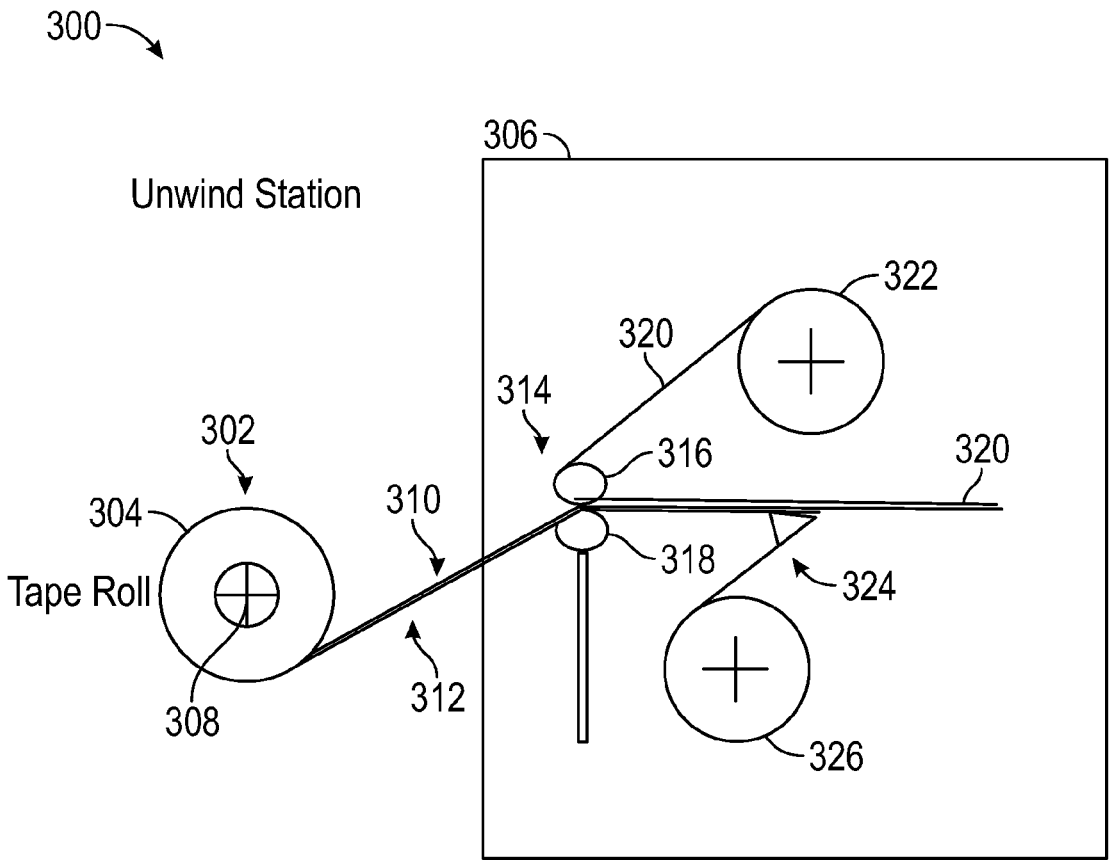
FIG. 7 illustrates one embodiment of an extended liner module.

FIG. 7 illustrates a liner exchange apparatus 300 in accordance with some embodiments. The liner exchange apparatus 300 can include unwind station 302, where tape roll 304 is unwound and provided as input to the extended liner exchange apparatus 306. The apparatus 300 can also include tension controls and guides not detailed in FIG. 7. The tape roll 304 can include a tape "chuck" or tape core 308, and in some embodiments an electrical or mechanical tension control mechanism can be controlled to unwind the tape roll 304 and extended liner roll 322.

Tape provided on the tape roll 304 can include a tape substrate having an adhesive tape 310 on a first (e.g., top) surface and an initial liner 312 on a second (e.g., bottom) surface. The adhesive tape 310 can include an acrylic foam tape, double coated polyethylene foam, double coated polyurethane foam, double coated film tapes, double coated tissues tapes, double coated metalized backing tapes, adhesive transfer tapes, and other examples. The initial liner 312 can include polypropylene, polyester, paper, other polymeric films, or other acceptable liner material, etc.

The tape roll 304 can include a planetary tape roll. In contrast, other tape rolls available for high-volume, high-level taping applications include level-wound rolls. Level-wound rolls provide for long run-times with few change-overs for replacing rolls. Level-wound tape can include two liners for roll stability. However, level-wound tape rolls are costly, requiring specialized converting equipment and specialized tension controlled unwinding equipment, and may not be an effective solution for some taping operations. Further, currently, only adhesive transfer tapes can be manufactured easily with extended liners, though it adds manufacturing cost. Today, it would be very difficult to manufacture extended liner double coated tapes. Currently, double coated extended liner tapes can be manufactured in a converting process by kiss cutting to the liner and removing tape sections in stripes from a wide roll of tape and then slitting down the middle of the stripes. This is currently an expensive process. Some tapes can be made with an extended liner in an additional level-wound roll converting process that adds a flexible extended liner to prevent the adhesive from sticking on the sides. This additional converting process adds to the overall tape cost to the end user. Planetary tape rolls with an added extended liner applied using an extended liner exchange apparatus 306 can provide a cost-effective solution for taping.

The liner exchange apparatus 306 can include a nip roll assembly 314 having a plurality of rollers 316, 318. The rollers 316, 318 can include metal (e.g., steel, chrome-coated steel, or released coated metal rollers, and related materials), rubber (e.g., silicone rubber, or similar rubber), or a combination thereof. In examples, one roller 316, 318 may include metal whereas the other roller 316, 318 may include rubber. The nip roll assembly is designed to laminate the extended liner to the non-linered side or exposed adhesive tape surface with essentially 100% contact and no or minimal air bubbles. In examples, the nip roll assembly 314 can include a tension controller and guides (not shown in FIG. 7). In embodiments, the tension controller can be a spring-loaded felt pad drag system that is manually or automatically adjusted. In embodiments, the tension controller can include an electronic magnetic particle clutch, where a magnetic particle clutch includes an electromagnetic clutch controlled by a control system remote or local to the liner exchange apparatus 306. Other roll tension control devices can also be used.

The nip roll assembly 314 can receive, at an input side, a tape substrate having a substrate width. The tape substrate can include an adhesive tape 310 and an initial liner 312 that is the same or substantially the same width as the adhesive tape. The initial liner 312 can be a non-adhesive liner including a release coating such as a silicone release coating or non-silicone, low-adhesion backside coating or a polymeric film in which the adhesive has low adhesion, although embodiments are not limited thereto. The nip roll assembly 314 can also receive, at the input side, an extended liner 320 having an extended width greater than the adhesive tape width. The extended liner can enable formation of an edge to initiate the liner removal. The extended liner 320 can be provided using an extended liner roll 322. The extended liner 320 can include a non-adhesive liner. In examples, the tape substrate width can be greater than 5, or greater than 16, or greater than millimeters, or greater than 50 millimeters. The adhesive tape 310 can be up to about millimeters thick. In examples, the adhesive tape 310 can be greater than about 1.6 millimeters thick. The liner thickness is usually about 0.3 millimeters and, including the 1.6-millimeter-thick tape, the total thickness will be about 1.9 millimeters. However, a liner thickness could be up to 1 millimeter thick.

The nip roll assembly 314 can output the tape substrate having the extended liner 320 laminated to the tape substrate on an opposing surface from the initial liner 312. In embodiments, the nip roll assembly 314 can center, or nearly-center, the extended liner 320 onto the tape substrate, and in other embodiments the extended liner could be aligned along one long edge of the tape substrate. The extended liner 320 can include a non-elastic material, including a polyolefin polymer, polypropylene material, polyester, paper, etc. The extended liner can be made from a polyolefin material. The liner exchange apparatus 300 can provide a splitter or slicer (not shown in FIG. 7) for splitting the tape substrate subsequent to the extended liner 320 being laminated to the tape substrate. In examples, the tape substrate is split in the middle or about in the middle, widthwise, to provide two equal or nearly equal width tape substrates, which creates two rolls of tape with one side extended liners. It is possible to wind these split tape substrates into two planetary rolls. The liner exchange apparatus 300 can include a printer (not shown in FIG. 7) for printing on one or more of the extended liner, initial liner, or tape. The printer can include a laser printer, laser scribe, ink jet printer, etc. The printing may occur prior to the lamination, subsequent to lamination, or during lamination. In embodiments, the printer can be implemented in a process or be used within a process to create a serial number for each tape segment that can be used for par tracking or data record tracking.

The liner exchange apparatus 300 can further include a liner stripping assembly 324 at an output side of the nip roll assembly 314, the liner stripping assembly 324 configured to remove the initial liner 312. The initial liner 312, subsequent to being stripped with the liner stripping assembly 324, can be wound on the product liner windup roll 326.

At least some of the components of FIG. 7 can be controlled by computing systems, e.g., computational circuitry 230 FIG. 6. For example, movement of the nip control assembly 314 can be controlled for speed to maintain speed or adjust force exerted by the nip roll of the extended liner exchange apparatus 300 to match speed of an operator's assembly line. Accordingly, speed of extended liner roll 322 and tape unwind station 302 can be controlled to provide tape substrate, extended liner 320, etc. at an appropriate speed. Tension on the nip control assembly 314 or related input tape roll 304 or extended liner roll 322 can be controlled based on inputs from data acquisition equipment 208. Vision systems 224 (FIG. 6) can provide input for assistance in centering the extended liner 320.

Figure 8:
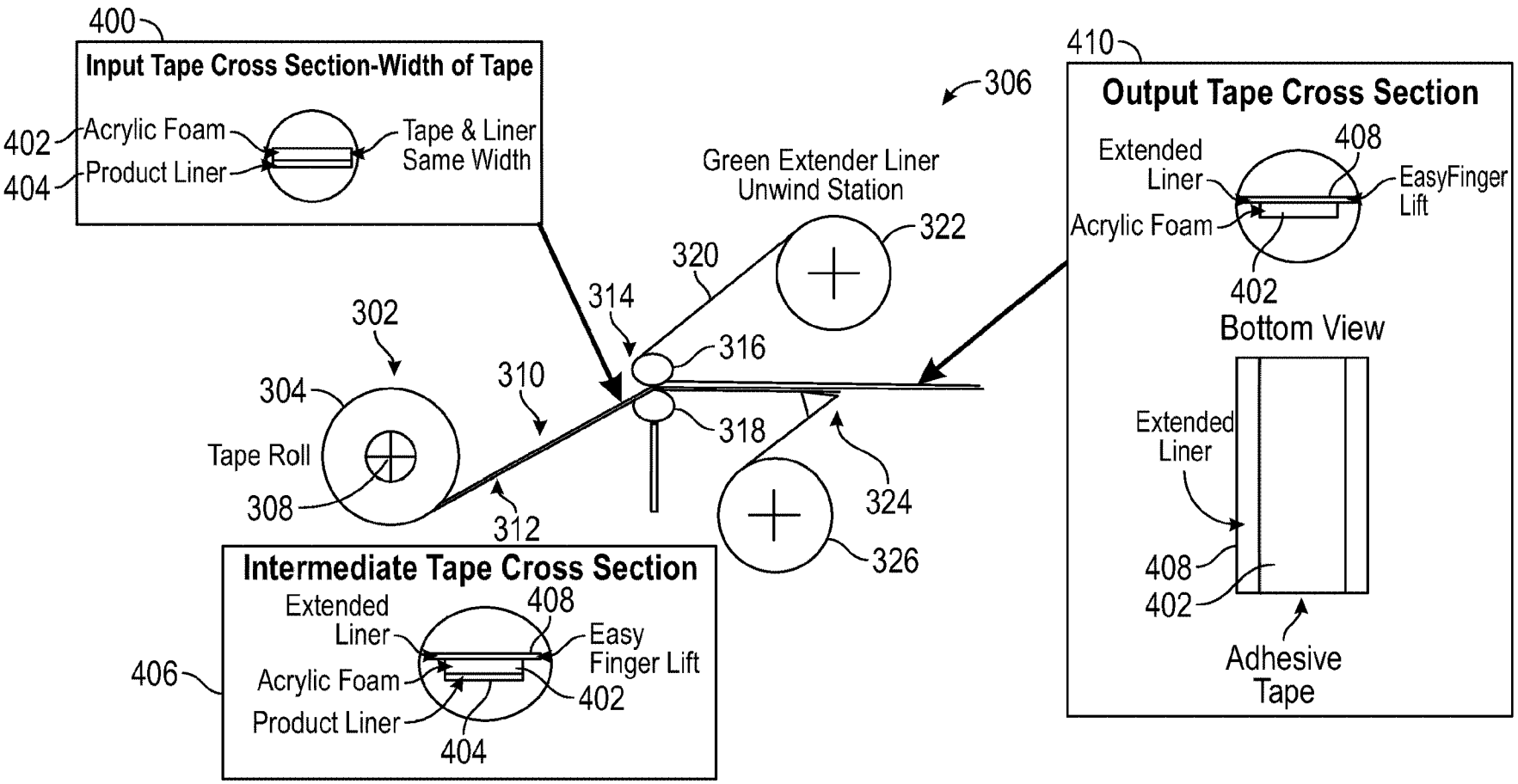
FIG. 8 illustrates one embodiment of tape cross sections at various points of an extended liner process.

FIG. 8 illustrates tape cross sections at various points of an extended liner process in accordance with some embodiments. Reference is made to elements of FIG. 7 in describing the tape cross sections and, accordingly, similar reference numerals in FIG. 8 refer to the corresponding elements of FIG. 7.

At an input stage 400, tape includes an adhesive 402, for example an acrylic foam. Product liner 404 having same width as the adhesive 402 is included. As input tape is provided to nip roll assembly 314, extended liner 408 is laminated and centered onto the adhesive 402. Extended liner 408 can be of greater width than adhesive 402, providing ease in removal of extended liner 408, after the adhesive has been applied to a relevant surface. The extended liner 408 width is preferably at least 3 millimeters wider than the input tape, and preferably at least about 6 millimeters wider than the input tape, and even more preferably about 12 millimeters wider than the input tape. A typical input tape substrate is less than about 150 millimeters wide, and more typically ranges from about 12 to 50 millimeters wide. At output stage 410, a bottom view of tape is shown after product liner 404 has been removed at liner stripping assembly 324. As can be seen, the extended liner 408 is of greater width than adhesive 402. In some embodiments, adhesive 402 can be split in the center or nearly in the center to provide two pieces of tape, each with a partial extended liner 408 attached. These two pieces of tape with extended liner 408 on one side can then be rolled into two planetary rolls.

Surface Characterization Module

Figure 9:
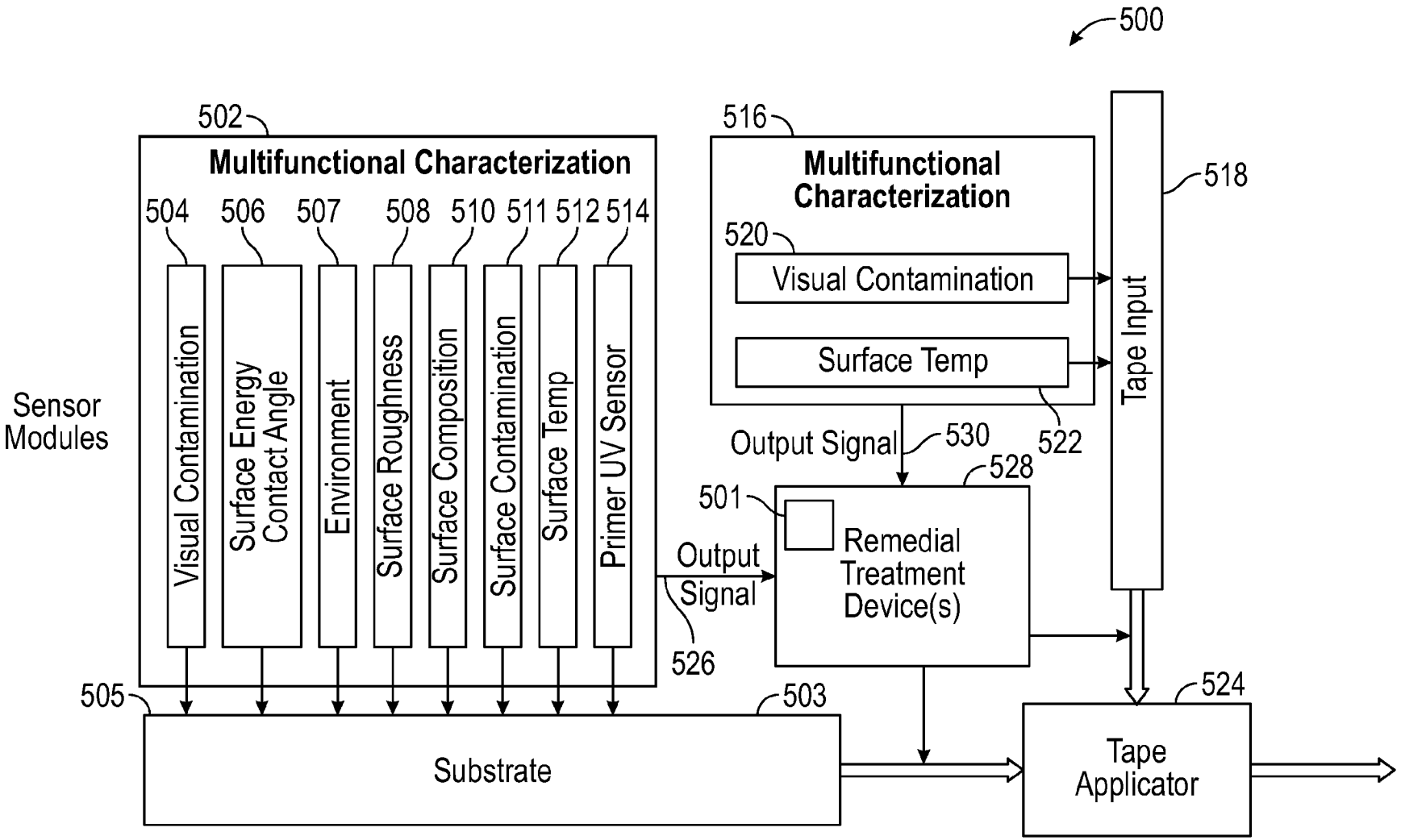
FIG. 9 is a block diagram of one embodiment of a surface characterization module.

FIG. 9 illustrates a surface characterization module 500 in accordance with some embodiments. The surface characterization module 500 can be utilized with the modular tape application system 100 as the multifunctional surface characterization module 104. The surface characterization module 500 can assess at least one of a substrate, a substrate surface, or an adhesive used in bonding processes, including pressure sensitive adhesive tapes and liquid structural adhesives. In one or more embodiments, the surface characterization module 500 can provide a characterization or estimate of surface energy of a surface based on measurements of surface wettability or contact angle. Further, the module 500 can be directed to helping operators solve challenges with surface cleaning and surface modification processes and reduce uncertainty as to whether surfaces are sufficiently cleaned or prepared. The module 500 can provide data to confirm that the surface (including the tape surface, any liner surface including product liners or extended liners, the surface of the substrate that the tape is to adhere to, or other relevant surfaces) is acceptable for adhesive and tape bonding. The surface can be disposed on a substrate, tape or other adhesive, tape liner, or any other surface or combination of surfaces. The substrate surface can include a metal such as aluminum, a polymeric substrate such as an article made from nylon, polypropylene or another polymer, epoxy coating, enamel, paint, coating, or any other substance to which an operator desires to attach a tape or apply a liquid structural adhesive.

The surface characterization module 500 can measure or characterize attributes or parameters including substrate composition, surface composition, surface roughness, primer attributes and primer coverage and amount, surface temperature, surface energy, wettability, ambient temperature, dew point, relative humidity, etc. The attributes or parameters that are characterized can be important to bonding, including adhesive bonding.

In general, the surface characterization module 500 can be configured to characterize surface quality of a surface 505 of the substrate 503 for adhesion. The module 500 can include a sensor or sensors 502 configured to detect at least one property of the surface 505 of the substrate 503 or ambient environment and provide a value indicative of the at least one property. The module 500 can further include the processor 501, which can be configured to determine at least one surface quality parameter of the surface 505 based upon the value provided by the sensor 502, and determine at least one processing parameter for a surface bonding application (e.g., tape application 116 of system 100 of FIG. 5 or liquid adhesive application) based upon the at least one surface quality parameter.

Figure 21:
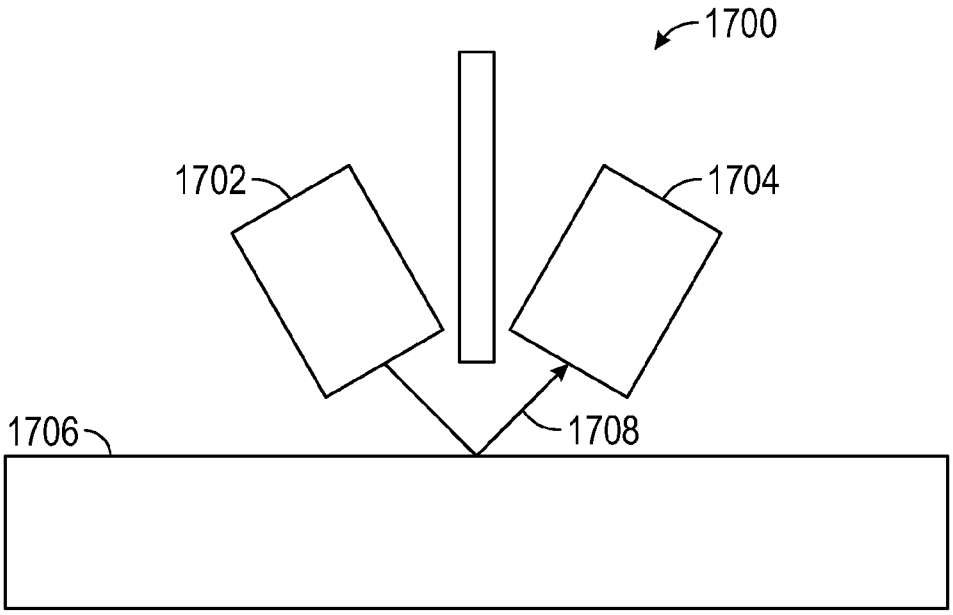
FIG. 21 is a schematic side view of one embodiment of a sensor that can be utilized with the surface characterization module of FIG. 9.

The surface characterization module 500 includes one or more sensors (i.e., substrate sensors) 502 to detect properties, conditions, and parameters of the substrate 503. The substrate 503 can include any suitable material, e.g., at least one of a metal, polymer, ceramic, or glass material, or coating that includes one or more of the suitable materials. In one or more embodiments, at least two sensors of the substrate sensor module 502 will be in use at any given time during tape application. The substrate sensor module 502 can include any suitable sensors, e.g., optical absorption band sensors, temperature sensors, surface energy contact angle sensors, mechanical sensors, imaging sensors, etc. For example, FIG. 21 is a schematic side view of one embodiment of a reflectance mode sensor 1700. The reflectance mode sensor 1700 can include an emitter 1702 and a detector 1704. The emitter 1702 can include any suitable emitter or emitters, e.g., at least one of a light emitting diode (LED), laser, vertical cavity laser, or laser diode. Although depicted as including one emitter 1702, the sensor 1700 can include any suitable number of emitters. Further, the emitter 1702 can be configured to emit electromagnetic radiation 1708 having any suitable wavelength or wavelength band, e.g., ultraviolet, visible, near infrared, infrared, etc. In one or more embodiments, the emitter 1702 is configured to emit electromagnetic radiation having a wavelength of 3450 nm with a full width half maximum of +/−150 nm to measure carbon-hydrogen (C—H) bonds of contaminants on a metal surface. This wavelength region can be useful for detecting oil or other organic surface contaminants on a metal surface. In one or more embodiments, the emitter 1702 is adapted to emit electromagnetic radiation having a first wavelength and a second wavelength, where the first wavelength is different from the second wavelength. The emitter can be configured to emit any suitable number of wavelengths of electromagnetic radiation. In one or more embodiments, the emitter 1702 can emit electromagnetic radiation having a bandwidth of at least 4300 nm with a full width half maximum of +/−250 nm. In one or more embodiments, the emitter 1702 can be a broadband emitter.

In one or more embodiments, the sensor 1700 includes at least one signal and one reference emitter of different wavelengths. In such embodiments, the reference wavelength range is selected so that contaminants do not show significant absorption due to chemical bonds. This reference can be used to subtract out a baseline that affects reflectance of the base substrate. In one or more embodiments, the substrate 1706 does not absorb significantly at that wavelength.

The detector 1704 is disposed to detect at least a portion of electromagnetic radiation 1708 that is emitted by the emitter 1702 and reflected by substrate 1706. The detector 1704 can include any suitable detector or detectors, e.g., at least one of a photodetector, photodiode, photoresistor, or any component that can detect a change in electromagnetic field strength. Although illustrated as including one detector 1704, the sensor 1700 can include any suitable number of detectors. The detector 1704 can be configured to detect one or more discrete wavelength bands of electromagnetic radiation. In one or more embodiments, the detector 1704 can have a detection target wavelength of 3450 nm and a full width half maximum of +/−150 nm. In one or more embodiments, the detector 1704 can be a broadband detector. The sensor 1700 can further include a light shield 1708 that can be disposed between the emitter 1702 and the detector 1704. The light shield 1708 can be configured to block electromagnetic radiation emitted by the emitter 1702 that is directed toward the detector 1704 without first having been reflected by the substrate 1706.

Returning to FIG. 9, the substrate sensor module 502 can include visual contamination sensors 504. Visual contamination sensors 504 can include cameras, magnifiers, or any other device capable of taking or examining visual data and can detect conditions such as cleanliness or lack thereof, excessive debris or dust on the substrate surface, excessive oiliness, etc., and can use image recognition methods, statistical methods, or machine methods to facilitate this detection.

In one or more embodiments, the visual contamination sensor 504 can utilize FTIR to identify a bulk material of the substrate 503, the surface material of the substrate, or a contaminant on the surface 505 of the substrate by scanning a wide spectral region of wavelengths onto the substrate that provide a distinct absorbance or transmittance spectra. Not only can FTIR be used to detect contamination, but the strength of the key spectra signals can be calibrated directly to the amount of contamination on the surface.

FTIR is a very useful technique but is expensive and a challenge to implement on a processing line related to the time required to complete a surface scan. It is useful for measuring stationary substrates and auditing, but not very good for moving substrates.

Figure 22:
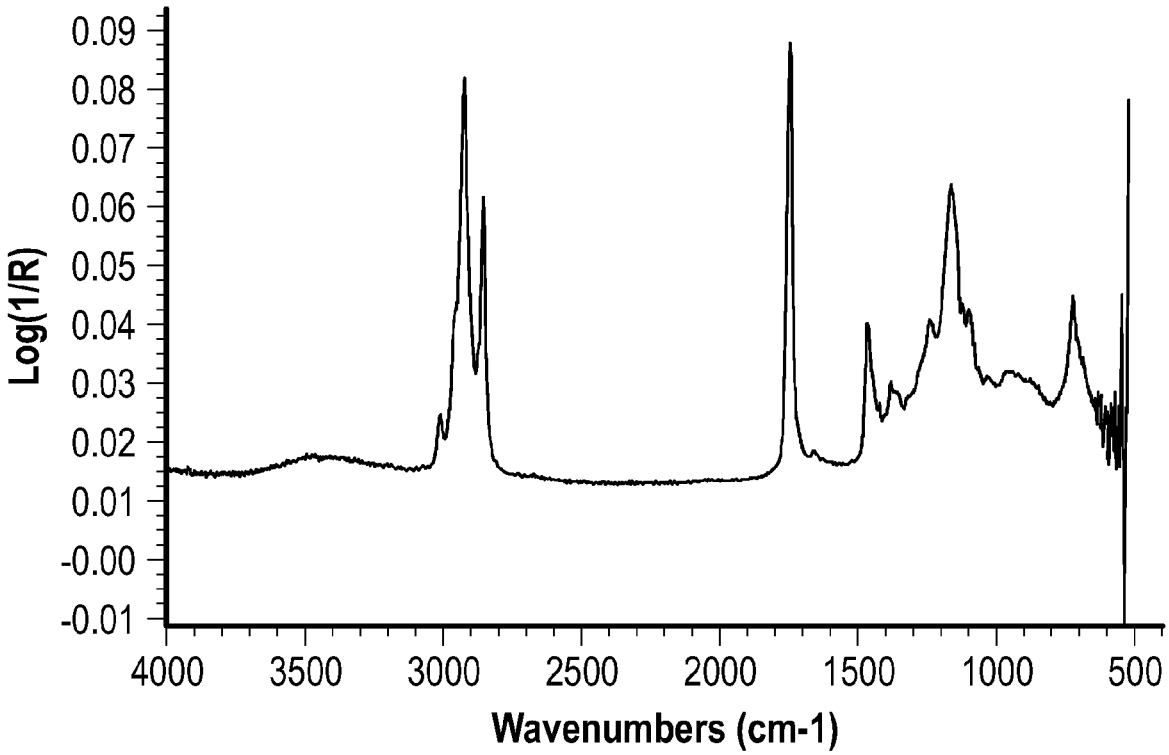
FIG. 22 is a graph of the absorption versus wavenumber.

For example, FIG. 22 is a plot 1800 of absorbance versus wavelength for FTIR spectra for different levels of contamination of a surface of a substrate. In general, a spectral band of an FTIR spectra can be identified where particular contaminants absorb specific wavelengths or wavelength bands that are not absorbed by the particular substrate material. A sensor can be identified that includes an emitter that emits in the identified spectral band and a detector that detects the reflected spectral band. A separate reference emitter can also be utilized that emits electromagnetic radiation of a particular wavelength or wavelength band that is not absorbed by the contaminant In one or more embodiments, a tape can be applied to a metal substrate such as aluminum. Organic oils are typically used in processing such metal substrate and can be a primary source of surface contamination on the substrate. Organic contaminants can exhibit a carbon-hydrogen absorption band in a range of about 3000 to 3800 nm. In contrast, metal substrates such as aluminum do not typically absorb in this range. Most of the absorption detected by the FTIR sensor will, therefore, be from the contaminants and not the substrate.

As shown in FIG. 22, the FTIR Spectrum of Tri-Cool MD-1 Micro-Drop Vegetable Lubricant (available from Trico Corporation, Pewaukee, WI, US) was measured using a Thermo Scientific Nicolet iS10 FTIR Spectrometer running the OMNIC 9 measurement and analysis software (ThermoFisher Scientific, Chicago, Illinois, US). Units included in FIG. 22 are Log(1/R) vs. wavenumbers (1/cm). Peaks can be seen in the wavenumbers range of (1/cm) 3050 to 2700. These correspond to various types of carbon-hydrogen bonds characteristic of organic compounds as detailed in the following Table 1. See Characteristic IR Band Positions. Berkeley Lab, Advanced Light Source [online], [retrieved 2022 Mar. 30]. Retrieved from the Internet <https://www2.lbl.gov/mmartin/bl1.4/IRbands.html> (which shows a span for carbon-hydrogen bond absorbances of 3340 to 2780 wavenumbers (1/cm)).

TABLE 1

| Group CH Stretching vibrations | Frequency Range ($cm^{-1}$) | Wavelength Range (nm) Max | Min |
|---|---|---|---|
| ≡—C—H | 3280-3340 | 3,049 | 2,994 |
| =C—H | 3000-3100 | 3,333 | 3,226 |
| C—CH3 | 2862-2882, 2652-2972 | 3,771 | 3,470 |
| O—CH3 | 2815-2832 | 3,552 | 3,531 |
| N—CH3 (aromatic) | 2810-2820 | 3,559 | 3,546 |
| N—CH3 (aliphatic) | 2780-2805 | 3,597 | 3,565 |
| CH2 | 2843-2863, 2916-2936 | 3,517 | 3,406 |
| CH | 2880-2900 | 3,472 | 3,448 |
| | Mins and Maxs: | 3,771 | 2,994 |

Tri-Cool MD-1 Micro-Drop Vegetable Lubricant was disposed on aluminum test panels having dimensions of 2 inches by 5 inches at six different levels of contamination (Conditions 1-6). The test panels were first cleaned using cleaning processes known in the art and then contaminated with 3 to 4 drops of Tri-Cool MD-1 Micro-Drop Vegetable Lubricant oil. The following are the six Conditions that were measured to produce spectra 1800 of FIG. 23. Units in FIG. 23 are percent Reflectance (% R) as calculated by the instrument software using the % Transmittance calculation. Since the measurement was a reflectance measurement, the Transmittance calculation corresponds to the reflectance. Units on the x-axis have been converted from Wavenumber (1/cm) to Wavelength (nm), again using the instrument software. The conversion between Wavenumber (1/cm) and Wavelength (nm) is Wavelength=1E7/Wavenumber. The observed reductions in % R correspond to greater absorbance of the electromagnetic radiation by the contaminant (Tri-Cool MD-1) at those wavelengths:

Condition 1 (Control): The oil coating was removed from the aluminum test panels. The panels were further cleaned with Methyl ethyl ketone (MEK) solvent CAS No.:78-93-3 (available from Sigma-Aldrich, Inc., St. Louis, MO, USA), two wipes with a 50/50 IPA/water solution, and three Acetone Solvent Wipes. A graph of Condition 1 is not shown but is similar to the graph of Condition 6 of FIG. 23D.

Condition 2: Three to four drops of Tri-Cool MD-1 Micro-Drop Vegetable Lubricant oil was disposed on the surface of each test panel and spread uniformly with a small Kimwipe tissue. The surface of the test panels had an oily sheen appearance. A graph of Condition 2 is not shown.

Figure 23A:
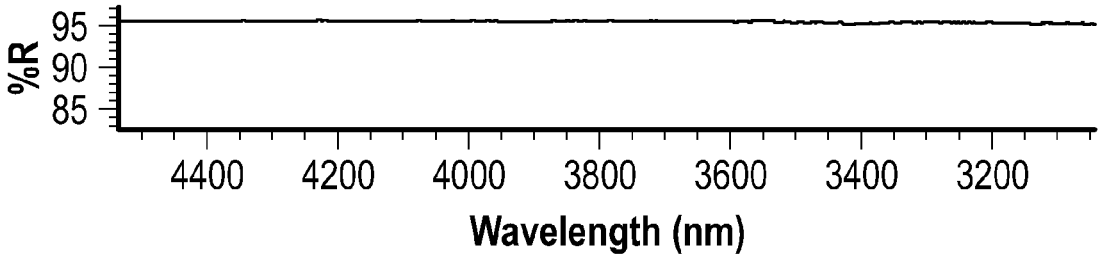
FIG. 23A is a graph of percent reflectance versus wavelength for Condition 3.

Condition 3: The test panels from Condition 2 were wiped one time with a large Kimwipe. FIG. 23A is a graph of the spectrum for the test panels under Condition 3.

Figure 23B:
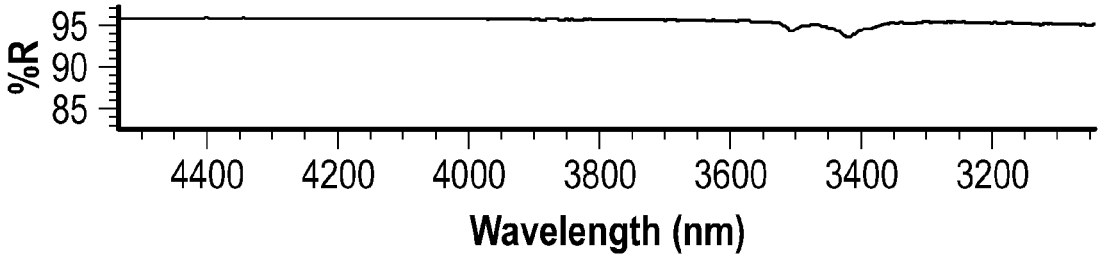
FIG. 23B is a graph of percent reflectance versus wavelength for Condition 4.

Condition 4: The panels from Condition 3 were wiped a second time with a large Kimwipe. The oil was no longer visible on the surfaces of the test panels. FIG. 23B is a graph of the spectrum for the test panels under Condition 4.

Figure 23C:
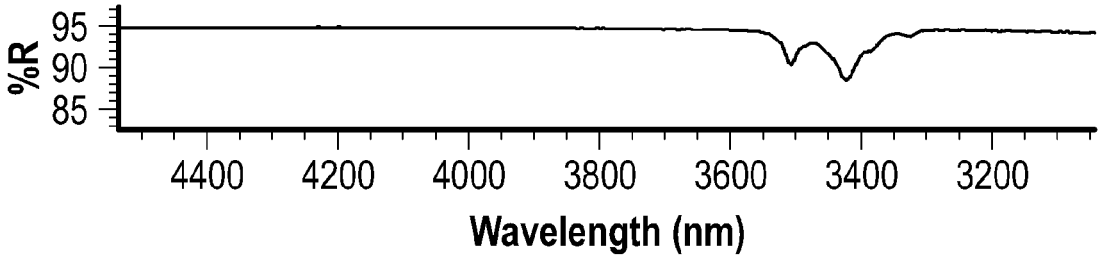
FIG. 23C is a graph of percent reflectance versus wavelength for Condition 5.

Condition 5: The panels from Condition 4 were given one IPA solvent wipe with a tissue (i.e., spray on IPA, wipe with Kimwipe). FIG. 23C is a graph of the spectrum for the test panels under Condition 5.

Figure 23D:
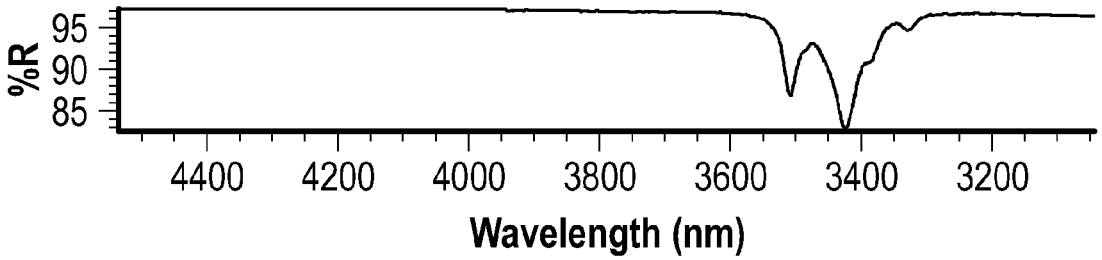
FIG. 23D is a graph of percent reflectance versus wavelength for Condition 6.

Condition 6: The panels from Condition 5 were given one Acetone solvent wipe with a tissue (spray on Acetone, wipe with Kimwipe). FIG. 23D is a graph of the spectrum for the test panels under Condition 6.

After each cleaning, the panels were scanned on a Nicolet iS10 FTIR Spectrometer to produce the graphs of FIGS. 23A-D.

As can be observed in FIGS. 23A-D, the specific wavelength peak heights vary with each particular Condition. TRI-COOL MD-1 oil is an organic oil similar to mineral oil and has a strong peak at around 3450+/−150 nm due to the carbon-hydrogen bonds. This peak would be visible for all organic contaminants. Further, most bare metal substrates do not have significant absorbance at this wavelength. If this type of contaminant is present on the surface, then the amount of contaminant should be proportional to the amount of absorbance as shown in an FTIR spectra.

Discrete wavelength LED emitter lights and related photodiode detectors can be used to provide similar spectral output on a narrow wavelength band. For monitoring the surface 505 of the substrate 503, the LED emitter and related photodiode detectors are mounted such that the LED emitter illuminates the surface with electromagnetic radiation. Such radiation is reflected at a precise angle directly to a photodiode detector, which detects a specific absorbance band as shown in FIG. 21. Concentrator lenses, mirrors, and filters can be used to enhance the signal. For contamination on the surface 505, the LED emitted electromagnetic radiation is selected to emit a wavelength known to be absorbed by the primary contaminant and not absorbed by the substrate 503. For example, hydrocarbon oil contaminants have a strong carbon-hydrogen bond absorbance within a wavelength band of 3450 nm+/−150 nm. Typical metals such as aluminum and steel do not absorb at this wavelength. Light absorbance in this range would indicate hydrocarbon oil or surfactant on the surface. LEDs typically emit electromagnetic radiation in a tight wavelength band. A methane detector LED light emitter and related photodiode detector that can measure absorbance in this wavelength range and can be arranged to detect hydrocarbon oil on the surface 505. To account for changes in the substrate surface 505 that can affect a reflectance signal, a reference baseline wavelength can also measured. The peak height or area relative to the baseline is used to determine the signal strength. For example, an LED emitting in the 4300 nm range could provide a suitable reference wavelength for the baseline. Such LEDs correspond to those used to detect carbon dioxide (CO2). This system offers the advantage of being relatively inexpensive and fast when compared to an FTIR and capable of measuring a moving article or web. LED emitters and related photodiode detectors can take more than 1000 measurements in a minute and average 10 measurement to give about 100 average measurements per minute. For this technique, the absorbance strength can also be calibrated to the amount of contaminant on the surface.

Note that this discrete wavelength system will not detect a contaminant unless it has chemical functionality that absorbs in the discrete wavelength range. Some contaminants such as silicone oil that exhibits small amount of hydrocarbon functionality will have a small presence of carbon-hydrogen bonds and will be challenging to detect using discrete wavelengths in the 3450 nm+/−150 nm band region. A small amount of silicone oil contamination can have a significant effect on lowering adhesion. Another discrete wavelength band can be selected for the specific silicone oil contaminant. For example, silicone oil contaminants can have a strong absorbance at a wavelength of 7900 nm+/−100 nm.

Returning to FIG. 9, substrate sensors 502 can further include surface energy or surface wettability sensors 506. Surface energy or wettability sensors 506 are discussed in more detail herein with reference to FIG. 10.

Surface roughness of a substrate can significantly affect adhesion of most tapes and adhesives. The substrate sensors 502 can further include surface roughness sensors 508. Surface roughness sensors 508 can include mechanical sensors, optical sensors, or image capture devices such as cameras. Surface roughness can also be measured or estimated based on images from the image capturing device. For example, an image captured of the surface 505 or the substrate 503 can be compared to a reference image of a known roughness to estimate or measure the subject surface roughness. Other sensors can be used to assess surface roughness.

The substrate sensors 502 can further include surface composition sensors 510. Any suitable surface composition sensor or sensor can be utilized, e.g., at least one of a near infrared spectroscopy (NIRS) sensor, UV-VIS sensor, Fourier transform infrared spectroscopy (FTIR) sensor, x-ray fluorescence (XRF) sensor, optically stimulated electronic emission (OSEE) sensor, or laser-induced breakdown spectroscopy (LIBS) sensor, or any other optical or physical spectrographic sensors. Measurements may be taken over a full range of the instruments, one or more portions of such range, or over discrete segments of the spectra. Example physical spectrographic sensors include acoustical spectrum sensors such as ultrasonic probes, and vibration pickup, mechanical stylus, and moisture sensors.

The substrate sensors 502 can further include surface temperature sensors 512 (which can include a non-contact infrared temperature sensor) that can help determine whether the substrate 503 is at a temperature most conducive to bonding with tape or adhesive (e.g., liquid adhesive). This temperature can vary depending upon ambient conditions and prior storage temperature, and other factors. In one or more embodiments, the surface temperature sensor 512 can be a non-contact sensor to avoid contamination of surfaces or deformation.

Liquid adhesives in this patent refer to liquid or paste structural adhesives or semi-structural adhesives used in assembly processes, e.g., one part or two-part epoxy, urethane, acrylic, silicon, and similar adhesives.

Other surface sensors 502 could use monochromatic light, lasers, or LEDs of selected spectral regions to sample subsets of the electromagnetic spectrum (e.g., specific wavelengths or wavelength bands preferably in UV-VIS-NIR-IR regions) to find or identify specific contaminants based on the contaminant spectral signature in the subset of the sampled spectral region.

The substrate sensors 502 can further include UV fluorescent sensors 514 triggered by the appropriate UV light shining upon the surface. Such sensors 514 can detect presence or amount of primer or presence of sufficient primer by using an ultraviolet (UV) sensor to detect and measure UV additive within the primer.

The surface characterization module 500 can further include tape sensors 516 to detect properties, conditions, or parameters of tape 518. Tape sensors 516 can include visual contamination sensors 520 and surface temperature sensors 522. The visual contamination sensors 520 and surface temperature sensors 522 can be similar to, the same as, or collocated with visual contamination sensors 504 and surface temperature sensors 512 that measure similar properties of the substrate 503 to which the tape will be adhered during tape application operations 524.

The at least one property of the surface 505 of the substrate 503 detected by the sensors 502 can include any suitable property or properties, e.g., the presence of a primer on the surface 505 of the substrate 503, surface temperature, dust, debris, surface contamination, surface wetting, and other sensors.

Sensors such as the substrate sensors 502 can provide an output signal 526 to remedial device 528 configured to provide remedial treatments or perform other remedial functions on the substrate 503. Remedial functions can include surface treatment processes including solvent cleaning modules, wiping, scrubbing, dust and debris removal, abrasion modules, plasma treaters, flame treaters, laser treaters, corona treaters, ultrasonic treaters, or other treatment processes such as heating the substrate, etc. These remedial processes are designed to clean the surface and/or increase the surface energy or wettability of the substrate 503 for improved adhesion of the tape or adhesive to the substrate. Similarly, the tape sensors 516 can provide an output signal 530 to remedial device 528. Signals 526 and 530 can include visual or audio indications alerting an operator to use a remedial device 528 to provide treatments to the substrate 503 or the tape 518. The surface characterization module 500 can log these and other data for troubleshooting purposes or for determination of environmental parameters to be set in future bonding processes.

The surface characterization module 500 can further include a processor 501 coupled to at least one sensor of the tape sensors 516 or substrate sensors 502. In some examples, the processor 501 can couple to two or more sensors of the tape sensors 516 or substrate sensors 502. The processor 501 can determine at least one surface quality parameter of the surface 505 based upon measurements of the sensor 502 (e.g., the value provided by the sensor), and determine at least one downstream or upstream processing parameter for a surface bonding application based upon the at least one surface quality parameter. The at least surface quality parameter can include any suitable parameters, e.g., temperature, roughness, surface energy, debris, contaminates, etc.

Further, the processing parameters can include any suitable parameter, e.g., environmental temperature, amount of force, processing speed, primer application, surface heating, abrasion adjustments, cleaning processes, etc. The processor 501 can provide an indication of a remedial action to perform that is responsive to detecting an adverse surface quality condition. As used herein, the phrase "adverse surface quality condition" means any condition that may adversely affect the adhesion of the tape or adhesive to the substrate surface. The indication can include a recommendation to adjust a surface abrasion process or perform any other process on the surface of either the tape, substrate, or liner, or some combination thereof. The indication can include a recommendation to provide service to a primer applicator system. The indication can include a recommendation for potential corrective actions or clean or treat the substrate to which the tape is being applied. The indication can include a recommendation to adjust a surface treatment process of at least one of the tape or the substrate to which the tape is being applied. Other recommendations can also be provided, e.g., at least one of cleaning the substrate, priming the substrate, surface treating the substrate, plasma or corona treating the substrate, abrading the substrate, heating the substrate, or drying the substrate. The above examples are not limiting on the number or nature of recommendations for remedial action provided by the processor 501. In one or more embodiments, the processor 501 is further configured to control a machine or module (e.g., surface cleaning module 102 of system 100 of FIG. 5) that is configured to perform the selected remedial action using any suitable technique.

The processor 501 can further be configured to identify surface composition of the surface 505 of the substrate 503 based upon the value provided by the sensors 502 using any suitable technique. For example, the surface composition of the surface 505 of the substrate 503 can be identified based upon a value provided by an optical absorption band sensor. If an unexpected surface composition is detected, then the processor 501 is further configured to provide a notification or feedback that is responsive to detecting the unexpected surface composition. As used herein, the phrase "unexpected surface composition" means surface material that is not what is expected or the surface is contaminated, such as a different surface than what the tape was selected to match with.

The processor 501 can further be configured to generate a prediction of the probability of success of the surface bonding application based upon the at least one surface quality parameter of the surface. Such prediction of success can be determined using any suitable technique, e.g., one or more of the techniques described herein regarding the Adhesive Prediction System. The prediction of success of the surface bonding application can further be based upon at least one of a specific tape or adhesive, a substrate composition, or the at least one property of the surface.

Figure 10:
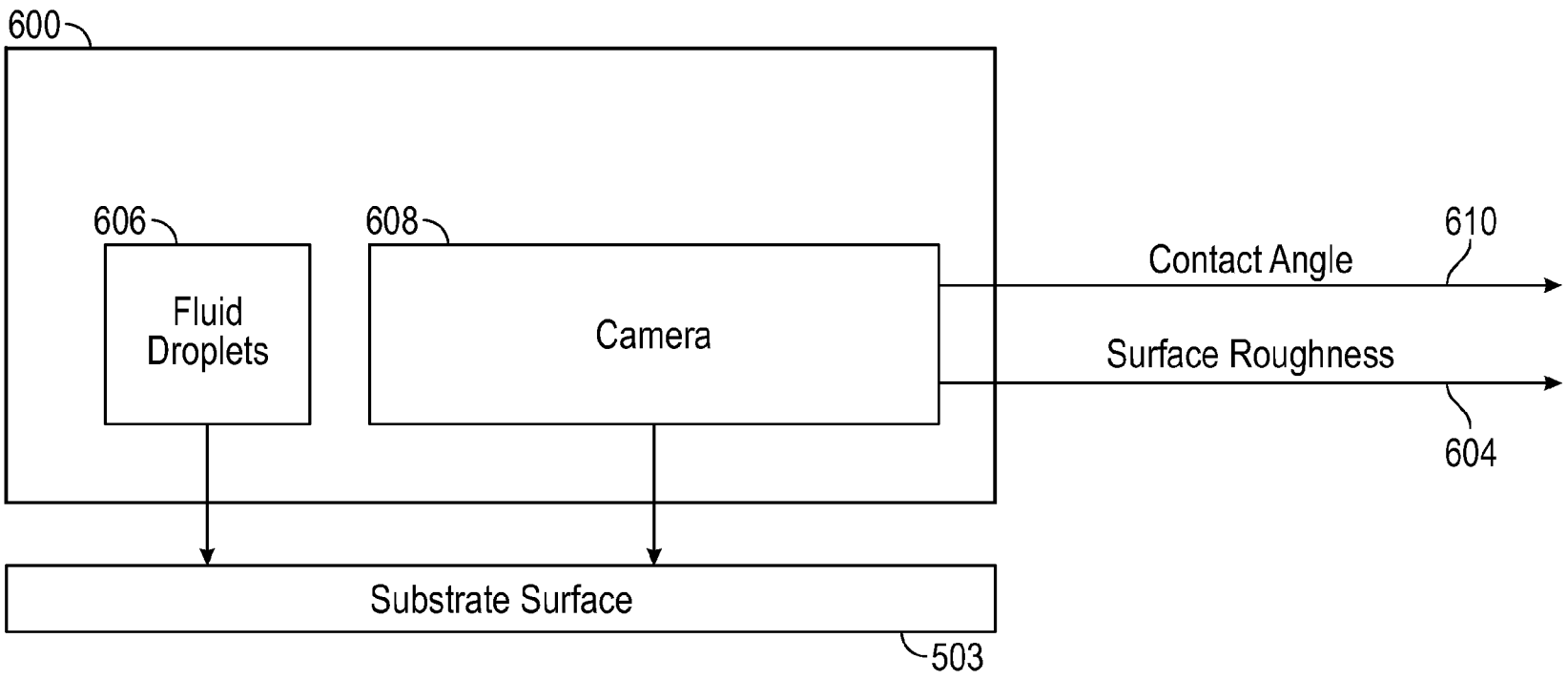
FIG. 10 is a block diagram of one embodiment of a sensor for detecting a measure of surface energy or wettability and surface roughness.

FIG. 10 is a block diagram of a sensor 600 for detecting contact angle 610 (typically water contact angle) and calculating surface wettability or surface energy and surface roughness 604 of the substrate 503 in accordance with some embodiments. The sensor 600 can perform operations of one or both of the wettability sensors 506 and the surface roughness sensors 508 (FIG. 9).

Surface energy is the surface tension of a solid and is typically measured in units of energy per unit length. Surface energy determines how the solid behaves in contact with other materials, and in the specific application of the substrate 503, can determine how the substrate will behave in contact with the tape being adhered to the substrate. Surface energy is usually indirectly estimated by a wettability of a surface test (e.g., contact angles, wetting tension, percent area wettened), which is known to correlate to surface energy and adhesion. Testing and detection can occur continuously, or during spot-checking, or periodically.

The sensor 600 takes reference liquid droplets 606 as an input. The liquid droplets 606 can contain a UV fluorescent material (taking into consideration the need to avoid contamination and the ability to remove the droplets from the article surface) to fluoresce when exposed to UV light to make the droplets more visible. The liquid droplets 606 can be of one or more different types and have a known surface tension. In examples, the liquid droplets 606 can include a polar liquid (typically water).

The liquid droplets 606 are applied to the substrate 503 under test. A camera 608 can be used for visual inspection or computer-based inspection to observe or measure or estimate a contact angle with the substrate 503. The contact angle is the angle formed between the liquid droplets 606 and the substrate 503 at the three-phase contact point where the solid-liquid and liquid-gas interfaces meet in example embodiments. Higher energy surfaces are more wettable with a given liquid having a lower contact angle, and lower energy surfaces are less wettable with a given liquid having a higher contact angle. Accordingly, wettability measurements (ex. contact angle measurements) can be correlated to surface energy and adhesion values. In another example, the wettability can be estimated by controlling deposition of a known number of liquid droplets on the surface and subsequently capturing an image of the surface and determining the amount of surface area covered by the droplets.

Water contact angle measurements are a very effective technique for detecting and determining silicone oil contamination on the surface. The change in water contact angle can be used to determine the amount of contamination on the surface.

Surface roughness 604 can be measured through subjective observation by an operator using a camera image taken by the camera 608. Other methods for estimating contact angle, surface roughness, surface energy, or wettability can also be used.

Tape Roll Splicing Station

Figure 11:
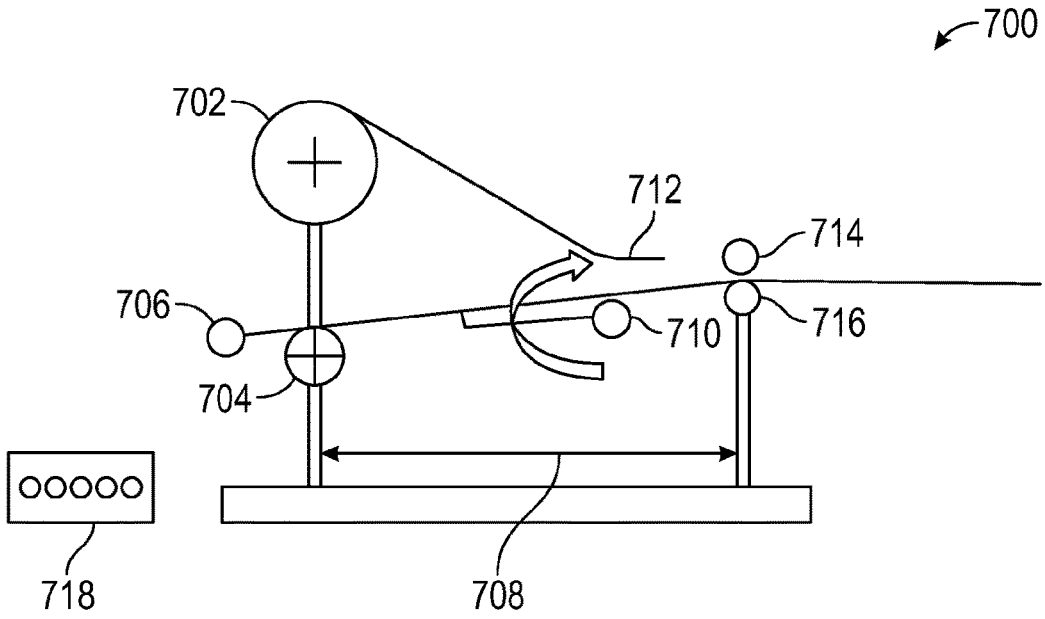
FIG. 11 is a block diagram of one embodiment of a tape roll splicing station.

FIG. 11 illustrates a tape roll splicing apparatus 700 in accordance with some embodiments. The tape roll splicing apparatus 700 can include spools (e.g., at least two tape core holders) to hold at least two rolls of double-coated tape, and a mechanism for unwinding multiple rolls of tape and for splicing a new (or full) tape roll 702, to a depleted (or nearly depleted) tape roll 704 for continuous operation and reduced time in tape roll changeover. The multiple rolls of tape can include double-coated tapes, for example double-coated foam tapes.

The tape roll splicing apparatus 700 is directed to helping operators solve challenges with tape roll changeover being needed too often to the extent that production or assembly lines are stopped or slowed, decreasing throughput, and reducing operator profits. Typical double coated tape and foam tape rolls are about 36 to 72 lineal yards long. In manual tape splicing systems, an operator typically detects a need to change a depleted or nearly depleted tape roll. The operator will typically stop or slow line speed for other processes outside the tape application system or other processes downstream of tape application (e.g., at a point when tape is applied to a surface). The operator will then cut one or both of depleted or nearly depleted tape roll and the new tape roll, and manually create a splice (e.g., a "butt splice") in the new roll. Manual tape splicing systems can be error prone. For example, the new tape roll 702 may become misaligned during splicing with the depleted tape roll 704 after splicing. Manual tape splicing is also relatively slow and can take minutes to splice together with the line stopped.

The tape roll splicing apparatus 700 of one or more embodiments can address these and other concerns to reduce time for loading of new tape rolls and perform auto-threading of tape rolls into the mechanisms that will be used downstream in a tape application process. The tape roll splicing apparatus 700 can perform operations on tapes of various widths and thicknesses, in contrast to level-wound rolls of tape that can be limited to certain widths, thicknesses, lengths and liner types, and require certain manufacturing processes. Additionally, the tape can be supplied as a cartridge that facilitates the threading operation or pre-threads the tape into the mechanisms.

A tape roll splicing apparatus 700 in accordance with embodiments can include a roll sensor 706 configured to detect a condition of depletion of at least a first roll (e.g., the depleted tape roll 704) of tape. Although not shown, the apparatus 700 can include a second roll sensor to detect depletion of the new tape roll. In some embodiments, instead of or in addition to the roll sensor 706, software, hardware, or other control systems remote or local to the tape roll splicing apparatus 700 can determine approximate tape remaining on a roll based on amount of material previously processed. In some examples, this approximation can be made as part of control logic of an unwind unit. The roll sensor 706 can include an optical sensor. Additionally, or in the alternative, the roll sensor 706 can include a mechanical arm configured to detect an empty roll when a diameter of the depleted tape roll 704 falls below a threshold. Additionally, or in the alternative, the roll sensor 706 can include a weight detector to detect weight of the depleted tape roll 704. The roll sensor 706 or a separate roll sensor (not shown in FIG. 11) can detect conditions of other rolls of tape, for example the new tape roll 702 or other tape rolls in systems having more than two tape rolls. The roll sensor 706 or control circuitry in contact with the roll sensor 706 or other portion of the tape roll splicing apparatus 700 can detect or determine an amount of time or distance 708 over which splicing should occur. The end of the tape of the depleted tape roll 704 can be estimated using a sensor that dispenses how much tape has been dispensed, e.g., a 36 yard roll runs out at 36 yards.

Responsive to the roll sensor 706 detecting an empty condition of a roll of tape (for example the depleted tape roll 704), a cutting mechanism 710 can cut depleted tape roll 704 at a trailing edge of the depleted tape roll 704. The cutting mechanism 710 can cut the depleted tape roll 704 at an angle, relative to the length and width of the tape. For example, the cutting mechanism 710 can cut the depleted tape roll 704 parallel to the trailing edge or leading edge of each of the depleted tape roll 704, or perpendicular to the lengthwise edge. A new tape roll 702 will be pre-cut in manufacturing. In examples, the angle of each cut should be substantially the same to minimize gap between each piece of tape after splicing. The tape splicing process is designed to make the splice with minimal gap or no overlap of pieces of tape.

A splicing mechanism can splice a leading edge of the new tape roll 702 (or other tape roll in the system, not shown), to the trailing edge of the depleted tape roll 704.

A tape tab 712 can be created in the new tape roll 702. The tape tab 712 is used to liner butt splice the new tape roll 702 to the depleted tape roll 704. The tape tab 712 can be made manually or automatically ahead of time before the new tape roll 702 is mounted into or onto the tape roll splicing apparatus 700.

In one or more embodiments, one or more of the tape rolls 702, 704 or other tape rolls (not shown in FIG. 11) can include adhesive and liner as depicted in FIG. 7. In examples, the spliced depleted roll 704 and new roll 702 are fed into a nip roll mechanism having at least two nip rolls 714, 716, for liner splicing as described with respect to FIG. 7 and FIG. 8 earlier herein.

Figure 12A:
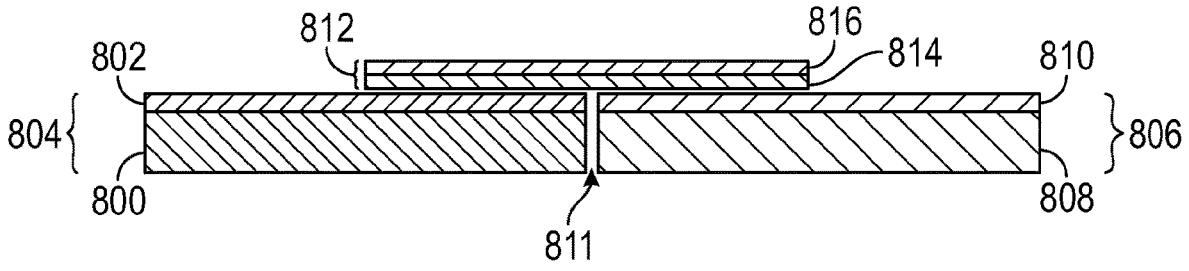
FIG. 12A is a diagram illustrating one embodiment of a type of liner butt splicing.
Figure 12B:
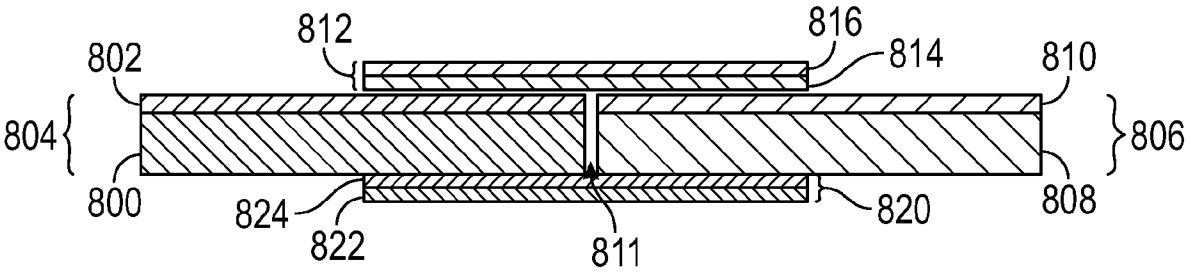
FIG. 12B is a diagram illustrating another embodiment of a type of functional butt splicing.
Figure 12C:
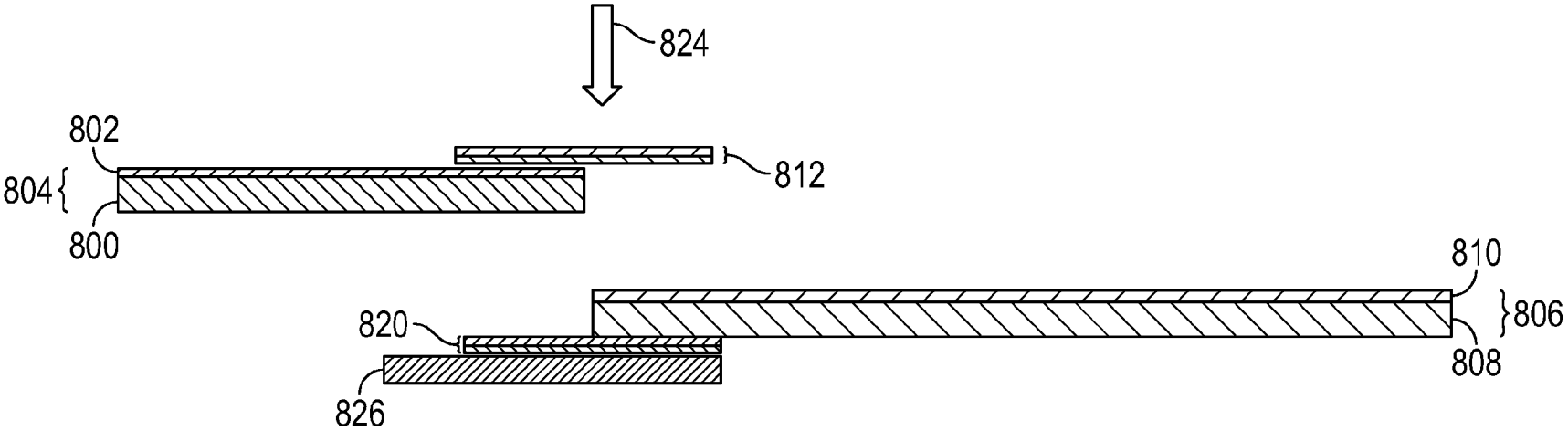
FIG. 12C is a diagram illustrating one embodiment of preparation for functional butt splicing.

FIG. 12A is a diagram illustrating a type of liner butt splicing in accordance with some embodiments. FIG. 12B is a diagram illustrating another type of butt splicing identified as a functional splice in accordance with some embodiments. Both types of splicing can be referred to as butt splicing. FIG. 12C is a diagram illustrating preparation for butt splicing in accordance with some embodiments.

In FIG. 12A, tape can include, e.g., double-coated acrylic foam 800 and tape liner 802 can include one piece of tape 804 to be spliced to another piece of tape 806, e.g., acrylic foam 808 and tape liner 810. Double-coated acrylic foam 800, 808 can typically have a thickness of up to about 6.0 millimeters thick. In examples, the double-coated acrylic foam 800, 808 can have a thickness of greater than 1.6 millimeters. The tape liner 802, 810 can be less than about 0.25 millimeters thick although in some embodiments, the tape liner 802, 810 can be up to about 0.5 millimeter thick. The pieces of tape 804 and 806 can have a gap 811 of less than about 3.2 millimeters (⅛ inch), depending on tape type and application, or less than about 1.6 millimeters (1/16 inch). The gap 811 helps prevent or eliminate overlap bumps in spliced tape, which can reduce or eliminate jams and other problems further downstream from the tape roll splicing apparatus 700 (FIG. 11). The gap 811 should, however, be minimized to maintain watertightness and bond consistency and integrity between the piece of tape 804 and piece of tape 806.

A tab 812, which includes of an adhesive portion 814 for bonding to tape liner 802, 810 and a tape film backing 816, can be applied over the gap 811. In embodiments, the tab 812 can be centered over the gap 811, although embodiments are not limited thereto. In embodiments, the portion 814 can include a silicone-based pressure sensitive adhesive (PSA) and the tape film backing can comprise polyester (PET). Splicing according to FIG. 12A can be referred to as liner butt splicing, in that only the liner is being spliced, not the tape itself.

FIG. 12B illustrates a splice where both the liner and the tape are separately spliced together. The spliced liner can be removed, and the tape is still spliced together and continuous. In FIG. 12B, tape that includes the double-coated foam 800 (for example acrylic foam tape, although embodiments are not limited thereto), and tape liner 802 can include one piece of tape 804 to be spliced to another piece of tape 806 that includes the acrylic foam 808 and tape liner 810. A splicing tape tab 812, which includes an adhesive portion 814 for bonding to tape liner 802, 810 and a tape film backing 816, can be applied over the gap 811. In embodiments, the splicing tape tab 812 can be centered over the gap 811, although embodiments are not limited thereto. In embodiments, the portion 814 can include a silicone based or compatible pressure sensitive adhesive (PSA) and the tape film backing can include polyester (PET). Splicing according to FIG. 12A can be referred to as liner butt splicing, etc.

As in FIG. 12B, the pieces of tape 804 and 806 can have a gap 811 less than about 3.25 millimeters, depending on tape type and application, or less than about 1.63 millimeters, or about 1/16 inch. The gap 811 helps prevent or eliminate bumps in spliced tape, which can reduce or eliminate jams or other problems further downstream from the tape roll splicing apparatus 700 (FIG. 11). However, a second tab 820 that includes an acrylic (or the same or similar adhesive used on the double-coated foam 800 and 808) PSA 822 and a compatible backing material (in some examples a polyester or polymeric film and adhesive) 824 can be applied to splice the foam portion at an opposite side of the pieces of tape 804, 806. Splicing according to FIG. 12B can be referred to as functional splicing or functional butt splicing.

In FIG. 12C, the two pieces of tape 804 and 806 are depicted before splicing occurs. Same element numbers in FIG. 12C refer to corresponding elements of FIG. 12B. At 824, force is applied to tab 812 in a direction toward splicing table 826. The splicing table 826 can also be a moveable sled or carriage. The splicing table 826 provides a counterforce to the automatic force provided at 824 during tab 812 application. The spicing table 826 includes guides for maintaining the pieces of tape 804, 806 in a splicing position and alignment. The splicing table can be coated with a release coating or similar surface to minimize adhesion of the tab 820. Tab 812 will therefore contact tape liner 810 of the piece of tape 806, thereby forming a liner butt splice and splicing piece of tape 804 to the piece of tape 806 to provide a continuous roll of tape. Similarly, tab 820 contacts and bonds acrylic foam 800 and 808 together forming a functional splice.

Referring again to FIG. 11, the tape roll splicing apparatus 700 can further include other circuitry 718 for communicating with other systems or for providing indicators. The circuitry 718 is described in more detail herein with respect to FIG. 19 and FIG. 20. For example, the circuitry 718 can include an indicator mechanism to indicate an emptiness condition of the depleted tape roll 704 or other tape roll. As a further example, the circuitry 718 can include a communication interface and a processor coupled to the communication interface to provide a signal to other elements of the system 100 (FIG. 5), including signals indicative of a desired speed of a manufacturing line associated with the tape roll splicing apparatus 700. This process can record the splice time, tape identification information, day code of the two input rolls of tape, and other applicable information.

Similarly, an improved roll change and splicing system can also benefit various tape automation processes commonly known as semi-automated push through straight line laminators (SLL). These automation tools and processes like a SLL are effective and are used to improve manual tape application operations, and offer benefits of improved quality, processing rate, and overall productivity and cost. Straight line laminators are commonly used to apply Acrylic Foam Tape and 3M™ VHB™ Tape to stiffeners and related linear parts.

Figure 24:
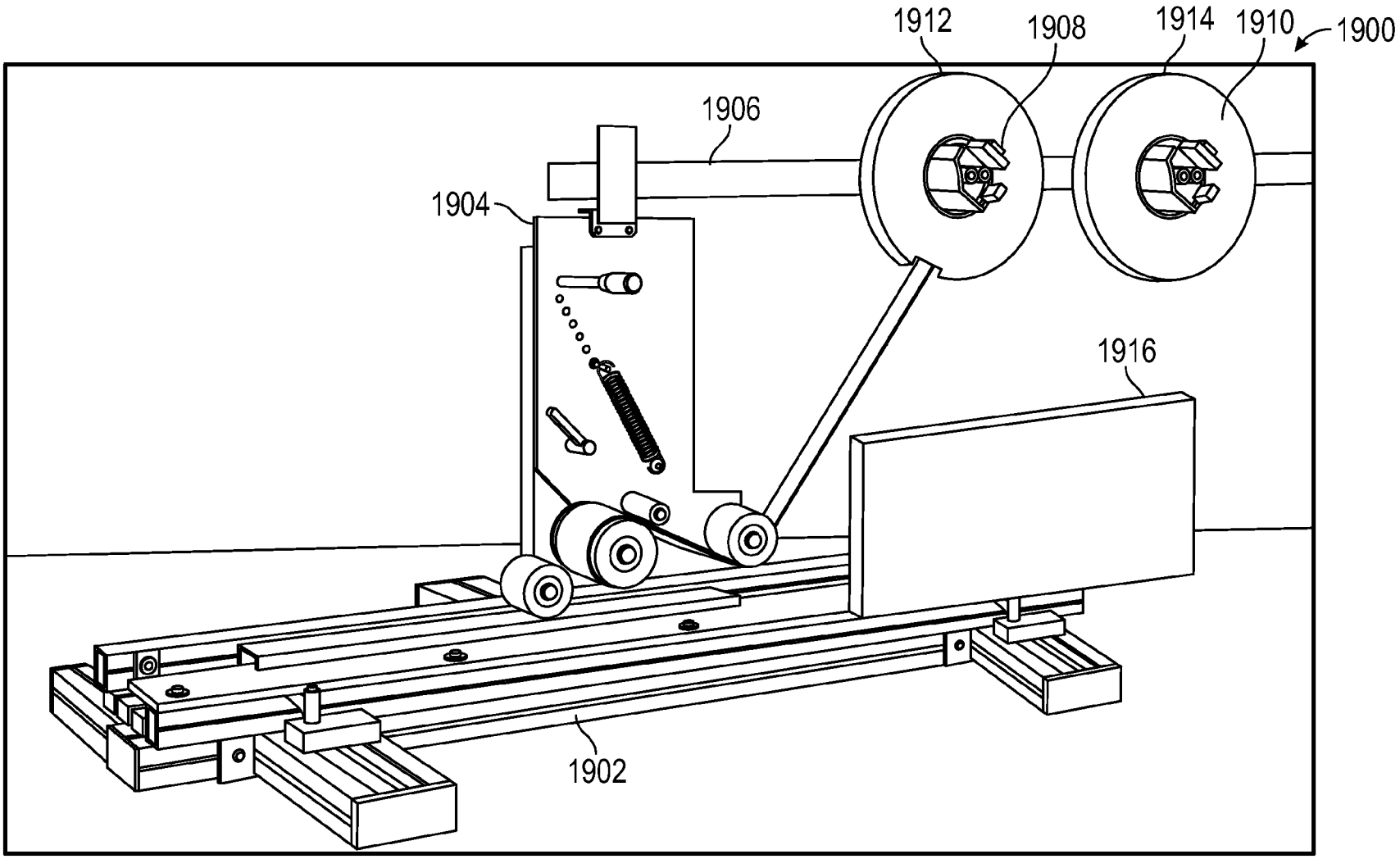
FIG. 24 is a schematic side perspective view of one embodiment of a tape entry system.

FIG. 24 is a schematic side perspective view of one embodiment of a tape entry system 1900. All design considerations and possibilities described herein regarding the tape entry system 106 of FIG. 5 apply equally to the tape entry system 1900 of FIG. 24. The system includes a base 1902 and/or a frame 1904. The frame 1904 includes an arm 1906 and first and second spindles 1908, 1910 connected to the arm. A first tape roll 1912 is connected to the first spindle 1908, and a second tape roll 1914 is connected to the second spindle 1910. The system 1900 also includes a tape splicing module 1916 that is configured to be slidably engaged with the base 1902. The tape splicing module 1916 can be configured to splice together planetary tape rolls continuously or nearly continuously. The tape splicing module 1916 includes a table 1918 upon which a splice can be formed.

The spindles 1908, 1910 can be slidably connected to the arm 1906 using any suitable technique such that the tape rolls 1912, 1914 can be independently repositioned along the arm. In one or more embodiments, the spindles 1908, 1910 can be connected to a track disposed in the arm 1906 by a slide that is connected to each spindle. In one or more embodiments, the spindles 1908, 1910 can be repositionably locked in place along the arm 1906. Although the system 1900 is illustrated as including two spindles 1908, 1910 and two tape rolls 1912, 1914, the system can include any suitable number of spindles that can support any suitable number of tape rolls.

In general, typical straight line tape entry systems are relatively low cost and simple to operate. Such systems can also improve quality by being capable of consistently and uniformly processing significant amounts of tape. Manual roll changes can, however, be challenging and require significant downtime of the system as these roll changes require multiple steps. For example, the roll change process requires the operator to stop the line, cut off the roll of tape, and then remove the depleted roll. The operator then installs a new roll of tape and adds a tape tab to the end for splicing. Once the new roll has been prepared, the operator takes the tail end of the depleted roll and attaches it to the end of the new roll with the tape tab by hand and with no alignment aid.

Figure 25:
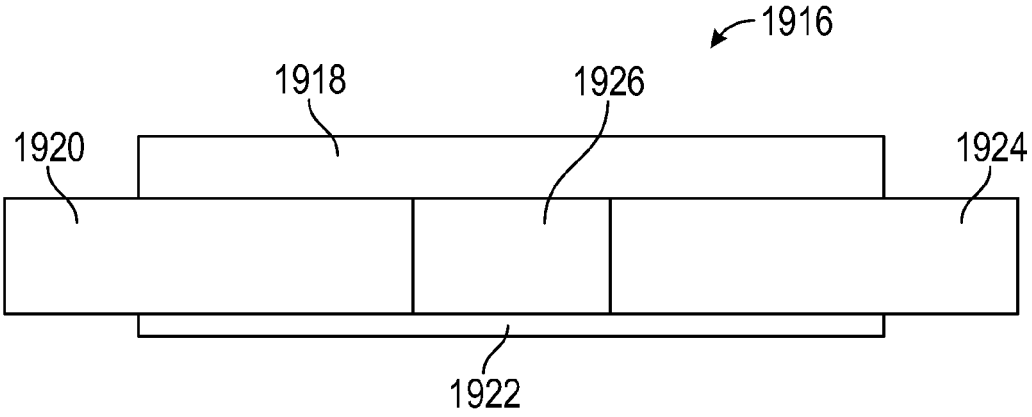
FIG. 25 is a schematic plan view of a splice formed utilizing the tape entry system of FIG. 24.

The addition of the second tape roll 1914 on spindle 1910 to the arm 1906 of the system 1900 and the inline tape splicing module 1916 can assist in aligning the end of the tape from the depleted roll (first tape roll 1912) with the end of the tape of the new roll (second tape roll 1914). The new tape roll 1914 can be preloaded or loaded at a convenient time in the process. As shown in FIG. 25, once the first tape roll 1912 is depleted, the inline splicing module 1916 can be slid into position for splicing, and a depleted end 1920 of the first tape roll can be aligned against an edge guide 1922 and applied/pressed to the table 1918 of the module 1900. The second tape roll 1914 can be prepared for running the system 1900 by sliding the roll into position and locking it in place. A new tape end 1924 of the second tape roll 1914 can be similarly applied directly over the depleted end 1920 on the splicing table 1918. In one or more embodiments, a safety protected razor knife or other cutting device can be slid along a track directly over the two overlapping ends 1920, 1924, thereby cutting through both layers. The adhesion of the tape holds the tape to the table 1918 of the splicing module 1916. The two cut off ends are removed, and the two remaining ends are pressed into position on the splicing table 1918. Because the knife cuts through both ends at the same time, they are in position for splicing and alignment. The operator then applies a piece of splicing tape 1926 onto the liner directly over the splice line, creating a liner butt splice. The tape is removed from the splicing table 1918, and the table is slid out of the way.

In one or more embodiments, the system 1900 maintains the same tape path as the depleted tape roll 1912 is replaced by the new tape roll 1914 because the new tape roll can be slid into place without having to move the depleted tape roll. Further, the splicing table 1918 can be configured to make a clean and aligned splice with almost no gap that can be applied to a substrate without creating defects.

Hand Tape Applicator

Figure 13:
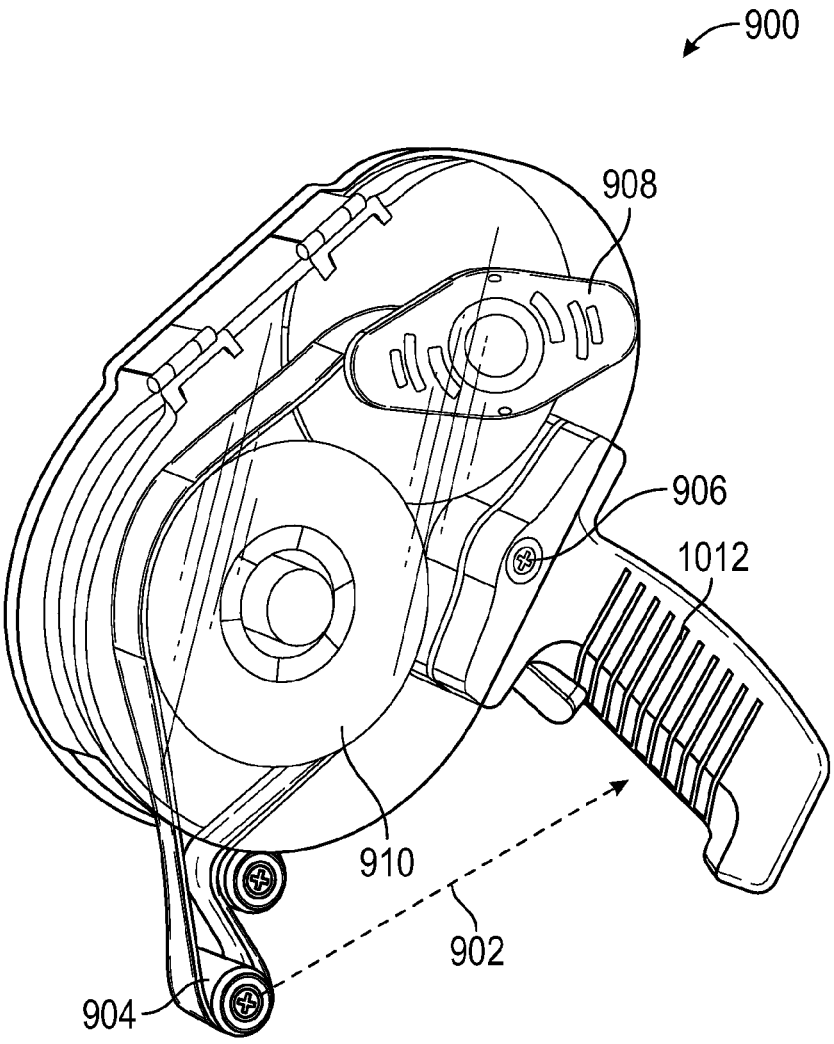
FIG. 13 illustrates one embodiment of a tape applicator.

FIG. 13 illustrates one embodiment of a hand tape applicator 900. The hand tape applicator 900 includes apparatuses and circuitry to measure at least one of tape application forces or positions. The applicator 900 is directed to helping operators during manual application solve challenges of applying tape in a desired (e.g., linear) application to meet needs of downstream processes. Although described regarding manual applications of tape to a substrate, the tape applicator 900 can be utilized in automated operations as is further described herein. In one or more embodiments, the tape applicator 900 can be utilized by an operator to apply tape to a substrate in a direction 902 toward the operator.

The applicator 900 can include a tape feeding system 910 to feed tape around a tape core in a forward direction and a liner windup roll 908 when liner is removed from tape.

Example apparatuses and circuitry can include guides (e.g., laser guides or vision-based sensors or mechanical guides) to guide tape application in a linear fashion or along a particular position as is further described herein. For example, guides can indicate the direction 902 that the tape applicator 900 is applying tape and where the tape should start and end on the substrate. Vision-based sensors can help detect oil, rust, debris, or other contaminants, or to detect primer or other materials at a surface at which the tape is to be applied. In addition, one or more sensors of the multifunctional surface characterization module 104 of FIG. 5 can be connected (wired or wirelessly) to the tape applicator 900. In one or more embodiments, the applicator 900 can receive input from the surface characterization module 104.

Example apparatuses can further include notification systems to provide feedback regarding tape application force, alignment, substrate surface temperature, and other information. For example, feedback can be provided using an audio or visual alarm if lamination force is lower than a threshold, if lamination force is not uniform, if the tape should be checked for air bubble entrapment, and other conditions, and remedial action taken if needed. Force sensors 905 (FIG. 14) can include sensors to detect force across a length of the tape, parallel or substantially parallel with tape application, thereby measuring force along the dispensing path. In addition, or alternatively, force sensors 905 can measure force across a width of the applicator 900 perpendicular or substantially perpendicular to the direction 902 of tape application, thereby measuring force across a width of the dispensing path. The forces can be displayed in a graphical format along the dispensed path on an article and can be recorded and documented per each specific identified article for later production Quality Control processes. If the forces are out of specification, a light or signal can be initiated so that the operator and supervisor know of the issue. Optionally, the operator can take remedial action to correct the issue.

Audio or visual feedback can be provided if alignment varies by a threshold from a desired alignment. Similarly, the tape alignment can be recorded and displayed. The applicator 900 can include a tape roller 904. The tape applicator 900 can also include an edge guide or other mechanism to apply tape parallel to or along a desired edge or a path. Example apparatuses can further include processing circuitry and memory for data collection, and for communication with other edge devices, the cloud, or other processing systems remote or local to the tape applicator or downstream processes. Data collection can be applied to quality control processes.

The tape applicator 900 can be mounted to swivel in various degrees or planes of motion, for example, to apply tape on uneven surfaces or around corners. The tape applicator 900 can be designed with a mounting mechanism 906 for mounting to various handling systems. The tape applicator 900 can be configured to run either forward of the operator or in reverse.

For totally manual operations, the tape applicator 900 can be designed with one or more ergonomic handles 1012 for easy operation and guiding, and application of force to the tape. The tape applicator 900 can be operated with two separate handles for two-handed operation, e.g., one handle for tape guiding and the other handle for force application, as is further described herein. In addition, one or both of the ergonomic handles can be repositionable or adjustable to be customized for the operator or application.

In typical operations, the first step is to apply a double coated bonding tape to an article. Once applied, a liner of the tape is removed to attach a second article. In one or more embodiments, this second operation can require the second article to be attached/bonded to the tape with similar force and adhesive contact. Normally, the operator utilizes a second roller tool to apply force to the second article for bonding. For another improvement and advantage, this same tape applicator 900 can be designed with a roller and retractable tape applicator roll which allows the tape applicator to be used as a force applicator roll for the second step in a tape bonding operation. The operator will not only experience the convenience of one tool but will also gain the same ergonomic benefits of the two handles and the force monitoring sensors.

In some example embodiments, the tape applicator 900 can include a mechanism such as the handle 1012 for manual application of tape. In at least these embodiments, guides can be provided for tape alignment during tape application.

Figure 14:
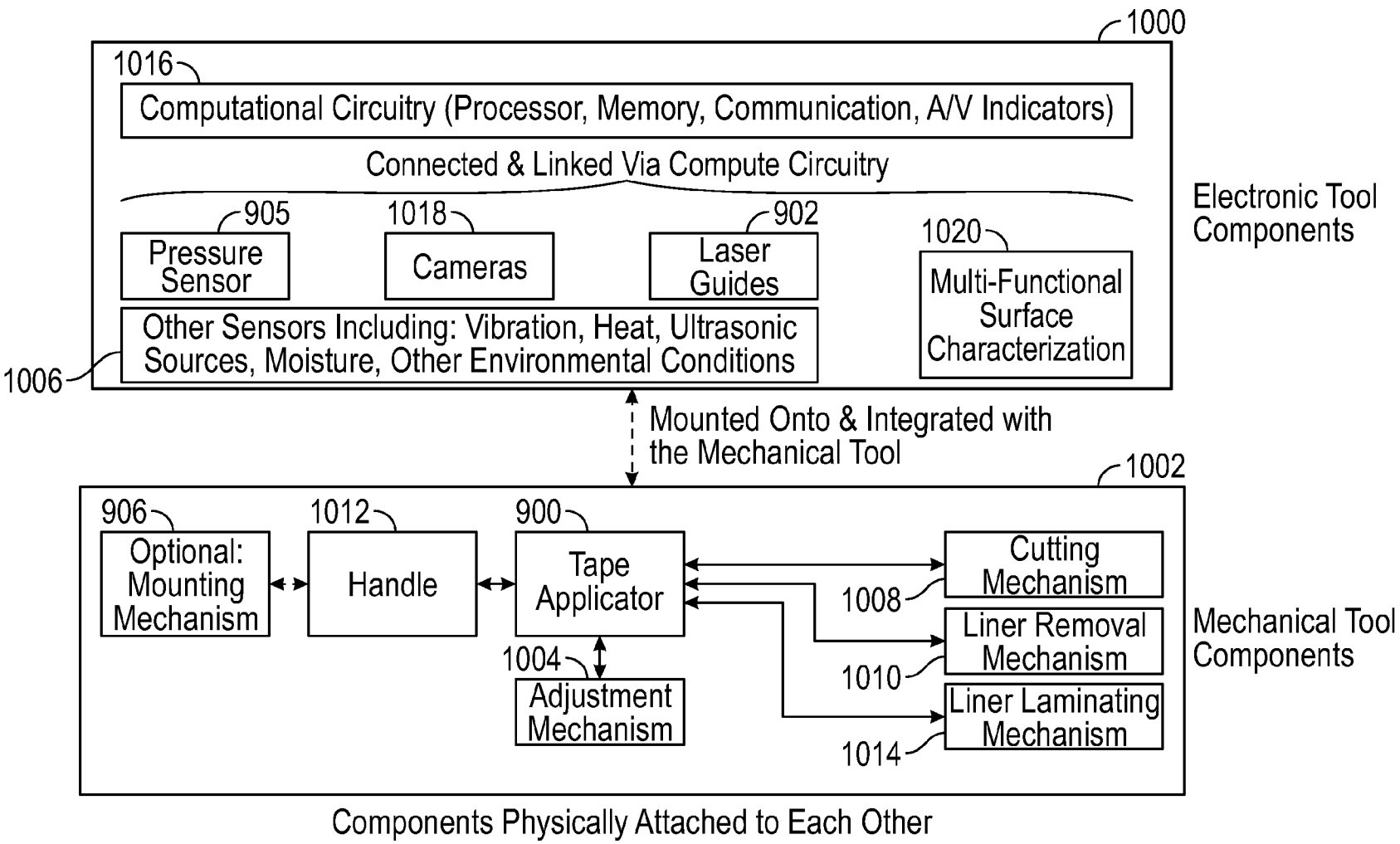
FIG. 14 illustrates one embodiment of further details of the tape applicator of FIG. 9.

FIG. 14 illustrates further details of the tape applicator 900 in accordance with some embodiments. Although described regarding hand tape applicator 900 of FIG. 13, the various elements and components described regarding FIG. 14 apply equally to hand tape applicator 2000 of FIGS. 26-27 and hand tape applicator 2100 of FIG. 28. As illustrated, the hand tape applicator 900 can include electronic tool components 1000 and mechanical tool components 1002.

Mechanical tool components 1002 can include a mounting mechanism 906. The mounting mechanism 906 can include a universal receiver that can be designed to mount to a robotics system or an X-Y-Z-R table or platform. The X-Y-Z-R table can hold a surface to be taped and rotate about multiple axes for tape application at varying angles (and in alternative embodiments, the tape applicator can be translated and rotated about the article). The tape applicator 900 can include adjustment mechanisms 1004 to adjust for different tape widths and lengths. Mechanical tool components 1002 can include actuators such as a cutting mechanism 1008 to separate a portion of the tape from the tape roll, liner removal mechanism 1010 to lift a corner of a tape liner for liner removal, force modifiers such as actuating cylinders to balance forces, as well as other elements such as ultrasonic horns, heaters, and other mechanisms designed to remediate tape application variability. Additionally, ergonomic handle 1012 can be added. The mechanical tool components 1002 can further include a laminator 1014 for laminating liners or other materials to the tape.

Electronic tool components 1000 can include sensors 1006 for detecting presence of tape, or for detecting vibration, heat, ultrasonic sources, presence of moisture, or other environmental factors and conditions. In one or more embodiments, the sensors 1006 can include a tape roller sensor that is configured to detect the number of revolutions of the tape roller as the hand tape applicator 900 applies tape to the substrate. Based upon the number of revolutions detected by the tape roller sensor (or other suitable techniques such as capacitance or use of a laser distance measurement system), the processor 1016 can determine a length of tape that has been applied to the substrate (i.e., the applied tape length). Alternatively, the rotation of other rollers in the applicator can be monitored to measure the length of tape applied.

Figure 19:
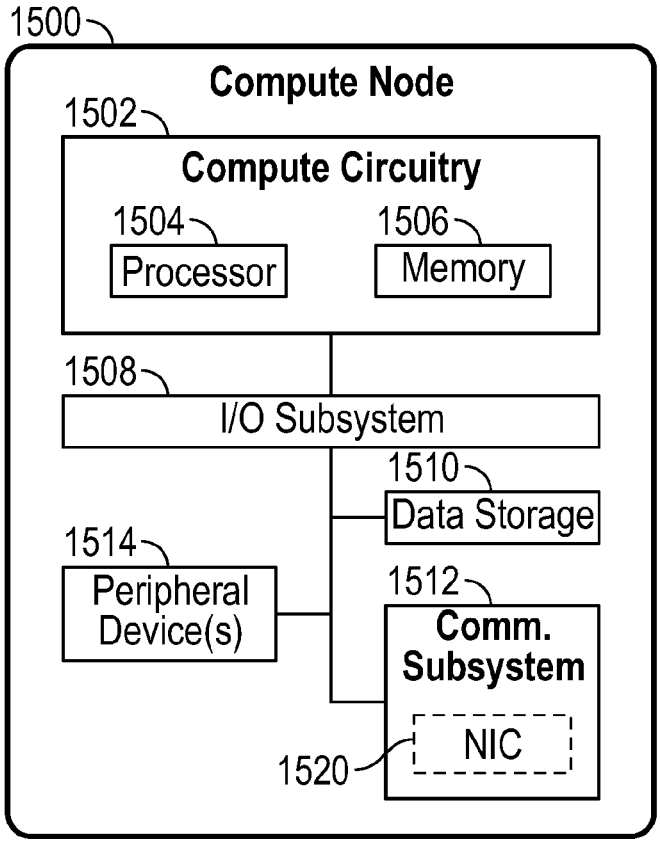
FIG. 19 depicts one embodiment of a computing node.
Figure 20:
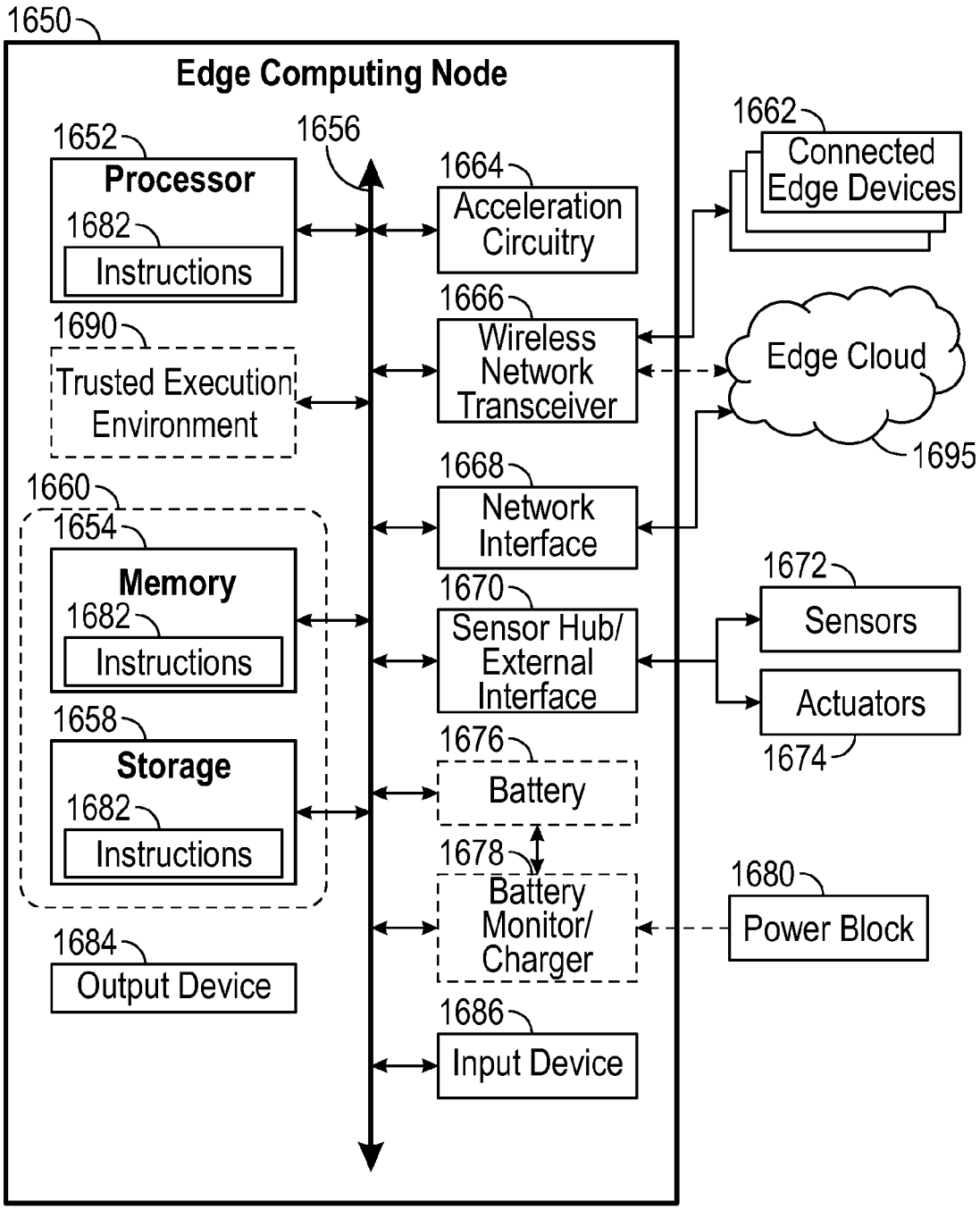
FIG. 20 depicts further details on edge computing node.

Electronic tool components 1000 can further include computational circuitry 1016 that can include components such as a processor, memory, communication circuitry, audio/visual indication circuitry as is described in more detail herein with respect to FIGS. 19-20. The computational circuitry 1016 can control various aspects and operations of the hand tape applicator 900 and provide communication to other systems and modules described with reference to FIGS. 5-6. Electronic tool components 1000 can further include imaging circuitry 1018 such as cameras, and components 1020 for implementing surface characterization, where the components 1020 can include or communicate with components of the multifunctional surface characterization module 104 (FIG. 5). Electronic tool components 1000 can be mounted onto and integrated with the hand tape applicator 900 or other components of the mechanical tool components 1002.

Figure 26:
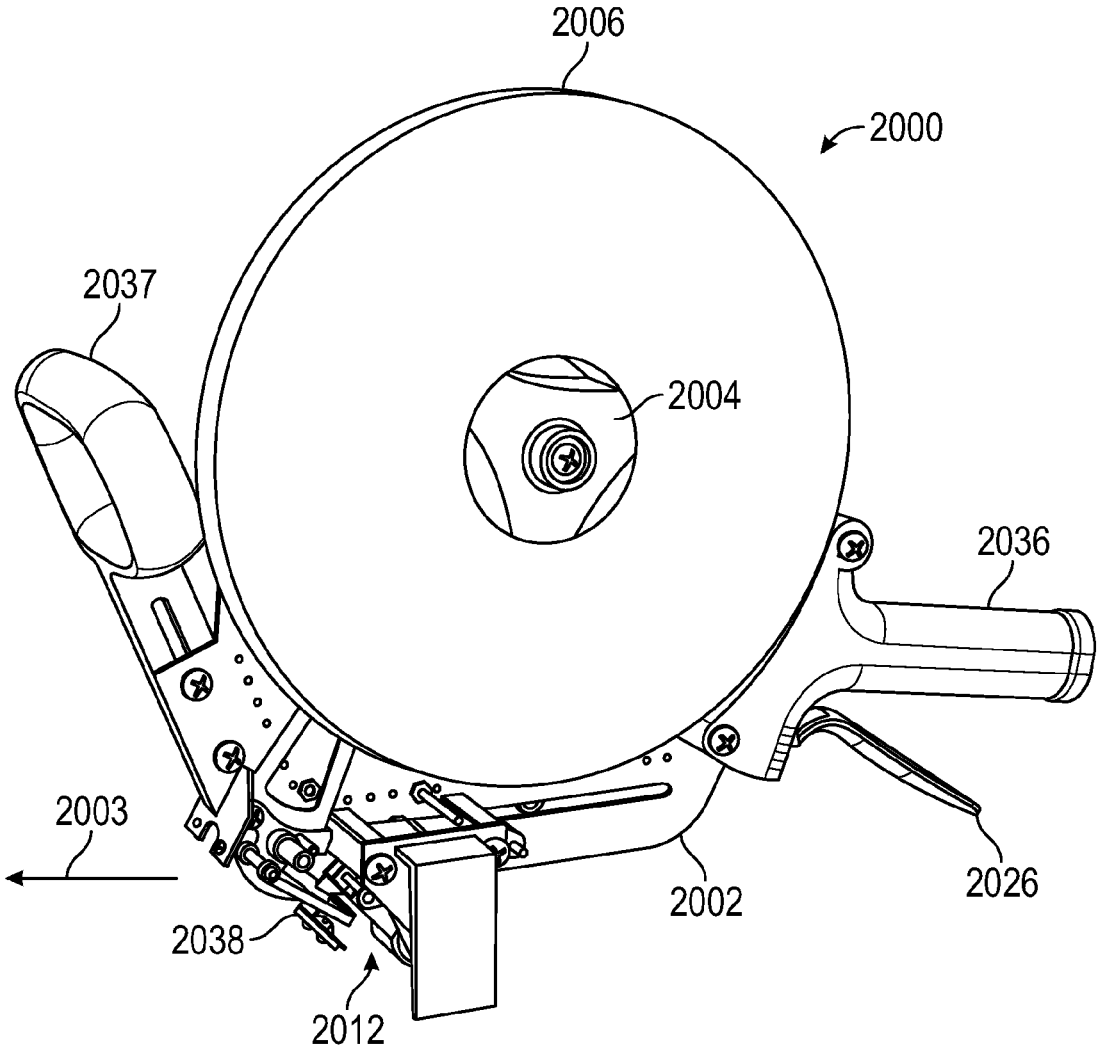
FIG. 26 is a schematic perspective view of another embodiment of a hand tape applicator.
Figure 27:
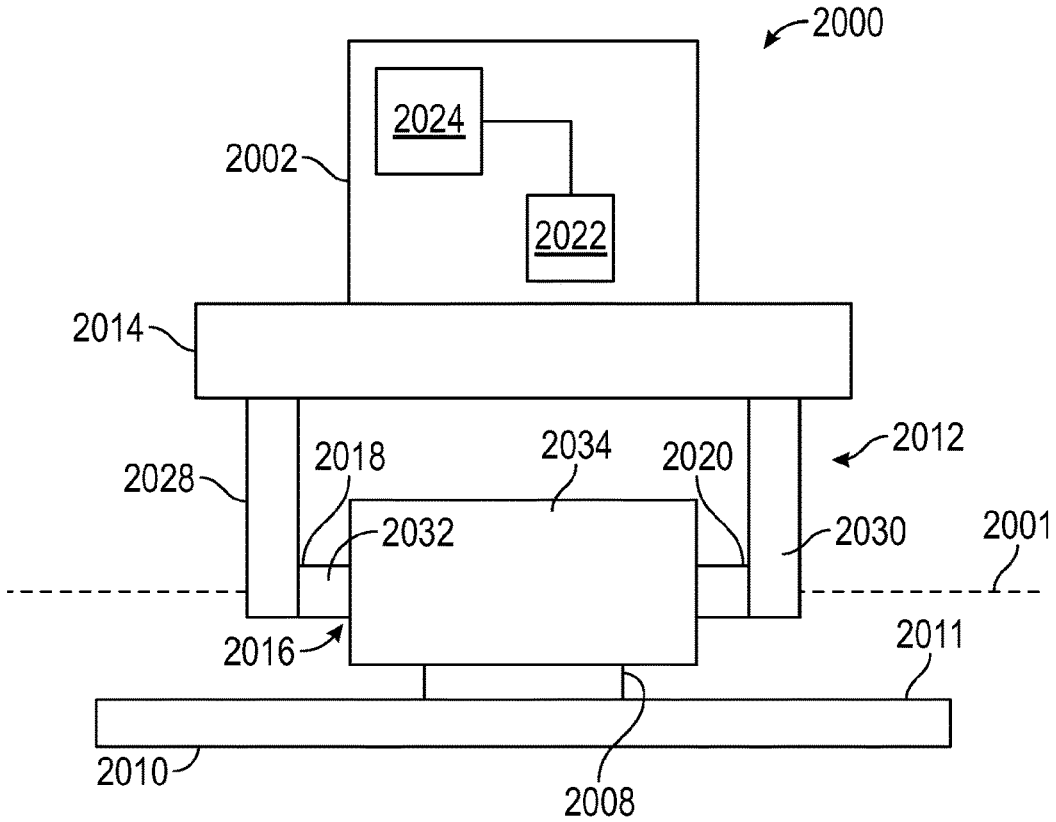
FIG. 27 is a schematic cross-section view of the hand tape applicator of FIG. 26.

FIGS. 26-27 are schematic perspective and cross-section views of another embodiment of a hand tape applicator 2000. All design considerations and possibilities described herein regarding the hand tape applicator 900 of FIGS. 13-14 apply equally to the hand tape applicator 2000 of FIGS. 24-25. For example, the tape applicator 2000 can include one or more elements of the mechanical tool components 1002 and the electronic tool components 1000 as described herein regarding FIG. 14.

The hand tape applicator 2000 includes a body 2002, a spindle 2004 connected to the body and configured to receive a tape roll 2006 that includes tape 2008, and an ergonomic handle 2036 connected to the body. The applicator 2000 also includes a roller mechanism 2012 connected to the body 2002 and configured to apply the tape 2008 to a substrate 2010. The roller mechanism 2012 includes a head 2014, and a tape roller 2016 extending along a roller axis 2001 between a first end 2018 and a second end 2020 of the tape roller. The tape roller 2016 is connected to the head 2014 at each of the first and second ends 2018, 2020. The applicator 2000 further includes a force sensor 2022 connected to the tape roller 2016 and the head 2014, where the force sensor is configured to detect a force between the tape roller and the head and provide a signal indicative of the force. The hand tape applicator 2000 can be configured to apply the tape 2008 to the substrate 2010 along any suitable direction. In one or more embodiments, the applicator 2000 is configured to apply tape along a direction 2003 away from the operator.

The body 2002 of the applicator 2000 can include any suitable material and take any suitable shape. Further, the spindle 2004 can be connected to the body 2002 using any suitable technique such that the spindle is configured to rotate in relation to the body. The spindle 2004 can be configured to receive the tape roll 2006 using any suitable technique. For example, the tape roll 2006 can be friction-fit onto the spindle or mechanically connected to the spindle. Any suitable tape roll 2006 and tape 2008 can be utilized with the applicator 2000, e.g., tape 2 of FIG. 1. Further, the tape 2008 can have any suitable dimensions. In one or more embodiments, the tape 2008 can have a width of at least 0.25 inches and no greater than 6 inches, but typically less than 2 inches.

Also connected to the body 2002 is the ergonomic handle 2036. As used herein, the phrase "ergonomic handle" means that the handle is perceived by an operator to be comfortable to grip, hold, guide, or carry. In one or more embodiments, the applicator can include a second handle 2037 also connected to the body 2002. Although depicted as including two handles 2036, 2037, the applicator 2000 can include any suitable number of handles connected to any suitable portion of the body 2002. Further, the handles 2036, 2037 can include any suitable handle, e.g., pistol grip, shovel, etc. In one or more embodiments, at least one of the handle 2036 or second handle 2037 is reconfigurable to accommodate different users, e.g., the handle can be repositionable on the body 2002 of the applicator 2000. Further, in one or more embodiments, at least one of the handle 2036 or second handle 2037 is also configured to connect the applicator 2000 to an automated tape application system, e.g., modular tape application system 100 of FIG. 5. In one or more embodiments, the handle 2036 (and/or the second handle 2037) can include an actuator 2026 for actuating a cutting mechanism 2038 that can be connected to the body 2002 as is further described herein. In one or more embodiments, the actuator 2026 can be an electric actuator that is configured to actuate the cutting mechanism 2038, or alternatively mechanically operated. In one or more embodiments, at least one of the handles 2036, 2037 is adjustably configured to allow the operator to apply force to the substrate 2010 with the tape applicator 2000. In one or more embodiments, at least one of the handles 2036, 2037 can be either removable, adjustable, or pivotable such that the handle can be in a storage position as shown in FIG. 26, where the second handle is in the storage position.

The roller mechanism 2012, which is also connected to the body 2002, is configured to apply the tape 2008 to the substrate 2010 as can be seen in FIG. 27. The head 2014 of the roller mechanism 2012 can take any suitable shape and be connected to the body 2002 using any suitable technique. Further, the head 2014 can be connected to the tape roller 2016 using any suitable technique. As shown in FIG. 27, the first end 2018 of the tape roller 2016 is connected to the head 2014 by a first connector 2028, and the second end 2020 of the tape roller is connected to the head by a second connector 2030. The first and second connectors 2028, 2030 can be connected to the roller 2016 such that the roller can rotate about the roller axis 2001 as the tape 2008 is applied to the substrate 2010.

The first and second connectors 2028, 2030 can include any suitable type of connector. In one or more embodiments, at least one of the first or second connectors 2028, 2030 can include at least one of a spring, hinge, shock absorber, or strut such that a force between the head 2014 and the tape roller 2016 can remain substantially constant as the tape 2008 is applied to the substrate 2010, i.e., maintain a substantially constant force. As used herein, the phrase "substantially constant force" means that the force between the head and the tape roller is no greater than about +/−50% of a target force, or more preferably +/−30% of a target force. In one or more embodiments, the first and second connectors 2028, 2030 can be configured to self-balance or level the tape roller 2016 with the substrate 2010 to maintain a relatively uniform force across a width of the tape 2008 as the tape is applied to the substrate. As used herein, the phrase "relatively uniform force" means that the differential force applied to the tape and substrate is no greater than about +/−30% across the width of the applied tape 2008, and more preferably no greater than about +/−15%. The target force can be input by the operator into the processor 2024. In one or more embodiments, the processor can be configured to determine the target force based on at least one of tape width, tape type, tape thickness, substrate surface condition, surface texture, or surface temperature with the goal of achieving at least 75% adhesive contact to the substrate surface, or more preferably approaching 85%, and most preferably a goal of 100% contact.

In one or more embodiments, the first connector 2028 can include a first actuator and the second connector 2030 can include a second actuator. In one or more embodiments, at least one of the first or second connectors 2028, 2030 can include an actuator in combination with at least one of a hinge, shock absorber, or strut. Each of the first and second actuators can include any suitable actuator that is adapted to adjust a force between the respective first and second ends 2018, 2020 of the tape roller 2016 and the head 2014, e.g., a linear actuator. In one or more embodiments, a processor 2024 of the hand tape applicator 2000 can be configured to independently actuate the first and second actuators to adjust the force between the head 2014 and each of the first and second ends 2018, 2020 of the tape roller 2016, i.e., the processor can control an actuator independent from the other. The processor 2024 can further be configured to direct the first and second actuators in an oscillating motion such that the tape roller 2016 oscillates or percusses while applying the tape 2008 to the substrate 2010. Such oscillations may improve wet out of the tape 2008 when it is applied to the substrate 2010. Further, such oscillations may also impart structure to a back surface of the tape 2008, which could assist with air bleed for secondary bonding applications performed on the tape.

The tape roller 2016 can include any suitable roller or rollers. In one or more embodiments, the tape roller 2016 includes an axle 2032 and a roller pad 2034 disposed on the axle. In one or more embodiments, the roller pad 2034 is integral with the axle 2032, i.e., manufactured as a single part. The axle 2032 is configured to be rotatably connected to the first and second connectors 2028, 2030. Further, the roller pad 2034 can include any suitable material, preferably an elastomeric material, e.g., rubber, polymer (e.g., an elastomeric material), foam, etc. In one or more embodiments, the exterior surface of roller pad 2034 can be conformable or include foam or foam-like properties to improve conformability of the tape roller 2016 with the substrate 2010. Further, the roller pad 2034 can take any suitable shape, e.g., a cylindrical shape. In one or more embodiments, the roller pad 2034 can take a circular shape in a plane orthogonal to the roller axis 2001. In one or more embodiments, the roller pad 2034 is compressible and can take a curved shape in a plane parallel to the roller axis and orthogonal to conform to a surface 2011 of the substrate 2010

Figure 28:
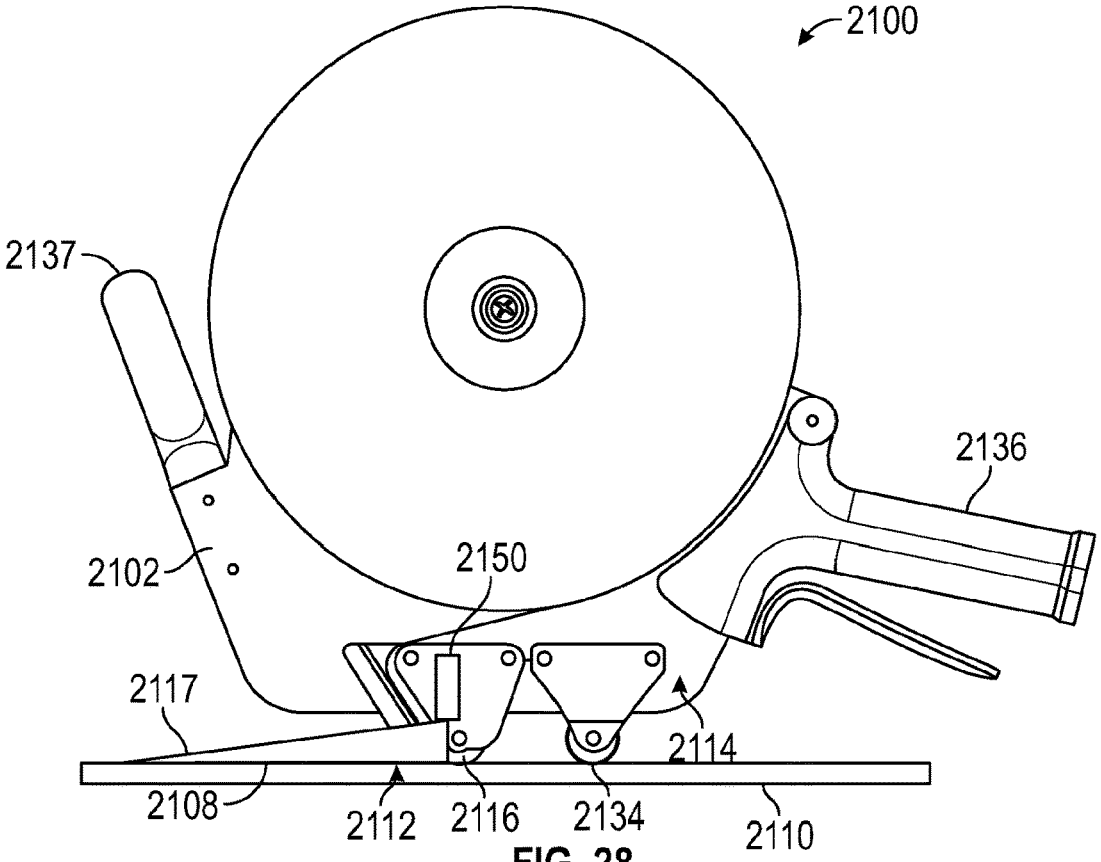
FIG. 28 is a schematic side view of another embodiment of a hand tape applicator.

The roller mechanism 2012 can include any suitable number of rollers. For example, FIG. 28 is a schematic side view of another embodiment of a hand tape applicator 2100. All design considerations and possibilities described herein regarding the hand tape applicator 2000 of FIGS. 26-27 apply equally to the hand tape applicator 2100 of FIG. 28. One difference between the hand tape applicator 2100 of FIG. 28 and the hand tape applicator 2000 of FIGS. 26-27 is that applicator 2100 includes a roller mechanism 2112 having a first tape roller 2116 and a second tape roller 2134, where each roller is connected to a head 2114. In the embodiment illustrated in FIG. 28, the first tape roller 2116 is configured to apply tape 2108 to a substrate 2110, and the second tape roller 2134 is configured to apply force to the tape after the tape has been applied to the substrate. In one or more embodiments, the first tape roller 2116 can be configured to apply force to the tape 2108 after the tape has been applied to the substrate 2110, and the second tape roller 2134 can be configured to apply the tape to the substrate. Further, in one or more embodiments, at least one of the first tape roller 2116 or the second tape roller 2134 can be removable or pivotable such that the respective tape roller does not contact the substrate 2110 or the tape 2108 that is been applied to the substrate.

Further, another difference between hand tape applicator 2100 and hand tape applicator 2000 is that applicator 2100 includes a laser guide 2150 that is configured to provide a direction that the tape 2108 is being applied to the substrate 2110. Although not illustrated in FIGS. 26-27, the hand tape applicator 2000 can also include a laser guide or guides. The laser guide 2150 can include any suitable laser or lasers. Further, the laser guide 2150 can be disposed in any suitable location or locations on at least one of the body 2012 or the roller mechanism 2112. In one or more embodiments, a laser of the laser guide 2150 can be disposed in front of the first roller 2116 such that the first roller is between the laser guide and the handle 2136. In one or more embodiments, the laser guide 2150 can include one or more additional lasers that can be disposed on sides of at least one of the body 2102 or the roller mechanism 2112 to provide lane markings or lines.

For example, in one or more embodiments, the laser guide 2150 can provide lane markings 2117 projected onto the substrate 2110 that aid the operator in applying the tape 2108 in at least one of a desired location or orientation on the substrate 2110. In one or more embodiments, the laser guide 2150 can project two lane markings 2117 onto the substrate 2110 in front of the first roller 2116 to indicate a desired direction that the tape 2108 will be applied. In one or more embodiments, circuitry (i.e., circuitry 1016 of FIG. 14) can provide feedback to the operator whether the tape 2108 is being applied within the lane lanes. Further, in one or more embodiments, the laser guide 2150 can indicate a starting point and a stopping point of the applied tape. In one or more embodiments, circuitry 1016 can control where the starting and stopping points are projected by the laser guide 2150 onto the substrate 2110.

Returning to FIGS. 26-27, the applicator 2000 also includes the force sensor 2022 that is connected to the head 2014. The force sensor 2022 is configured to detect the force between the tape roller 2016 and the head 2014 and provide the signal indicative of the force. The force sensor 2022 can include any suitable force sensor or sensors, e.g., force sensors, flexural beam-based sensors, piezoelectric, and others. In one or more embodiments, the force sensor 2022 includes a first sensor connected to the first end 2018 of the tape roller 2016 and a second sensor connected to the second end 2020 of the tape roller. The first sensor can be configured to detect a first force between the first end 2018 of the tape roller 2016 and the head 2014, and the second sensor can be configured to detect a force between the second end 2020 of the tape roller and the head. In one or more embodiments, the force sensor 2022 can be configured to determine a composite force between the tape roller 2016 and the head 2014 based upon the first force and the second force.

In one or more embodiments, the hand tape applicator 2000 can also include a processor 2024 that is configured to receive the signal from the force sensor 2022 and provide feedback to the operator regarding the force. Any suitable feedback can be provided to the operator, e.g., the feedback described herein provide by the force sensor 905 of the tape applicator 900 of FIGS. 13-14. The processor 2024 can also be configured to adjust the force between the tape roller 2016 and the head 2014 to provide a selected force or force per unit width applied to the tape 2008 as it is disposed onto the substrate 2010. Any suitable technique can be utilized by the processor 2024 to adjust the force between the tape roller 2016 and the head 2014. Further, a width of the tape 2008 being applied to the substrate 2010 can either be entered into the processor 2024 by the operator, or a sensor connected to the processor can be configured to detect the width of the tape 2008 being applied to the substrate 2010. Based upon the width of the tape 2008 and the force between the head 2014 and the tape roller 2016, the force per unit width can be calculated and adjusted by the processor 2024 using any suitable technique such that the force per unit width stays within a selected range. In one or more embodiments, the force per unit width can be at least about 3 lbs/in and no greater than about 50 lbs/in. In one or more embodiments, the surface characterization module 104 (FIG. 5) and the surface preparation module 112 are connected to the data acquisition equipment 208. The surface characterization module 1020 can be configured to characterize surface quality of the surface 2011 of the substrate 2011 prior to application of the input tape 2008. The force between the tape roller 2016 and the head 2014 of the hand tape applicator 2000 can be adjustable based upon the surface quality of the surface 2011 of the substrate 2010.

Further, the processor 2024 can be configured to log or map the force signal from the sensor 2022 in relation to a position along an applied tape length using any suitable technique. As used herein, the term "applied tape length" means a length of tape 2008 that has been applied to the surface 2011 of the substrate 2010. A map of the force signal along the applied tape length can be provided to the operator that indicates variations in force that has been applied to the tape 2008 as the tape has been disposed on the surface 2011 of the substrate 2010. For example, a 3D model of the substrate 2010 can be input into the circuitry 1016 (FIG. 14) along with a desired location where the tape 2008 will be disposed. The hand tape applicator 2000 can then sense the location using circuitry 1016 and distance traveled by the applicator utilizing a tape roller sensor as described herein. Such information can be utilized by the circuitry 1016 to provide a 3D representation of the tape application. The cutting mechanism 2038 can also be controlled by circuitry 1016 to automatically dispense a specified length of tape that has been provided to the process 2024 once the applicator 2000 has begun applying 2008 to the substrate 2010.

Figure 29:
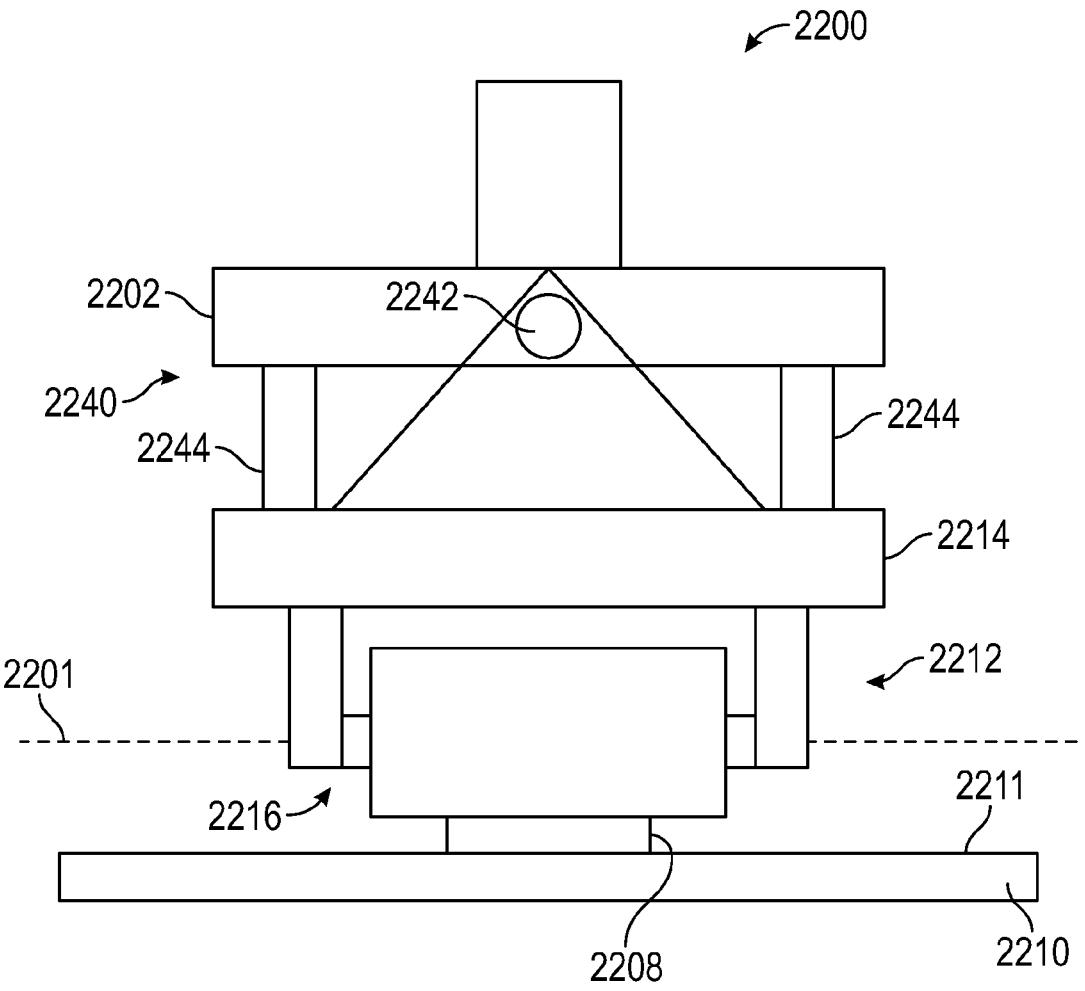
FIG. 29 is a schematic cross-section view of a portion of another embodiment of a hand tape applicator.

As mentioned herein, the roller mechanism 2012 can be connected to the body 2002 utilizing any suitable technique. For example, FIG. 29 is a schematic cross-section view of another embodiment of a hand tape applicator 2200. All design considerations and possibilities described herein regarding the tape applicator 2000 of FIGS. 26-27 and the tape applicator 2100 of FIG. 28 apply equally to the tape applicator 2200 of FIG. 29. One difference between tape applicator 2200 and tape applicators 2000 and 2100 is that applicator 2200 includes a pivoting mechanism 2240 that connects a head 2214 of a roller mechanism 2212 to a body 2202 of the applicator. The pivoting mechanism 2240 is configured to pivot a tape roller 2216 of the roller mechanism 2212 in relation to the body 2202 using any suitable technique, with preferably 5 degrees or less of pivoting.

The pivoting mechanism 2240 can include any suitable pivoting mechanism. As shown in FIG. 29, the pivoting mechanism 2240 includes a swivel 2242 that is connected to the body 2202 using any suitable technique. The pivoting mechanism 2240 can also include one or more connectors 2244 that connect the pivoting mechanism to the head 2214. The connectors 2244 can include any suitable connector, e.g., a spring or force cylinder, which allow the head 2214 to pivot in relation to the body 2202 and balance a force on each side of the tape roller 2216 irrespective of an angle between a roller axis 2201 and a surface 2211 of substrate 2210. Although not shown, the tape applicator 2200 can include one or more force sensors as described herein regarding force sensor 2022 of applicator 2000 of FIGS. 26-27.

Returning to FIGS. 26-27, the hand tape applicator 2000 can be in communication with the system 200 of FIGS. 5-6 and can load a profile of a particular adhesive or tape that is being applied to the substrate 2010. This profile can interact with the force sensor 2022 or other sensors connected to the applicator 2000 to determine how sensor data relates to the force being applied to the tape 2008. A user interface connected to the applicator 2000 can also receive other data such as substrate and tape dimensions to calculate a desired force needed to produce a target force on the tape 2008. Further, a centralized database connected to the applicator 2000 can provide traceability of the application process. For example, the surface characterization module 104 of FIG. 5 can log surface conditions, and the hand tape applicator 2000 can log application conditions. These logs can be combined and analyzed by the processor and provide product and process suggestions.

In general, the various components and modules of a tape application system described in this application as shown in FIGS. 9 and 14 are designed to improve common pain points experienced in a tape application process regardless the level of automation. Some components and modules such as the Surface Characterization Module can also solve pain points in the liquid structural adhesive process. These components and modules are designed to be smart and help the operators and supervisors control and improve those processes. In the lowest form, the processor for each of the components and modules can give the operator a signal such as a visual light, an audible signal, tactile response, etc., so that the operator knows that the process is drifting or is out of specification and to take corrective action. These alerts on the components, modules, and processes can be recorded and logged on a computer system to provide a record. They can also be sent to the supervisor in a convenient method such as an alert on a cell phone app with process-related information and at any level of detail. This information can be useful for operator training and taking preventive and corrective action on the various components, modules, and process. The processor can control and chart key data and notify the operator that the process is out of control or drifting. Based on Machine Learning and data analysis, the processor can automatically determine if the conditions are acceptable for either tape or liquid structural adhesive bonding based on past modelling and then determine what conditions/changes need to be made to ensure acceptable bonding conditions. For a high level automated system, the processor can determine the issue and automatically take corrective action to keep the product and process in control. At all levels, the processor can log data regarding the article, tape or liquid adhesive, date/time, lot, process conditions, etc., and results for a record for a Quality Assurance Department and for customer documentation and future issues.

Adhesive Prediction System

Embodiments can provide a predictive modeling tool that uses suitable analytical techniques such as a multivariate statistical approach and predictive model to drive iterative machine learning applications to predict performance or success of a tape or adhesive bond (e.g., a liquid adhesive). Performance of a tape or adhesive bond depends on the interaction between the tape or adhesive and the substrate of the article. The adhesive behavior can be characterized based on chemistry of the adhesive and other properties; however, substrate nature can vary based on factors such as surface composition, finish, bulk polymer additives, surface treatments such as coronas, primers, etc., aging, storage conditions, and other factors. Some of these other factors can be determined by the surface characterization module 500 (FIG. 9). Embodiments described herein are directed to predicting adhesive performance based on collected data regarding the adhesive, the substrate, and any processes for joining the two.

This prediction can be used to determine remedial actions to take to improve performance. In these and other examples, observed performance data can be iteratively fed back to the machine learning applications for improving future predictions, for quality control, and for other applications.

Embodiments provide an improvement over other modeling and quality control applications by not relying on manual operator input and analysis of data. Embodiments can also provide for computerized development of equations that represent the tape application process and surface characterization of tapes, adhesives, and substrates, and for machine learning of new and additional aspects not previously considered by operators.

Figure 15:
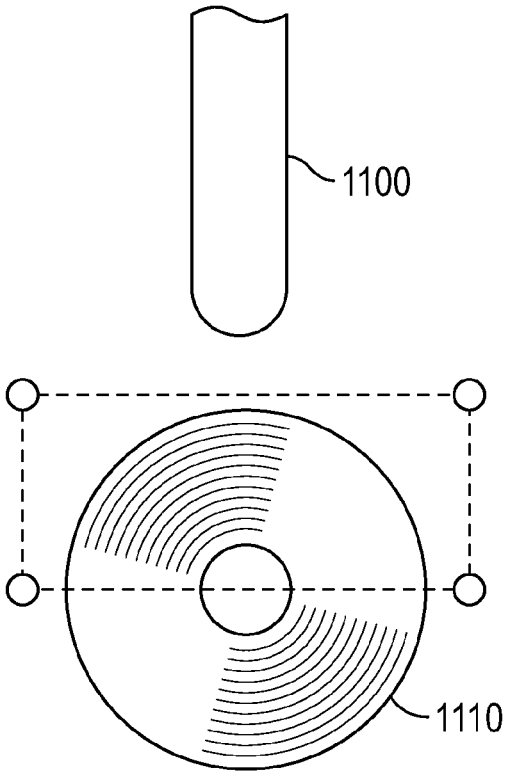
FIG. 15 illustrates one embodiment of a handheld device that estimates the wettability of the surface of a substrate using a liquid droplet.

Instruments are used to collect data regarding the substrate. These instruments include those described above with reference to the surface characterization module 500 (FIG. 9), for example instruments for detecting fluid contact angle (such as water contact angle) to help determine or estimate surface energy, surface roughness, and topographic properties of the substrate, tape, or adhesive. The surface energy of a surface is a parameter that affects the performance of an adhesive/substrate. For example, FIG. 15 illustrates a handheld device 1100 that measures the surface free energy of a surface of a substrate 1110. The device of FIG. 15 uses a liquid droplet on a solid surface to measure the fluid contact angle.

Figure 16:
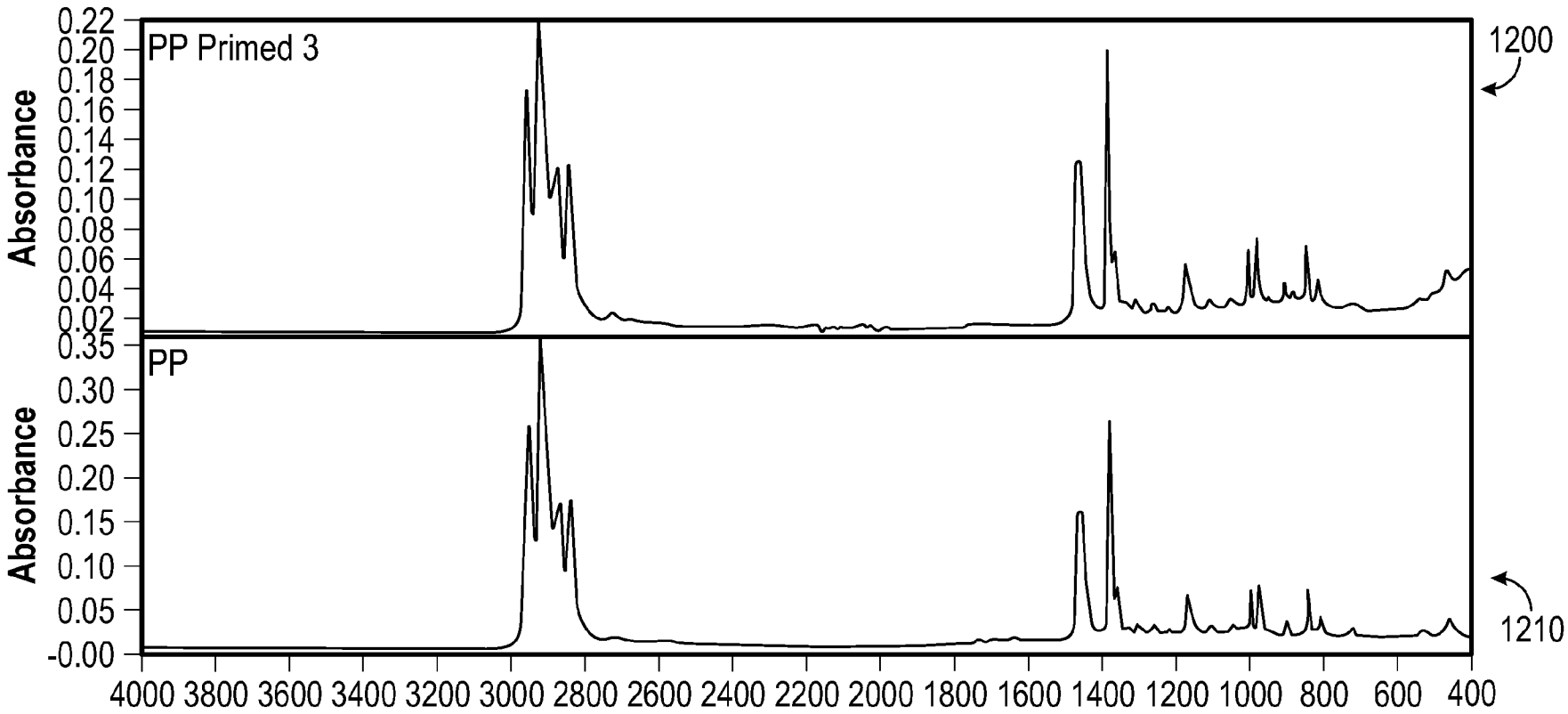
FIG. 16 illustrates the FTIR spectra of two polypropylene samples.

A second set of data, such as Fourier Transform Infrared (FTIR) spectroscopy also may be used to measure parameters of at least one of an adhesive or substrate in sample embodiments as FTIR spectroscopy is well suited to determine the identity of a polymeric material. FTIR spectroscopy is a technique used to obtain a far-infrared spectrum of absorption or emission of a solid, liquid, or gas by measuring how much light a sample absorbs at each wavelength. In one or more embodiments, an FTIR spectrometer simultaneously collects high-spectral-resolution data over a wide spectral range by pressing a sample against a diamond crystal to collect absorption data. For example, FIG. 16 illustrates the FTIR spectra 1200 and 1210 of two polypropylene samples. In FTIR spectroscopy, a Fourier transform is used to convert the raw data into the actual spectrum of the type illustrated in FIG. 16. As described in the multifunctional characterization section, many other techniques can be employed to get the second data point(s) such as electromagnetic or acoustic spectra or portions thereof, or to capture an array that includes multiple data point(s), using direct contact or non-contact methods.

Techniques such as multivariate analysis or machine learning can be used to understand how different factors and variables can influence each other, and embodiments to understand how different properties and variables related to adhesive, substrate, and tape application processes can influence the quality of an adhesive bond. In examples, partial least square (PLS) techniques are used to construct predictive models of adhesive performance due to the suitability of PLS to data originating from analytical instruments often used in adhesive applications (e.g., FTIR instruments, NMR instruments, etc.). However, embodiments are not limited to PLS techniques for multivariate analysis.

PLS regression is a statistical method that finds a linear regression model by projecting the predicted variables and the observable variables to a new space. PLS is used to find the fundamental relations between two matrices (X and Y), i.e., a latent variable approach to modeling the covariance structures in these two spaces. The PLS model tries to find the multidimensional direction in the X space that explains the maximum multidimensional variance direction in the Y space. PLS regression is particularly suited when the matrix of predictors has more variables than observations, and when there is multicollinearity among X values.

Figure 17:
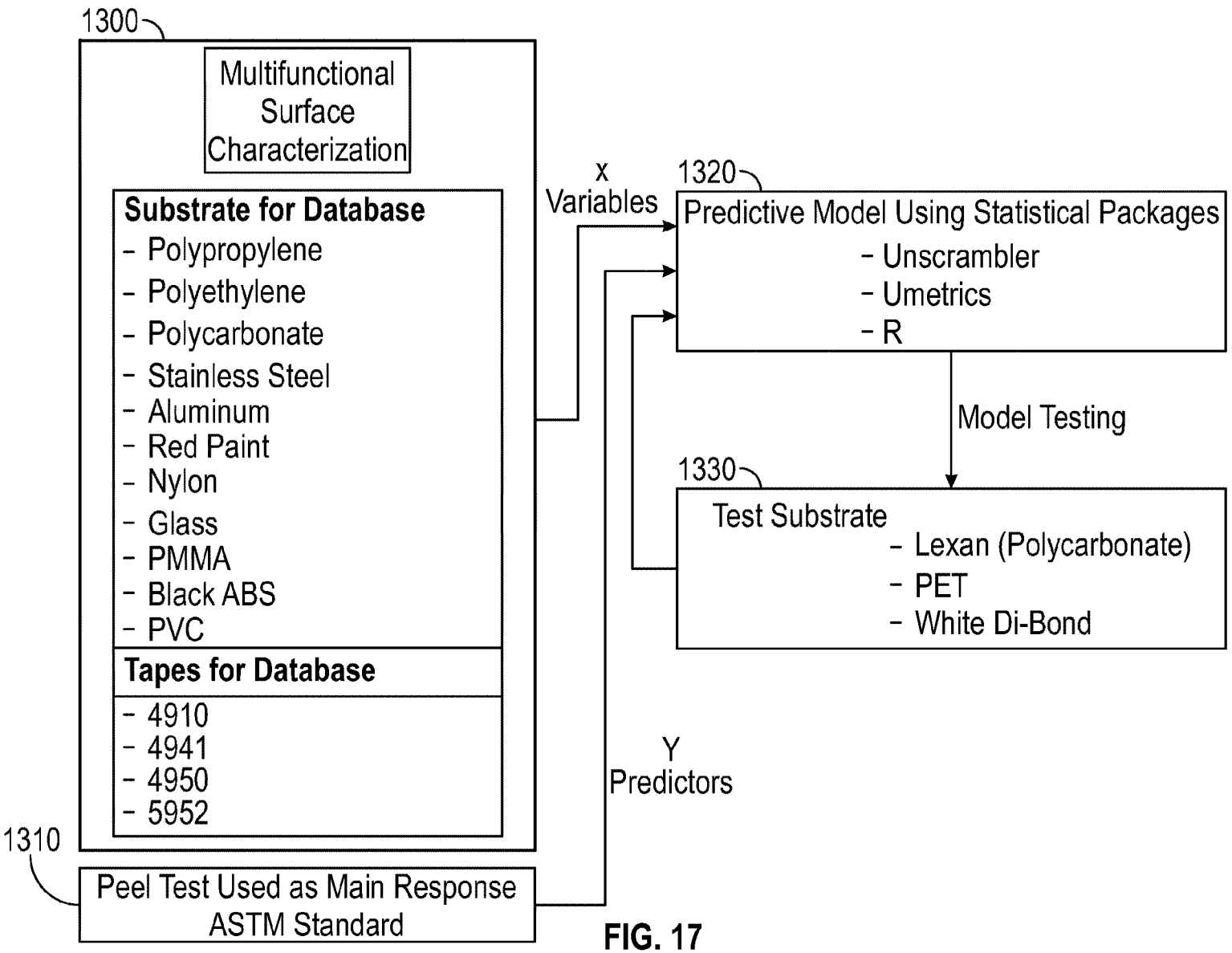
FIG. 17 illustrates one embodiment of a process for multivariate analysis or machine learning to predict performance of a tape and substrate.

Multivariate analysis can be performed in any of the systems (e.g., edge computing system, central processor, or other system) as described herein with reference to FIGS. 19 and 20. In examples, therefore, a non-transitory computer-readable medium can include instructions that, when implemented on a processor cause the processor to perform multivariate analysis and prediction of substrate/tape or substrate/adhesive performance. An overview of such a process can be seen in FIG. 17.

As illustrated, the X-variables representing the substrate parameters are collected using a variety of measurement techniques such as FTIR spectroscopy or other surface characterization methods to create a database 1300 including the parameters for respective substrates such as polypropylene, polyethylene, polycarbonate, stainless steel, aluminum, red paint, nylon, glass, polymethylmethacrylate (PMMA), black acrylonitrile butadiene styrene (ABS), polyvinylchloride (PVC), etc. and for respective adhesive products such as adhesive tapes (e.g., by part number). X-variables can further include data or information provided by the multifunctional surface characterization module 104 as described earlier herein. The Y-variables may be collected, for example, by performing peel tests (e.g., a Peel Adhesion test based on ASTM D3330) at 1310 to establish a main response for the adhesive tape on the respective substrates. This type of analysis may be used to create a predictive model at 1320 using statistical packages such as Unscrambler®, available from Aspen Technology Company of Montclair, New Jersey, USA, Umetrics®, available from Sartorius of Gottingen, Germany, and R, a free software environment for statistical computing and graphics, downloadable at https://cran.r-project.org, based on a set of variables that influence measurable output parameters. For example, the performance of the tape/substrate or adhesive/substrate combination evaluated using the standard ASTM D3330 90° Peel Adhesion Test may be used as the main response. The resulting output variables may include predictions of performance of an adhesive bond. The two surfaces of interest are analyzed using the chosen techniques (surface energy and FTIR spectroscopy) and used as variables in the statistical packages to create the predictive model 1320. The predictive model 1320 is then tested by testing the substrate at 1330, and the process is iterated using additional samples to improve the predictive model 1320 as an iterative process over time.

Other predictors can be used depending on a particular application. For example, predictors can include predictors of failure modes. In general, adhesion will most be found to fail at lamination, where depending on the strength of the bond, the two materials being bonded (e.g., the adhesive and substrate) may split. Results of any testing can be fed back in a feedback loop for improvement of the predictive model.

Operations can further include generating a recommendation for remedial action of the tape application process for a specific substrate tape. Additionally, operations can include outputting at least one of the input variables or any other parameter of the predictive model, testing systems, or simulation of a taping application based on any of the input variables or testing systems or predictive model.

Based on the input tape, substrate, and measured surface characteristics and input parameters, the multi-variate analysis predicts the adhesive performance such a peel adhesion. Based on the model, the system takes remedial action to maximize and maintain adhesive performance. For example, the maximum adhesive performance for a double coated foam tape is achieved when the peel failure mode is a foam split failure. The system takes correction actions and adjustments to maintain the adhesion value above the value needed for a foam split failure mode. Remedial action can include activating the solvent cleaning process, abrading the surface, plasma treating the surface, adding primer to the surface, etc.

Input variables can indicate a substrate type. For example, input variables can include indicators for at least one of polypropylene, polyethylene, polycarbonate, stainless steel, aluminum, paint, nylon, and glass. Input variables can also indicate a tape or adhesive type. The tape can include a pressure sensitive adhesive (although embodiments are not limited thereto) with or without additional adhesive or non-adhesive layers. Databases can be used to store information regarding standard substrates and tape types. Input variables can include at least one of adhesive physical characteristics, adhesive thermal characteristics, adhesive electrical characteristics, adhesive curing characteristics, adhesive performance characteristics, adhesive durability characteristics, adhesive chemical resistance characteristics, adhesive rheological characteristics, adhesive viscosity, adhesive setting time, adhesive modulus of elasticity, adhesive solvent resistance, adhesive composition, adhesive dispensing characteristics, adhesive use requirements, standardized tests or certifications, environmental parameters, backing characteristics, and liner characteristics.

Figure 18:
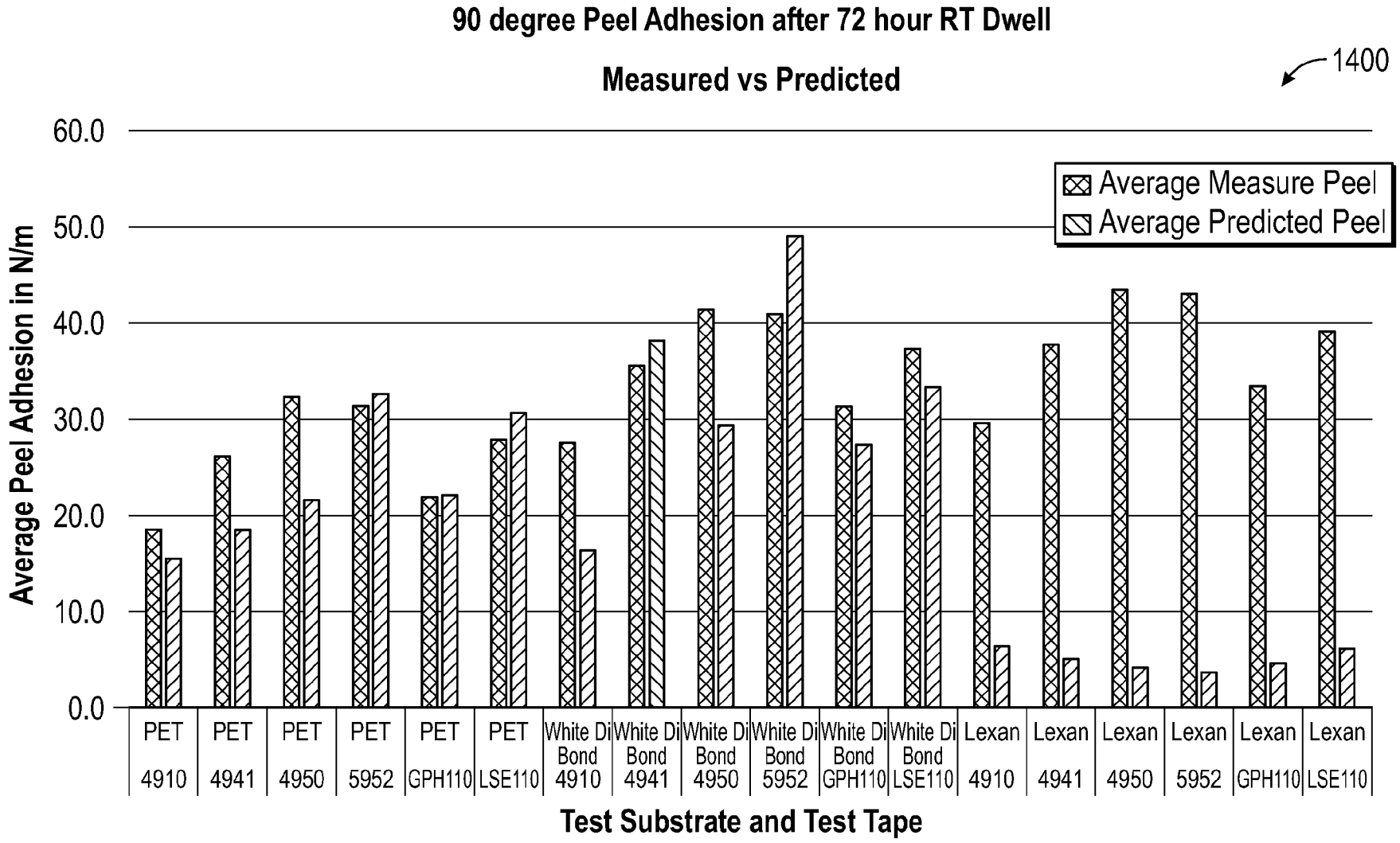
FIG. 18 is a chart illustrating the average measured peel adhesion value versus the average predicted peel adhesion value for a variety of substrate/adhesive combinations.

FIG. 18 is a chart illustrating the average measured peel value versus the average predicted peel value for a variety of substrate/adhesive combinations. As illustrated, the predictive model was fairly accurate using the developed dataset. However, the Lexan samples 1400 show that the predictive model was confused by a thin layer with a lower surface energy causing a different contact angle much different than what was expected. Such inaccuracy in the predictive model may be improved over time by using more samples to build the predictive model.

Computer Apparatuses

The apparatuses and circuitry of the surface characterization module 104, tape splicing module 108, extended liner module 110, and tape applicator module 120 (FIG. 5 and FIG. 6), as well as components of the computational circuitry 230 and data acquisition equipment 208 (FIG. 6), can be executed or partially executed on computing systems, for example edge computing nodes. FIG. 19 depicts an edge computing node in accordance with some embodiments.

In the simplified example depicted in FIG. 19, an edge compute node 1500 includes a compute engine (also referred to herein as "compute circuitry") 1502, an input/output (I/O) subsystem 1508, data storage device 1510, a communication circuitry subsystem 1512, and, optionally, one or more peripheral devices 1514. In other examples, respective compute devices may include other or additional components, such as those typically found in a computer (e.g., a display, peripheral devices, etc.). Additionally, in some examples, one or more of the illustrative components may be incorporated in, or otherwise form a portion of, another component.

The compute node 1500 may be embodied as any type of engine, device, or collection of devices capable of performing various compute functions. In some examples, the compute node 1500 may be embodied as a single device such as an integrated circuit, an embedded system, a field-programmable gate array (FPGA), a system-on-a-chip (SOC), or other integrated system or device. In the illustrative example, the compute node 1500 includes or is embodied as a processor 1504 and a memory 1506. The processor 1504 may be embodied as any type of processor capable of performing the functions described herein (e.g., executing an application). For example, the processor 1504 may be embodied as a multi-core processor(s), a microcontroller, or other processor or processing/controlling circuit. In some examples, the processor 1504 may be embodied as, include, or be coupled to an FPGA, an application specific integrated circuit (ASIC), reconfigurable hardware or hardware circuitry, or other specialized hardware to facilitate performance of the functions described herein.

The memory 1506 may be embodied as any type of volatile (e.g., dynamic random-access memory (DRAM), etc.) or non-volatile memory or data storage capable of performing the functions described herein. Volatile memory may be a storage medium that requires power to maintain the state of data stored by the medium. Non-limiting examples of volatile memory may include various types of random-access memory (RAM), such as DRAM or static random-access memory (SRAM). One particular type of DRAM that may be used in a memory module is synchronous dynamic random-access memory (SDRAM).

In an example, the memory device is a block addressable memory device, such as those based on NAND or NOR technologies. In some examples, all or a portion of the memory 1506 may be integrated into the processor 1504. The memory 1506 may store various software and data used during operation such as one or more applications, data operated on by the application(s), libraries, and drivers.

The compute circuitry 1502 is communicatively coupled to other components of the compute node 1500 via the I/O subsystem 1508, which may be embodied as circuitry or components to facilitate input/output operations with the compute circuitry 1502 (e.g., with the processor 1504 or the main memory 1506) and other components of the compute circuitry 1502. For example, the I/O subsystem 1508 may be embodied as, or otherwise include, memory controller hubs, input/output control hubs, integrated sensor hubs, firmware devices, communication links (e.g., point-to-point links, bus links, wires, cables, light guides, printed circuit board traces, etc.), or other components and subsystems to facilitate the input/output operations. In some examples, the I/O subsystem 1508 may form a portion of a system-on-a-chip (SoC) and be incorporated, along with one or more of the processor 1504, the memory 1506, and other components of the compute circuitry 1502, into the compute circuitry 1502.

The one or more illustrative data storage devices 1510 may be embodied as any type of devices configured for short-term or long-term storage of data such as, for example, memory devices and circuits, memory cards, hard disk drives, solid-state drives, or other data storage devices. Individual data storage devices 1510 may include a system partition that stores data and firmware code for the data storage device 1510. Individual data storage devices 1510 may also include one or more operating system partitions that store data files and executables for operating systems depending on, for example, the type of compute node 1500.

The communication circuitry 1512 may be embodied as any communication circuit, device, or collection thereof, capable of enabling communications over a network between the compute circuitry 1502 and another compute device (e.g., an edge gateway of an implementing edge computing system). The communication circuitry 1512 may be configured to use any one or more communication technology (e.g., wired or wireless communications) and associated protocols (e.g., a cellular networking protocol such a 3GPP 4G or 5G standard, a wireless local area network protocol such as IEEE 802.11/Wi-Fi®, a wireless wide area network protocol, Ethernet, Bluetooth®, Bluetooth Low Energy, a IoT protocol such as IEEE 802.15.4 or ZigBee®, low-power wide-area network (LPWAN), ultra-wide-band or low-power wide-area (LPWA) protocols, etc.) to effect such communication.

The illustrative communication circuitry 1512 includes a network interface controller (NIC) 1520. The NIC 1520 may be embodied as one or more add-in-boards, daughter cards, network interface cards, controller chips, chipsets, or other devices that may be used by the compute node 1500 to connect with another compute device (e.g., an edge gateway node). In some examples, the NIC 1520 may be embodied as part of a system-on-a-chip (SoC) that includes one or more processors or included on a multichip package that also contains one or more processors. In some examples, the NIC 1520 may include a local processor (not shown) or a local memory (not shown) that are both local to the NIC 1520. In such examples, the local processor of the NIC 1520 may be capable of performing one or more of the functions of the compute circuitry 1502 described herein. Additionally, or alternatively, in such examples, the local memory of the NIC 1520 may be integrated into one or more components of the client compute node at the board level, socket level, chip level, or other levels.

Additionally, in some examples, a respective compute node 1500 may include one or more peripheral devices 1514. Such peripheral devices 1514 may include any type of peripheral device found in a compute device or server such as audio input devices, a display, other input/output devices, interface devices, or other peripheral devices, depending on the particular type of the compute node 1500. In further examples, the compute node 1500 may be embodied by a respective edge compute node (whether a client, gateway, or aggregation node) in an edge computing system or like forms of appliances, computers, subsystems, circuitry, or other components.

In a more detailed example, FIG. 20 illustrates a block diagram of an example of components that may be present in an edge computing node 1650 for implementing the techniques (e.g., operations, processes, methods, and methodologies) described herein. This edge computing node 1650 provides a closer view of the respective components of node 1500 when implemented as or as part of a computing device (e.g., as a computer, a mobile device, a server, a smart sensor, a control system, etc.). The edge computing node 1650 may include any combinations of the hardware or logical components referenced herein, and it may include or couple with any device usable with an edge communication network or a combination of such networks. The components may be implemented as integrated circuits (ICs), portions thereof, discrete electronic devices, or other modules, instruction sets, programmable logic or algorithms, hardware, hardware accelerators, software, firmware, or a combination thereof adapted in the edge computing node 1650, or as components otherwise incorporated within a chassis of a larger system.

The edge computing node 1650 may include processing circuitry in the form of a processor 1652, which may be a microprocessor, a multi-core processor, a multithreaded processor, an ultra-low voltage processor, an embedded processor, or other known processing elements. The processor 1652 may be a part of a system on a chip (SoC) in which the processor 1652 and other components are formed into a single integrated circuit, or a single package. The processor 1652 and accompanying circuitry may be provided in a single socket form factor, multiple socket form factor, or a variety of other formats, including in limited hardware configurations or configurations that include fewer than all elements shown in FIG. 20.

The processor 1652 may communicate with a system memory 1654 over an interconnect 1656 (e.g., a bus). Any number of memory devices may be used to provide for a given amount of system memory. As examples, the memory 1654 may be random access memory (RAM) in accordance with a Joint Electron Devices Engineering Council (JEDEC) design. In various implementations, the individual memory devices may be of any number of different package types such as single die package (SDP), dual die package (DDP) or quad die package (Q17P). These devices, in some examples, may be directly soldered onto a motherboard to provide a lower profile solution, while in other examples the devices are configured as one or more memory modules that in turn couple to the motherboard by a given connector. Any number of other memory implementations may be used, such as other types of memory modules, e.g., dual inline memory modules (DIMMs) of different varieties including but not limited to microDIMMs or MiniDIMMs.

To provide for persistent storage of information such as data, applications, operating systems and so forth, a storage 1658 may also couple to the processor 1652 via the interconnect 1656. In an example, the storage 1658 may be implemented via a solid-state disk drive (SSDD). Other devices that may be used for the storage 1658 include flash memory cards, such as Secure Digital (SD) cards, microSD cards, eXtreme Digital (XD) picture cards, and the like, and Universal Serial Bus (USB) flash drives.

The components may communicate over the interconnect 1656. The interconnect 1656 may include any number of technologies, including industry standard architecture (ISA), extended ISA (EISA), peripheral component interconnect (PCI), peripheral component interconnect extended (PCIx), PCI express (PCIe), or any number of other technologies. The interconnect 1656 may be a proprietary bus, for example, used in an SoC based system. Other bus systems may be included, such as an Inter-Integrated Circuit (I2C) interface, a Serial Peripheral Interface (SPI) interface, point to point interfaces, proprietary busses, and a power bus, among others.

The interconnect 1656 may couple the processor 1652 to a transceiver 1666, for communications with the connected edge devices 1662. The connected edge devices 1662 can include other elements or portions of other elements depicted in FIG. 20, or other elements of manufacturing systems in use by the operator, either remotely or locally to tape automation systems. The transceiver 1666 may use any number of frequencies and protocols, such as 2.4 Gigahertz (GHz) transmissions under the IEEE 802.15.4 standard, using the Bluetooth® low energy (BLE) standard, as defined by the Bluetooth® Special Interest Group, or the ZigBee® standard, among others. Any number of radios, configured for a particular wireless communication protocol, may be used for the connections to the connected edge devices 1662. For example, a wireless local area network (WLAN) unit may be used to implement Wi-Fi® communications in accordance with the Institute of Electrical and Electronics Engineers (IEEE) 802.11 standard. In addition, wireless wide area communications, e.g., according to a cellular or other wireless wide area protocol, may occur via a wireless wide area network (WWAN) unit.

The wireless network transceiver 1666 (or multiple transceivers) may communicate using multiple standards or radios for communications at a different range. For example, the edge computing node 1650 may communicate with close devices, e.g., within about 10 meters, using a local transceiver based on Bluetooth Low Energy (BLE), or another low power radio, to save power. More distant connected edge devices 1662, e.g., within about 50 meters, may be reached over ZigBee® or other intermediate power radios. Both communications techniques may take place over a single radio at different power levels or may take place over separate transceivers, for example, a local transceiver using BLE and a separate mesh transceiver using ZigBee®.

A wireless network transceiver 1666 (e.g., a radio transceiver) may be included to communicate with devices or services in the edge cloud 1695 via local or wide area network protocols. The wireless network transceiver 1666 may be a low-power wide-area (LPWA) transceiver that follows the IEEE 802.15.4, or IEEE 802.15.4g standards, among others. The edge computing node 1650 may communicate over a wide area using LoRaWAN™ (Long Range Wide Area Network) developed by Semtech and the LoRa Alliance. The techniques described herein are not limited to these technologies but may be used with any number of other cloud transceivers that implement long range, low bandwidth communications, such as Sigfox, and other technologies. Further, other communications techniques, such as time-slotted channel hopping, described in the IEEE 802.15.4e specification may be used.

Any number of other radio communications and protocols may be used in addition to the systems mentioned for the wireless network transceiver 1666, as described herein. For example, the transceiver 1666 may include a cellular transceiver that uses spread spectrum (SPA/SAS) communications for implementing high-speed communications. Further, any number of other protocols may be used, such as Wi-Fi® networks for medium speed communications and provision of network communications. The transceiver 1666 may include radios that are compatible with any number of 3GPP (Third Generation Partnership Project) specifications, such as Long-Term Evolution (LTE) and 5th Generation (5G) communication systems. A network interface controller (NIC) 1668 may be included to provide a wired communication to nodes of the edge cloud 1695 or to other devices, such as the connected edge devices 1662 (e.g., operating in a mesh). The wired communication may provide an Ethernet connection or may be based on other types of networks, such as Controller Area Network (CAN), Local Interconnect Network (LIN), DeviceNet, ControlNet, Data Highway+, PROFIBUS, or PROFINET, among many others. An additional NIC 1668 may be included to enable connecting to a second network, for example, a first NIC 1668 providing communications to the cloud over Ethernet, and a second NIC 1668 providing communications to other devices over another type of network. Ultra-wideband sensors and emitters may be used to facilitate precise positioning of tape relative to defined emitter beacons, as well as communications such as data transfer.

Given the variety of types of applicable communications from the device to another component or network, applicable communications circuitry used by the device may include or be embodied by any one or more of components 1664, 1666, 1668 or 1670. Accordingly, in various examples, applicable means for communicating (e.g., receiving, transmitting, etc.) may be embodied by such communications circuitry.

The edge computing node 1650 may include or be coupled to acceleration circuitry 1664, which may be embodied by one or more artificial intelligence (AI) accelerators, a neural compute stick, neuromorphic hardware, an FPGA, an arrangement of GPUs, an arrangement of data processing units (DPUs) or Infrastructure Processing Units (IPUs), one or more SoCs, one or more CPUs, one or more digital signal processors, dedicated ASICs, or other forms of specialized processors or circuitry designed to accomplish one or more specialized tasks. These tasks may include AI processing (including machine learning, training, inferencing, and classification operations), visual data processing, network data processing, object detection, rule analysis, or the like.

The interconnect 1656 may couple the processor 1652 to a sensor hub or external interface 1670 that is used to connect additional devices or subsystems. The devices may include sensors 1672, such as accelerometers, level sensors, flow sensors, optical light sensors, camera sensors, temperature sensors or gauges, global navigation system (e.g., GPS) sensors, force sensors, barometric force sensors, any sensors for detecting conditions of tapes or other adhesives, primers, substrates, and the like. These sensors may be directly connected to the computing device or remotely located as part of various manufacturing modules. The hub or interface 1670 further may be used to connect the edge computing node 1650 to actuators 1674, such as power switches, valve actuators, an audible sound generator, a visual warning device, and the like. These actuators may be directly connected to the computing device or remotely located as part of various manufacturing modules.

In some optional examples, various input/output (I/O) devices may be present within or connected to, the edge computing node 1650. For example, a display or other output device 1684 may be included to show information, such as sensor readings or actuator position. An input device 1686, such as a touch screen or keypad may be included to accept input. An output device 1684 may include any number of forms of audio or visual display, including simple visual outputs such as binary status indicators (e.g., light-emitting diodes (LEDs)) and multi-character visual outputs, or more complex outputs such as display screens (e.g., liquid crystal display (LCD) screens), with the output of characters, graphics, multimedia objects, and the like being generated or produced from the operation of the edge computing node 1650. A display or console hardware, in the context of the present system, may be used to provide output and receive input of an edge computing system; to manage components or services of an edge computing system; identify a state of an edge computing component or service; or to conduct any other number of management or administration functions or service use cases. These various input/output devices may be directly connected to the computing device or remotely located as part of various manufacturing modules. In examples, notifications can be provided to more than one device simultaneously, for example, an operator can view notifications on individual modules of the system 100. Simultaneously or near simultaneously, based proximity or other criteria, notifications can be provided to the operator's smartphone or other device.

A battery 1676 may power the edge computing node 1650, although, in examples in which the edge computing node 1650 is mounted in a fixed location, it may have a power supply coupled to an electrical grid, or the battery may be used as a backup or for temporary capabilities. The battery 1676 may be a lithium-ion battery, or a metal-air battery, such as a zinc-air battery, an aluminum-air battery, a lithium-air battery, and the like.

A battery monitor/charger 1678 may be included in the edge computing node 1650 to track the state of charge (SoCh) of the battery 1676, if included. The battery monitor/charger 1678 may be used to monitor other parameters of the battery 1676 to provide failure predictions, such as the state of health (SoH) and the state of function (SoF) of the battery 1676. The battery monitor/charger 1678 may communicate the information on the battery 1676 to the processor 1652 over the interconnect 1656. The battery monitor/charger 1678 may also include an analog-to-digital (ADC) converter that enables the processor 1652 to directly monitor the voltage of the battery 1676 or the current flow from the battery 1676.

A power block 1680, or other power supply coupled to a grid, may be coupled with the battery monitor/charger 1678 to charge the battery 1676. In some examples, the power block 1680 may be replaced with a wireless power receiver to obtain the power wirelessly, for example, through a loop antenna in the edge computing node 1650. The specific charging circuits may be selected based on the size of the battery 1676, and thus, the current required.

The storage 1658 may include instructions 1682 in the form of software, firmware, or hardware commands to implement the techniques described herein. Although such instructions 1682 are shown as code blocks included in the memory 1654 and the storage 1658, it may be understood that any of the code blocks may be replaced with hardwired circuits, for example, built into an application specific integrated circuit (ASIC).

In an example, the instructions 1682 provided via the memory 1654, the storage 1658, or the processor 1652 may be embodied as a non-transitory, machine-readable medium 1660 including code to direct the processor 1652 to perform electronic operations in the edge computing node 1650. The processor 1652 may access the non-transitory, machine-readable medium 1660 over the interconnect 1656. For instance, the non-transitory, machine-readable medium 1660 may be embodied by devices described for the storage 1658 or may include specific storage units such as optical disks, flash drives, or any number of other hardware devices. The non-transitory, machine-readable medium 1660 may include instructions to direct the processor 1652 to perform a specific sequence or flow of actions, for example, as described with respect to the flowchart(s) and block diagram (s) of operations and functionality depicted above. As used herein, the terms "machine-readable medium" and "computer-readable medium" are interchangeable.

Also, in a specific example, the instructions 1682 on the processor 1652 (separately, or in combination with the instructions 1682 of the machine readable medium 1660) may configure execution or operation of a trusted execution environment (TEE) 1690. In an example, the TEE 1690 operates as a protected area accessible to the processor 1652 for secure execution of instructions and secure access to data. Such access can be provided to, for example, other components of the system 200.

In further examples, a machine-readable medium also includes any tangible medium that is capable of storing, encoding, or carrying instructions for execution by a machine and that cause the machine to perform any one or more of the methodologies of the present disclosure or that is capable of storing, encoding or carrying data structures utilized by or associated with such instructions. A "machine-readable medium" thus may include but is not limited to, solid-state memories, and optical and magnetic media. Specific examples of machine-readable media include non-volatile memory, including but not limited to, by way of example, semiconductor memory devices (e.g., electrically programmable read-only memory (EPROM), electrically erasable programmable read-only memory (EEPROM)) and flash memory devices; magnetic disks such as internal hard disks and removable disks; magneto-optical disks; and CD-ROM and DVD-ROM disks. The instructions embodied by a machine-readable medium may further be transmitted or received over a communications network using a transmission medium via a network interface device utilizing any one of a number of transfer protocols (e.g., Hypertext Transfer Protocol (HTTP)).

A machine-readable medium may be provided by a storage device or other apparatus which is capable of hosting data in a non-transitory format. In an example, information stored or otherwise provided on a machine-readable medium may be representative of instructions, such as instructions themselves or a format from which the instructions may be derived. This format from which the instructions may be derived may include source code, encoded instructions (e.g., in compressed or encrypted form), packaged instructions (e.g., split into multiple packages), or the like. The information representative of the instructions in the machine-readable medium may be processed by processing circuitry into the instructions to implement any of the operations discussed herein. For example, deriving the instructions from the information (e.g., processing by the processing circuitry) may include: compiling (e.g., from source code, object code, etc.), interpreting, loading, organizing (e.g., dynamically or statically linking), encoding, decoding, encrypting, unencrypting, packaging, unpackaging, or otherwise manipulating the information into the instructions.

In an example, the derivation of the instructions may include assembly, compilation, or interpretation of the information (e.g., by the processing circuitry) to create the instructions from some intermediate or preprocessed format provided by the machine-readable medium. The information, when provided in multiple parts, may be combined, unpacked, and modified to create the instructions. For example, the information may be in multiple compressed source code packages (or object code, or binary executable code, etc.) on one or several remote servers. The source code packages may be encrypted when in transit over a network and decrypted, uncompressed, assembled (e.g., linked) if necessary, and compiled or interpreted (e.g., into a library, stand-alone executable, etc.) at a local machine, and executed by the local machine.

Herein, the term "comprises," and variations thereof do not have a limiting meaning where these terms appear in the description and claims. Such terms will be understood to imply the inclusion of a stated step or element or group of steps or elements but not the exclusion of any other step or element or group of steps or elements. By "consisting of" is meant including, and limited to, whatever follows the phrase "consisting of" Thus, the phrase "consisting of" indicates that the listed elements are required or mandatory, and that no other elements may be present. By "consisting essentially of" is meant including any elements listed after the phrase and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether they materially affect the activity or action of the listed elements. Any of the elements or combinations of elements that are recited in this specification in open-ended language (e.g., comprise and derivatives thereof), are considered to additionally be recited in closed-ended language (e.g., consist and derivatives thereof) and in partially closed-ended language (e.g., consist essentially, and derivatives thereof).

The words "preferred" and "preferably" refer to embodiments of the disclosure that may afford certain benefits, under certain circumstances. However, other embodiments may also be preferred, under the same or other circumstances. Furthermore, the recitation of one or more preferred embodiments does not imply that other claims are not useful and is not intended to exclude other embodiments from the scope of the disclosure.

In this application, terms such as "a," "an," and "the" are not intended to refer to only a singular entity but include the general class of which a specific example may be used for illustration. The terms "a," "an," and "the" are used interchangeably with the term "at least one." The phrases "at least one of" and "comprises at least one of" followed by a list refers to any one of the items in the list and any combination of two or more items in the list.

As used herein, the term "or" is generally employed in its usual sense including "and/or" unless the content clearly dictates otherwise.

The term "and/or" means one or all the listed elements or a combination of any two or more of the listed elements.

Also herein, all numbers are assumed to be modified by the term "about" and in certain embodiments, preferably, by the term "exactly." As used herein in connection with a measured quantity, the term "about" refers to that variation in the measured quantity as would be expected by the skilled artisan making the measurement and exercising a level of care commensurate with the objective of the measurement and the precision of the measuring equipment used. Herein, "up to" a number (e.g., up to 50) includes the number (e.g., 50).

Also herein, the recitations of numerical ranges by endpoints include all numbers subsumed within that range as well as the endpoints (e.g., 1 to 5 includes 1, 1.5, 2, 2.75, 3, 3.80, 4, 5, etc.) and any sub-ranges (e.g., 1 to 5 includes 1 to 4, 1 to 3, 2 to 4, etc.).

As used herein, the term "room temperature" refers to a temperature of 20° C. to 25° C.

The term "in the range" or "within a range" (and similar statements) includes the endpoints of the stated range.

Reference throughout this specification to "one embodiment," "an embodiment," "certain embodiments," or "some embodiments," etc., means that a particular feature, configuration, composition, or characteristic described in connection with the embodiment is included in at least one embodiment of the disclosure. Thus, the appearances of such phrases in various places throughout this specification are not necessarily referring to the same embodiment of the disclosure. Furthermore, the features, configurations, compositions, or characteristics may be combined in any suitable manner in one or more embodiments.

The tape splicing module, tape applicator, and the extended liner module are more specific to tapes. Other embodiments described herein can be used directly or with analogous versions for liquid adhesives and coatings.

Examples

These examples are merely for illustrative purposes and are not meant to be overly limiting on the scope of the appended claims. Notwithstanding that the numerical ranges and parameters setting forth the broad scope of the present disclosure are approximations, the numerical values set forth in the specific examples are reported as precisely as possible. Any numerical value, however, inherently contains certain errors necessarily resulting from the standard deviation found in their respective testing measurements. At the very least, and not as an attempt to limit the application of the doctrine of equivalents to the scope of the claims, each numerical parameter should at least be construed considering the number of reported significant digits and by applying ordinary rounding.

Unless otherwise noted, all chemicals used in the examples can be obtained from the noted suppliers.

Test Methods:

90° Peel Adhesion Test:

The adhesive performance of a test tape is measured by a 90° Peel Adhesion Test based on ASTM D3330, Test Method F to a variety of substrates with the following test conditions:

The test tape was prepared by laminating the non-linered side of the acrylic foam tape to a 5 mil (0.127 mm) thick anodized aluminum foil backing. A 16 mm wide by about 150 mm long test strip was slit from the test tape. The test panel substrates were cleaned with at least two wipes with isopropyl alcohol.

Five Acrylic Foam Tapes were tested:

3M™ VHB™ 4910
3M™ VHB™ 4941
3M™ VHB™ 4950
3M™ VHB™ GPH110
3M™ VHB™ LSE110

The liner was removed, and the test tape was rolled down onto the test panel substrate with a 5 kg rubber coated roller, one pass in each direction. The bonded sample were allowed a 72-hour room temperature dwell (23 C+/−3 C and 50+/−5% Relative Humidity) before testing. The 90° Peel Adhesion was determined at a peel rate of 30 cm/minute (12 inches/minute) and was measured on an Instron or equivalent tensile tester. The average 90° Peel Adhesion was measured and converted into Newtons per meter (N/m). Three test samples were tested for each condition.

The complete disclosures of the patents, patent documents, and publications cited herein are incorporated by reference in their entirety as if each were individually incorporated. To the extent that there is any conflict or discrepancy between this specification as written and the disclosure in any document that is incorporated by reference herein, this specification as written will control. Various modifications and alterations to this disclosure will become apparent to those skilled in the art without departing from the scope and spirit of this disclosure. This disclosure is not intended to be unduly limited by the illustrative embodiments and examples set forth herein and that such examples and embodiments are presented by way of example only with the scope of the disclosure intended to be limited only by the claims set forth herein as follows.

What is claimed is:

1. A hand tape applicator comprising:
a body;
a spindle connected to the body and configured to receive a tape roll comprising tape;
an handle connected to the body
a roller mechanism connected to the body and configured to apply the tape to a substrate, wherein the roller mechanism comprises:
a head;
a tape roller extending along a roller axis between a first end and a second end of the tape roller, wherein the tape roller is connected to the head at each of the first and second ends; and
a first connector that connects the first end of the tape roller to the head and a second connector that connects the second end of the tape roller to the head; and
a force sensor connected to the head, wherein the force sensor is configured to detect a force between the tape roller and the head and provide a signal indicative of the force;
wherein the first connector comprises a first actuator and the second connector comprises a second actuator.

2. The hand tape applicator of claim 1, further comprising a processor configured to receive the signal from the force sensor and provide feedback to an operator regarding the force.

3. The hand tape applicator of claim 2, wherein the processor is further configured to adjust a force between the tape roller and the head to provide a selected force per unit width to the tape as the tape is applied to the substrate.

4. The hand tape applicator of claim 1, wherein each of the first and second connectors comprises at least one of a spring, a hinge, a shock absorber, or a strut.

5. The hand tape applicator of claim 2, wherein each of the first and second actuators are connected to the processor.

6. The hand tape applicator of claim 5, wherein the processor is further configured to independently actuate at least one of the first or second actuators to adjust the force between the head and each of the first and second ends of the tape roller.

7. The hand tape applicator of claim 6, wherein the processor is further configured to direct the first and second actuators in an oscillating motion such that the tape roller oscillates or percusses while applying the tape to the substrate.

8. The hand tape applicator of claim 2, wherein the processor is further configured to log or map the force signal from the sensor in relation to a position along an applied tape length.

9. The hand tape applicator of claim 1, further comprising a pivoting mechanism that connects the head to the body, wherein the pivoting mechanism is configured to pivot the tape roller in relation to the body.

10. The hand tape applicator of claim 1, further comprising a second tape roller connected to the head, wherein at least one of the tape roller or the second tape roller is configured to apply force to the tape after the tape has been applied to the substrate.

11. The hand tape applicator of claim 1, wherein the handle is reconfigurable to accommodate different operators.

12. The hand tape applicator of claim 1, further comprising a laser guide connected to the body or the roller mechanism, wherein the laser guide is configured to indicate to an operator at least one of a desired starting position of the tape when the tape is applied to the substrate, a desired stopping position of the tape that has been applied to the substrate, or a path of the tape as it is applied to the substrate.

13. The hand tape applicator of claim 1, further comprising a cutting mechanism connected to the body and adapted to separate a portion of the tape from the tape roll.

14. A tape application system comprising:

a tape entry module comprising an input tape;

a hand tape applicator connected to the tape entry module, wherein the hand tape applicator module comprises:

a body;

a roller mechanism connected to the body and configured to apply the input tape to a substrate, wherein the roller mechanism comprises:

a head;

a tape roller extending along a roller axis between a first end and a second end of the tape roller, wherein the tape roller is connected to the head at each of the first and second ends; and a first connector that connects the first end of the tape roller to the head and a second connector that connects the second end of the tape roller to the head; and a force sensor connected to the head, wherein the force sensor is configured to detect a force between the tape roller and the head and provide a signal indicative of the force; and data acquisition equipment connected to the tape entry module and the hand tape applicator module;

wherein the first connector comprises a first actuator and the second connector comprises a second actuator.

15. The system of claim 14, further comprising a surface characterization module and a surface preparation module, wherein the surface characterization module and the surface preparation module are connected to the data acquisition equipment, wherein the surface characterization module is configured to characterize surface quality of the surface of the substrate prior to application of the input tape, and further wherein the force between the tape roller and the head of the hand tape applicator is adjustable based upon the surface quality of the surface of the substrate.

16. The system of claim 15, wherein the data acquisition equipment comprises a processor configured to provide an indication of a remedial action to the surface preparation module that is responsive to an adverse surface quality condition detected by the surface characterization module.

17. The system of claim 14, wherein the hand tape applicator further comprises a processor configured to receive the signal from the force sensor and provide feedback to an operator regarding the force.

18. The system of claim 17, wherein the processor is further configured to determine a target force based on at least one of tape width, tape type, tape thickness, substrate surface condition, surface texture, or surface temperature.

19. A method comprising:

disposing a tape on a surface of a substrate utilizing a hand tape applicator that comprises a roller mechanism comprising a head and a tape roller connected to the head at a first end and a second end of the tape roller;

detecting a force between the tape roller and the head while disposing the tape on the surface of the substrate;

communicating a signal indicative of the force; and adjusting the force between the tape roller and the head while disposing the tape on the surface of the substrate based upon the signal; wherein adjusting the force comprises adjusting a first actuator connected to a first end of the tape roller and a second actuator connected to a second end of the tape roller.

* * * * *